US010921748B2

(12) United States Patent
Haruta et al.

(10) Patent No.: US 10,921,748 B2
(45) Date of Patent: Feb. 16, 2021

(54) IMAGE FORMING APPARATUS WITH ROLLER-DRIVABLE MECHANISM, ROLLER-MOVABLE MECHANISM, AND NIPPING-FORCE ADJUSTABLE MECHANISM

(71) Applicant: BROTHER KOGYO KABUSHIKI KAISHA, Nagoya (JP)

(72) Inventors: Kotaro Haruta, Yokkaichi (JP); Masahito Saeki, Nagoya (JP); Shoichiro Nishimura, Yokkaichi (JP); Tomonori Watanabe, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/715,968

(22) Filed: Dec. 16, 2019

(65) Prior Publication Data

US 2020/0310281 A1 Oct. 1, 2020

(30) Foreign Application Priority Data

Mar. 28, 2019 (JP) ..... 2019-062951

(51) Int. Cl.
*G03G 21/18* (2006.01)
*G03G 15/08* (2006.01)
(Continued)

(52) U.S. Cl.
CPC ..... *G03G 21/1857* (2013.01); *G03G 15/087* (2013.01); *G03G 15/0808* (2013.01); *G03G 15/1675* (2013.01); *G03G 15/2053* (2013.01)

(58) Field of Classification Search
CPC ..... G03G 21/1857
See application file for complete search history.

(56) References Cited

U.S. PATENT DOCUMENTS 5,933,687 A 8/1999 Okuno et al.
5,970,286 A 10/1999 Numazu et al.
(Continued)

FOREIGN PATENT DOCUMENTS

JP 5-297763 A 11/1993
JP 11-30894 A 2/1999
(Continued)

*Primary Examiner* — Walter L Lindsay, Jr.
*Assistant Examiner* — Arlene Heredia
(74) *Attorney, Agent, or Firm* — Merchant & Gould P.C.

(57) ABSTRACT

An image forming apparatus, having a photosensitive drum, a developing roller movable between a contacting position, in which the developing roller contacts the photosensitive drum, and a separated position, in which the developing roller is separated from the photosensitive drum, a moving mechanism to move the developing roller between the contacting position and the separated position, a fuser including a heating member and a pressing member to nip a sheet at a position between the heating member and the pressing member, a nipping-force adjuster to switch a nipping force in the fuser between a first nipping force and a second nipping force being greater than the first nipping force, a motor, and a driving-force transmitter to transmit a driving force from the motor to the developing roller, is provided. The driving-force transmitter transmits the driving force further to the moving mechanism and the nipping-force adjuster.

19 Claims, 30 Drawing Sheets

(51) Int. Cl.
*G03G 15/20* (2006.01)
*G03G 15/16* (2006.01)

(56) References Cited

U.S. PATENT DOCUMENTS

| | | | | |
|---|---|---|---|---|
| 7,643,785 | B2 * | 1/2010 | Matsubara | G03G 15/206 399/329 |
| 9,256,177 | B2 * | 2/2016 | Watanabe | G03G 15/2064 |
| 9,335,718 | B2 * | 5/2016 | Suzuki | G03G 21/1647 |
| 2007/0031166 | A1 | 2/2007 | Zensai | |
| 2011/0091237 | A1 | 4/2011 | Suzuki | |
| 2015/0093152 | A1 | 4/2015 | Hashimoto | |

FOREIGN PATENT DOCUMENTS

| | | | |
|---|---|---|---|
| JP | 11-52651 | A | 2/1999 |
| JP | 2000-250315 | A | 9/2000 |
| JP | 2000-293003 | A | 10/2000 |
| JP | 2002-189322 | A | 7/2002 |
| JP | 2004-205688 | A | 7/2004 |
| JP | 2005-215107 | A | 8/2005 |
| JP | 2006-17988 | A | 1/2006 |
| JP | 2007-65632 | A | 3/2007 |
| JP | 2009-139682 | A | 6/2009 |
| JP | 2011-90040 | A | 5/2011 |
| JP | 2011-137987 | A | 7/2011 |
| JP | 2015-69031 | A | 4/2015 |

* cited by examiner

IMAGE FORMING APPARATUS WITH ROLLER-DRIVABLE MECHANISM, ROLLER-MOVABLE MECHANISM, AND NIPPING-FORCE ADJUSTABLE MECHANISM

CROSS REFERENCE TO RELATED APPLICATION

This application claims priority from Japanese Patent Application No. 2019-062951, filed on Mar. 28, 2019, the entire subject matter of which is incorporated herein by reference.

BACKGROUND

Technical Field

An aspect of the present disclosure is related to an image forming apparatus, having a photosensitive drum, a developing roller, and a fuser, capable of forming an image electro-photographically.

Related Art

Image forming apparatuses for forming images electro-photographically are known. For example, an electro-photographic image forming apparatus may have a cam to adjust nipping force in a fuser and a dedicated motor to move the cam. For another example, an electro-photographic image forming apparatus may have a moving device to move a developing roller between a contacting position, in which the developing roller contacts a photosensitive drum, and a separated position, in which the developing roller is separated from the photosensitive drum. The image forming apparatus may be equipped with a single motor, which may drive both rotation of the developing roller and movements of the moving device.

SUMMARY

In this regard, generally, it may be preferable to reduce a quantity of motors in an image forming apparatus to drive movable elements.

The present disclosure is advantageous in that an image forming apparatus, in which rotation of a developing roller, contacting/separating movements of the developing roller, and adjustment of nipping force in a fuser may be driven by a single motor, is provided.

According to an aspect of the present disclosure, an image forming apparatus, having a photosensitive drum, a developing roller, a moving mechanism a fuser, a nipping-force adjuster, a motor, and a driving-force transmitter, is provided. The developing roller is configured to be movable between a contacting position, in which the developing roller contacts the photosensitive drum, and a separated position, in which the developing roller is separated from the photosensitive drum. The moving mechanism is configured to move the developing roller between the contacting position and the separated position. The fuser includes a heating member and a pressing member. The pressing member is configured to nip a sheet at a position between the heating member and the pressing member. The nipping-force adjuster is configured to switch a nipping force between the heating member and the pressing member in the fuser between a first nipping force and a second nipping force. The second nipping force is greater than the first nipping force.

The driving-force transmitter is configured to transmit a driving force from the motor to the developing roller. The driving-force transmitter is further configured to transmit the driving force from the motor to the moving mechanism and the nipping-force adjuster.

According to another aspect of the present disclosure, an image forming apparatus, having a photosensitive drum, a developing roller, a moving mechanism, a fuser, a nipping-force adjuster, and a development motor, is provided. The developing roller is configured to be movable between a contacting position, in which the developing roller contacts the photosensitive drum, and a separated position, in which the developing roller is separated from the photosensitive drum. The moving mechanism is configured to move the developing roller between the contacting position and the separated position. The fuser includes a heating member and a pressing member. The nipping-force adjuster is configured to switch a nipping force between the heating member and the pressing member in the fuser between a first nipping force and a second nipping force. The second nipping force is greater than the first nipping force. The development motor is configured to drive the developing roller, the moving mechanism, and the nipping-force adjuster.

BRIEF DESCRIPTION OF THE ACCOMPANYING DRAWINGS

Figure 12A:
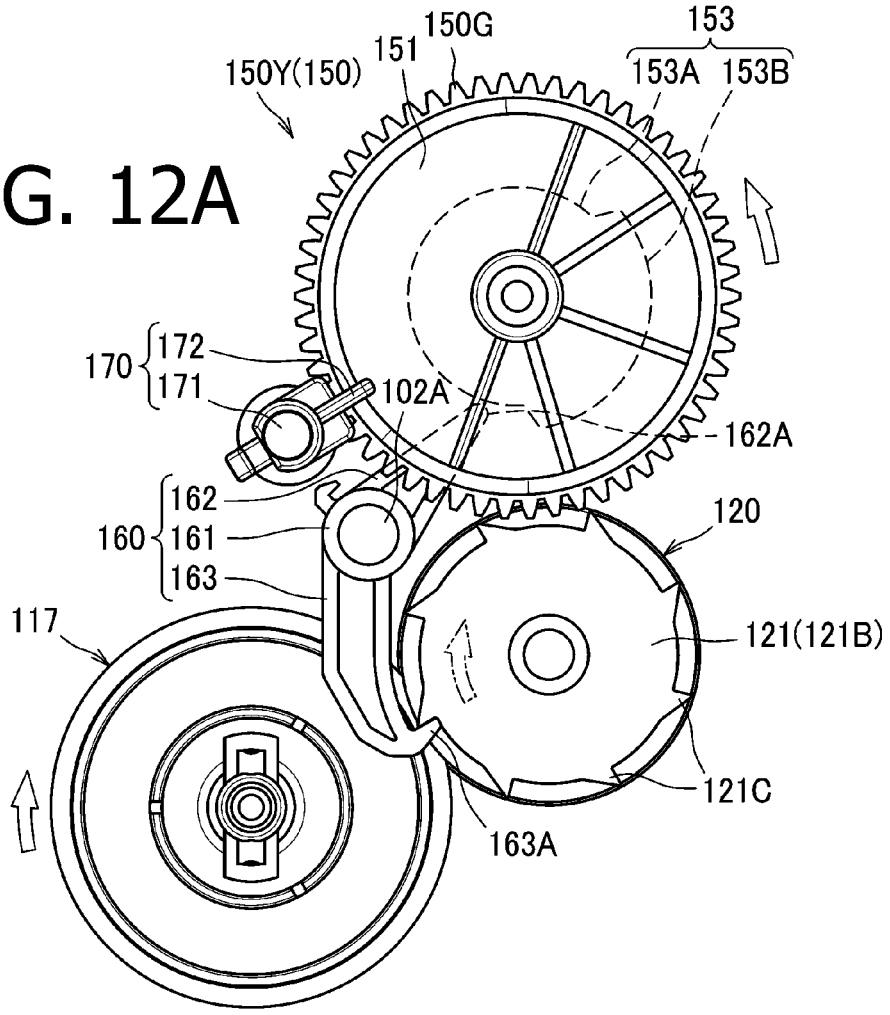
FIGS. 12A and 12B are a side view of a moving mechanism with a clutch in a transmittable condition, alongside a lever and a coupling gear, viewed along the axial direction, and a perspective view of the moving mechanism, respectively, in the image forming apparatus according to the embodiment of the present disclosure.
Figure 12B:
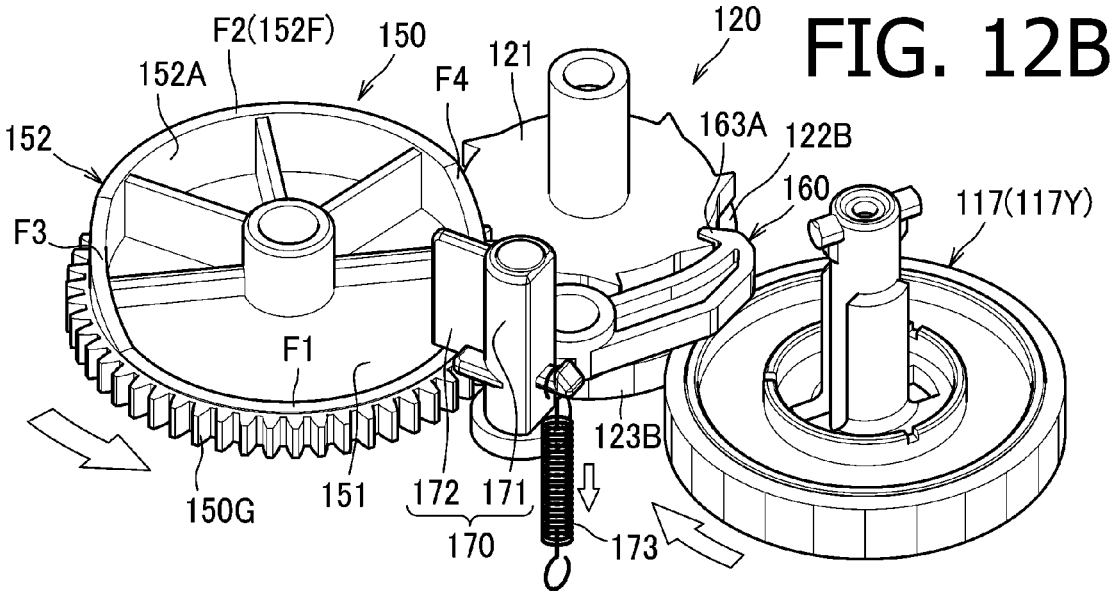
Figure 13A:
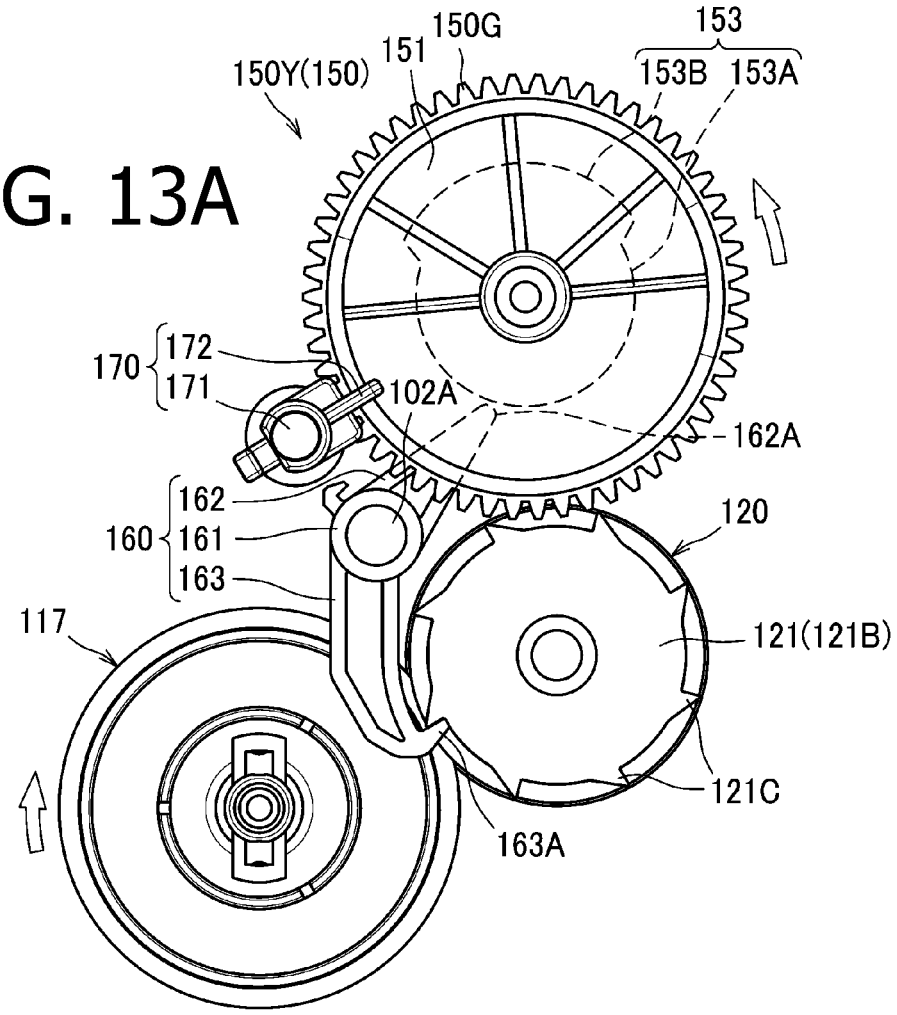
Figure 13B:
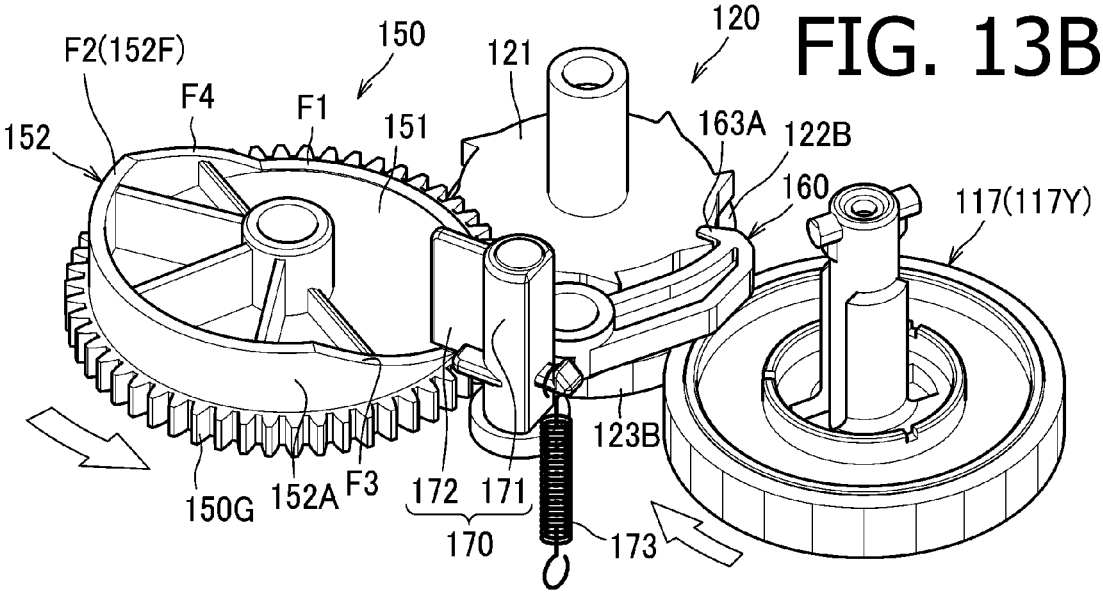

FIGS. 13A and 13B are a side view of the moving mechanism with the cam rotated from the position shown in FIGS. 12A-12B, alongside the lever, the clutch, and the coupling gear, when a developing roller for yellow is at a contacting position to form an image, viewed along the axial direction, and a perspective view of the moving mechanism, respectively, in the image forming apparatus according to the embodiment of the present disclosure.

Figure 14A:
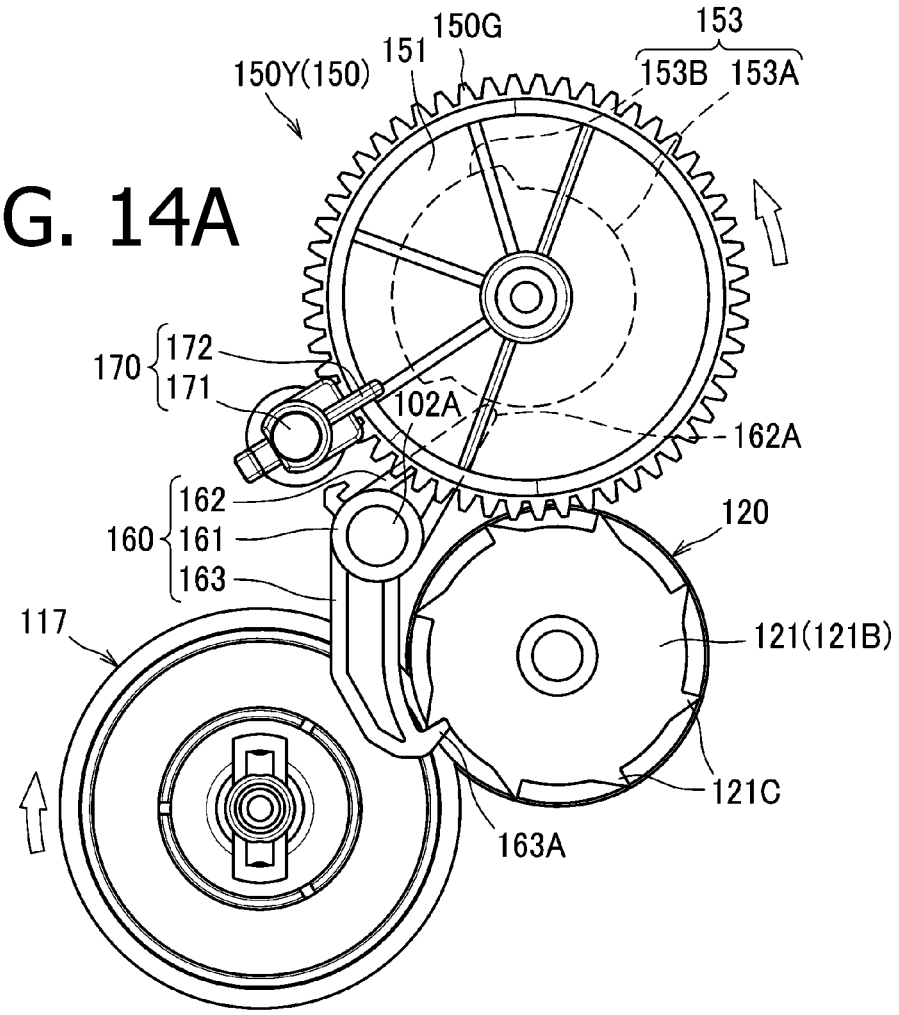
Figure 14B:
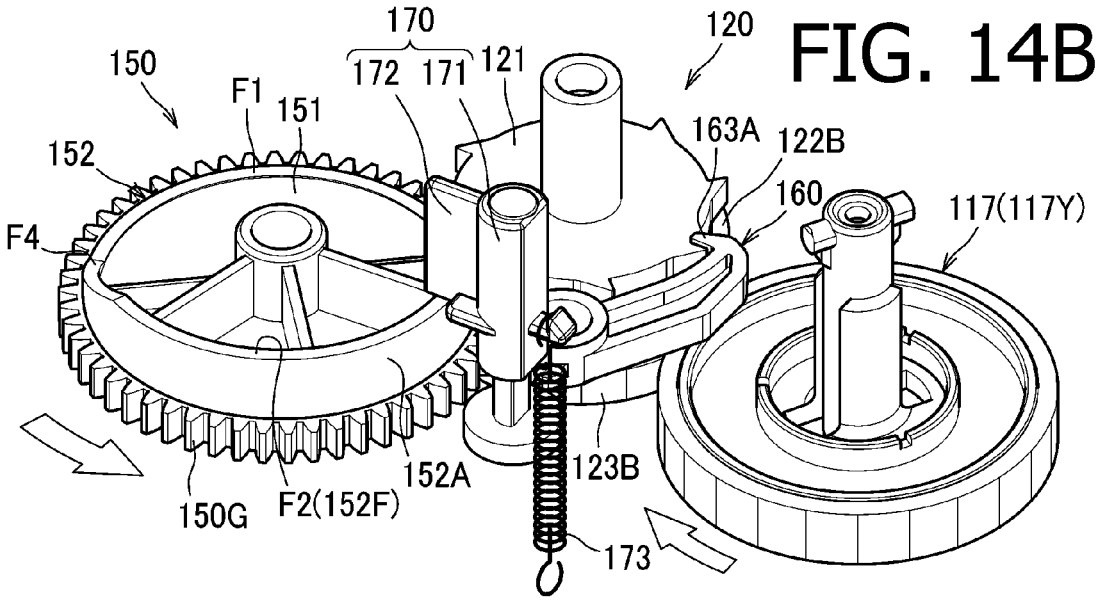

FIGS. 14A and 14B are a side view of the moving mechanism with the cam rotated from the position shown in FIGS. 13A-13B, alongside the lever, the clutch, and the coupling gear, when the developing roller is at a separated position and the clutch is in the transmittable condition, viewed along the axial direction, and a perspective view of the moving mechanism, respectively, in the image forming apparatus according to the embodiment of the present disclosure.

Figure 15A:
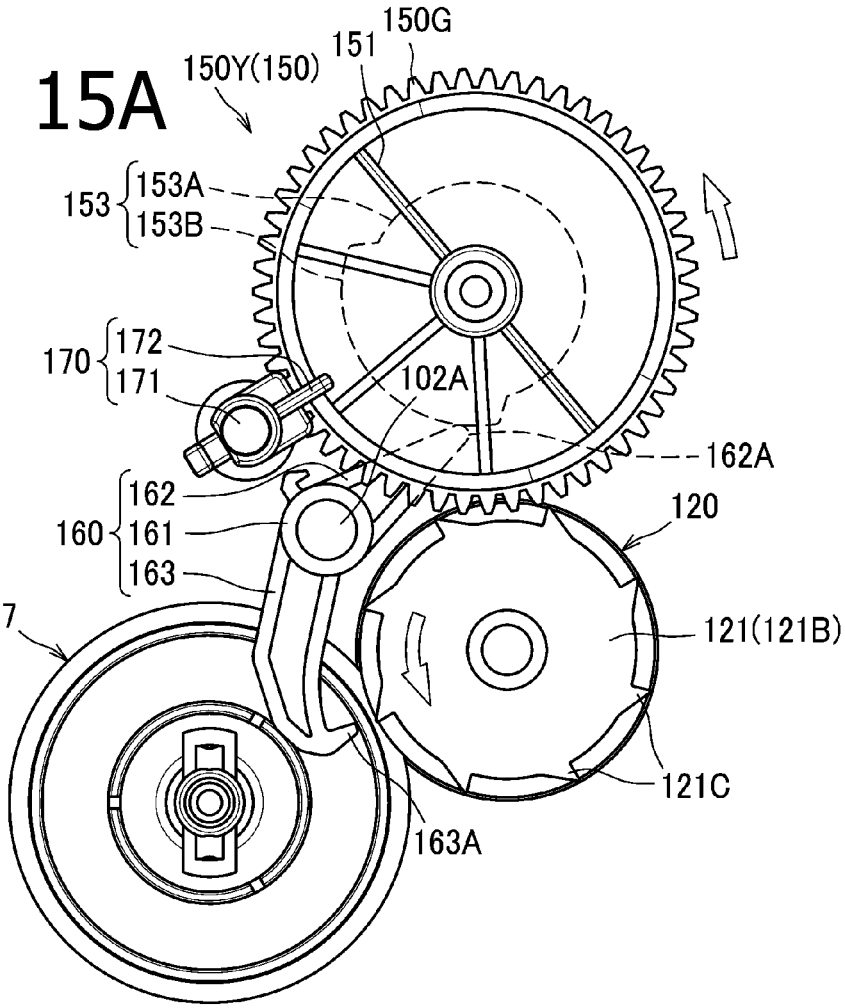
Figure 15B:
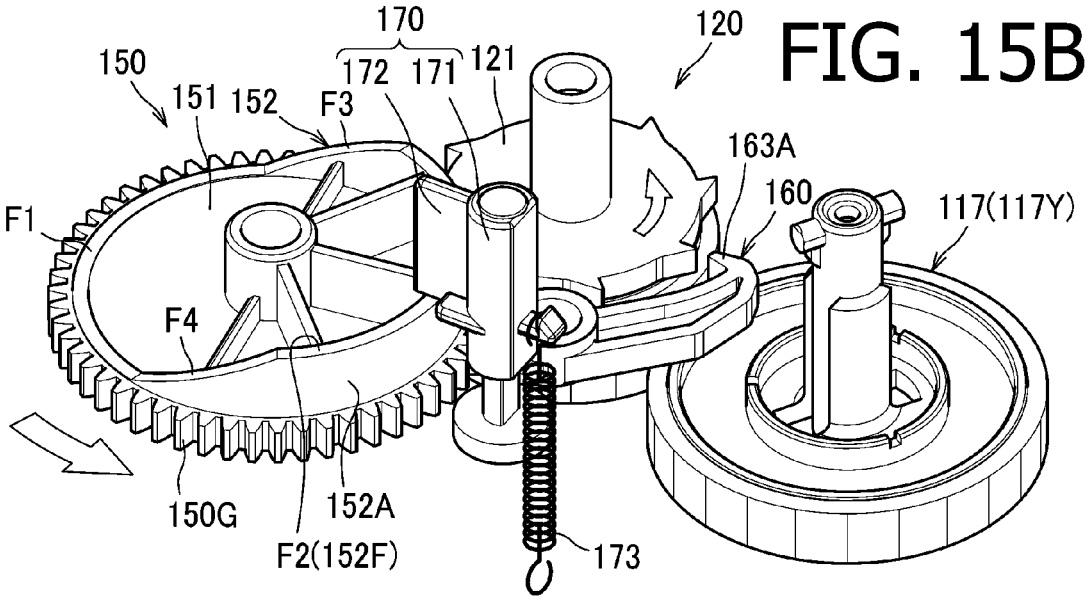

FIGS. 15A and 15B are a side view of the moving mechanism with the cam rotated from the position shown in FIGS. 14A-14B, alongside the lever, the clutch, and the coupling gear, when the developing roller is at the separated position and the clutch is in a discontinuing condition, viewed along the axial direction, and a perspective view of the moving mechanism, respectively, in the image forming apparatus according to the embodiment of the present disclosure.

Figure 16A:
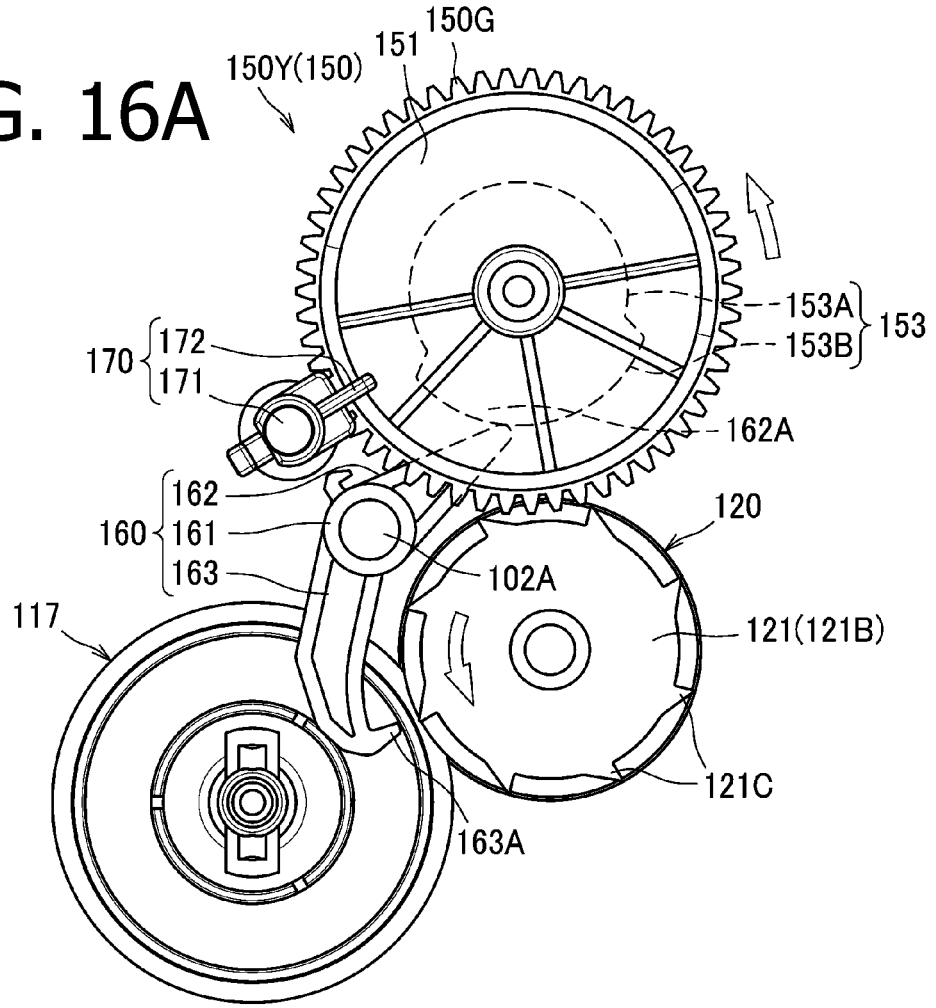
Figure 16B:
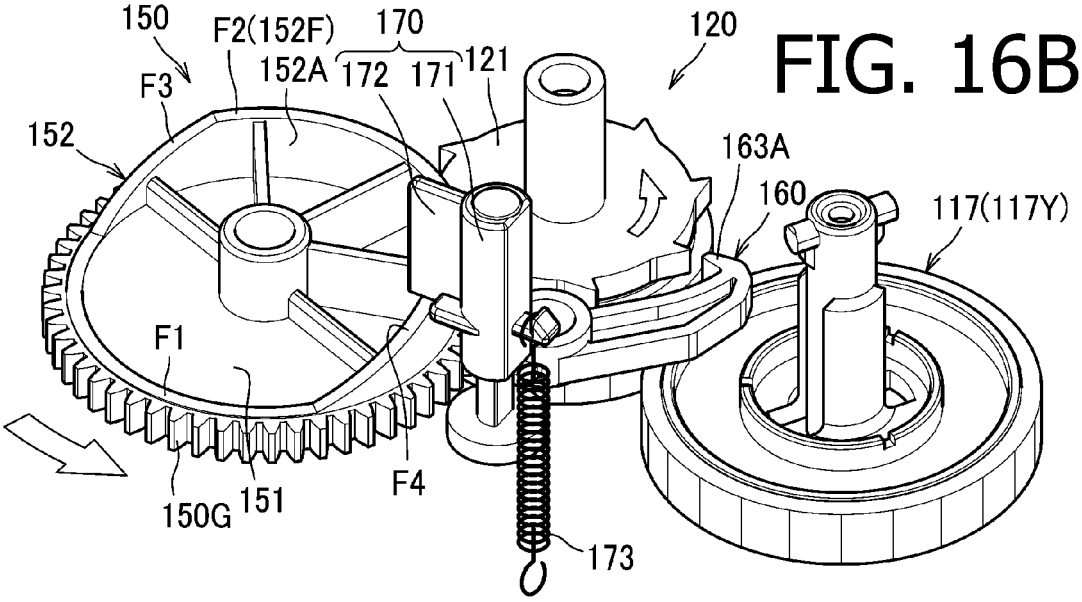

FIGS. 16A and 16B are a side view of the moving mechanism with the cam rotated from the position shown in FIGS. 15A-15B, alongside the lever, the clutch, and the coupling gear, when the developing roller for yellow is pausing before moving to the contacting position, viewed along the axial direction, and a perspective view of the moving mechanism, respectively, in the image forming apparatus according to the embodiment of the present disclosure.

Figure 17A:
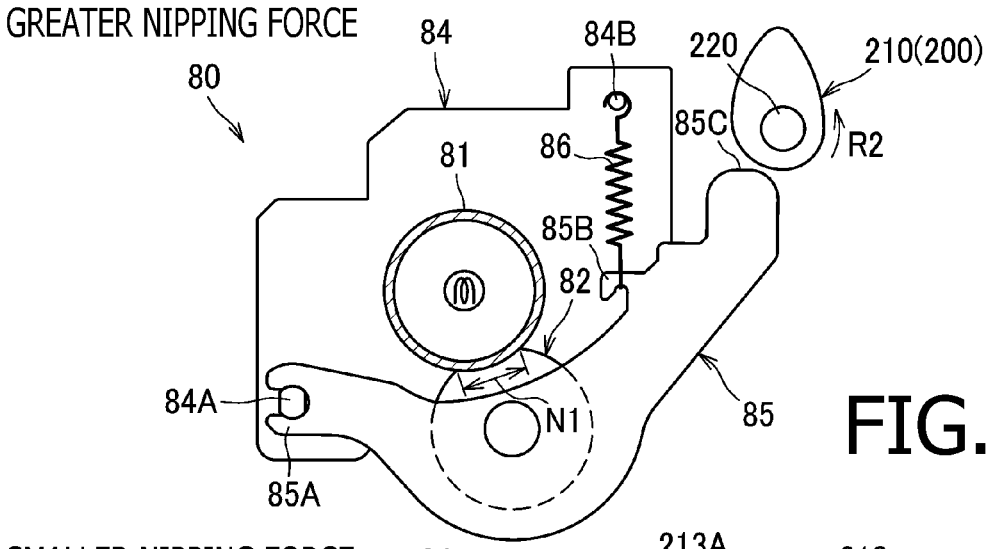
Figure 17B:
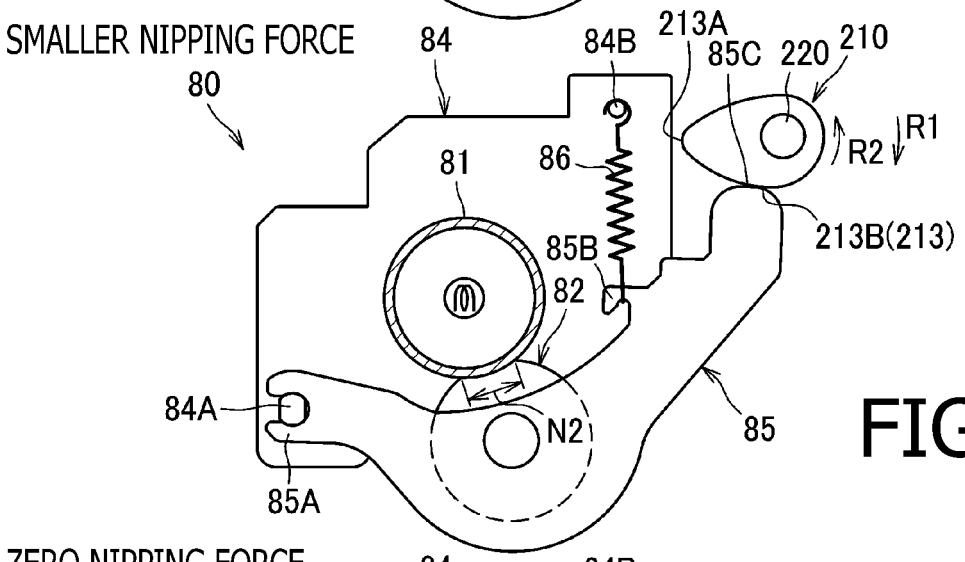
Figure 17C:
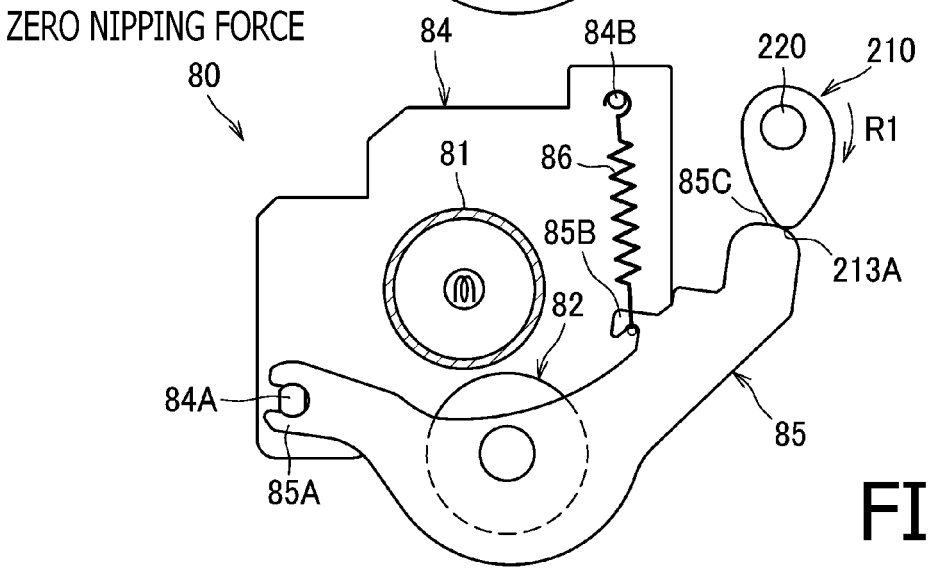

FIGS. 17A-17C illustrate a fuser and a second cam, in which a nipping force between heating roller and a pressing roller is greater, smaller, and none (zero), respectively, in the image forming apparatus according to the embodiment of the present disclosure.

Figure 18A:
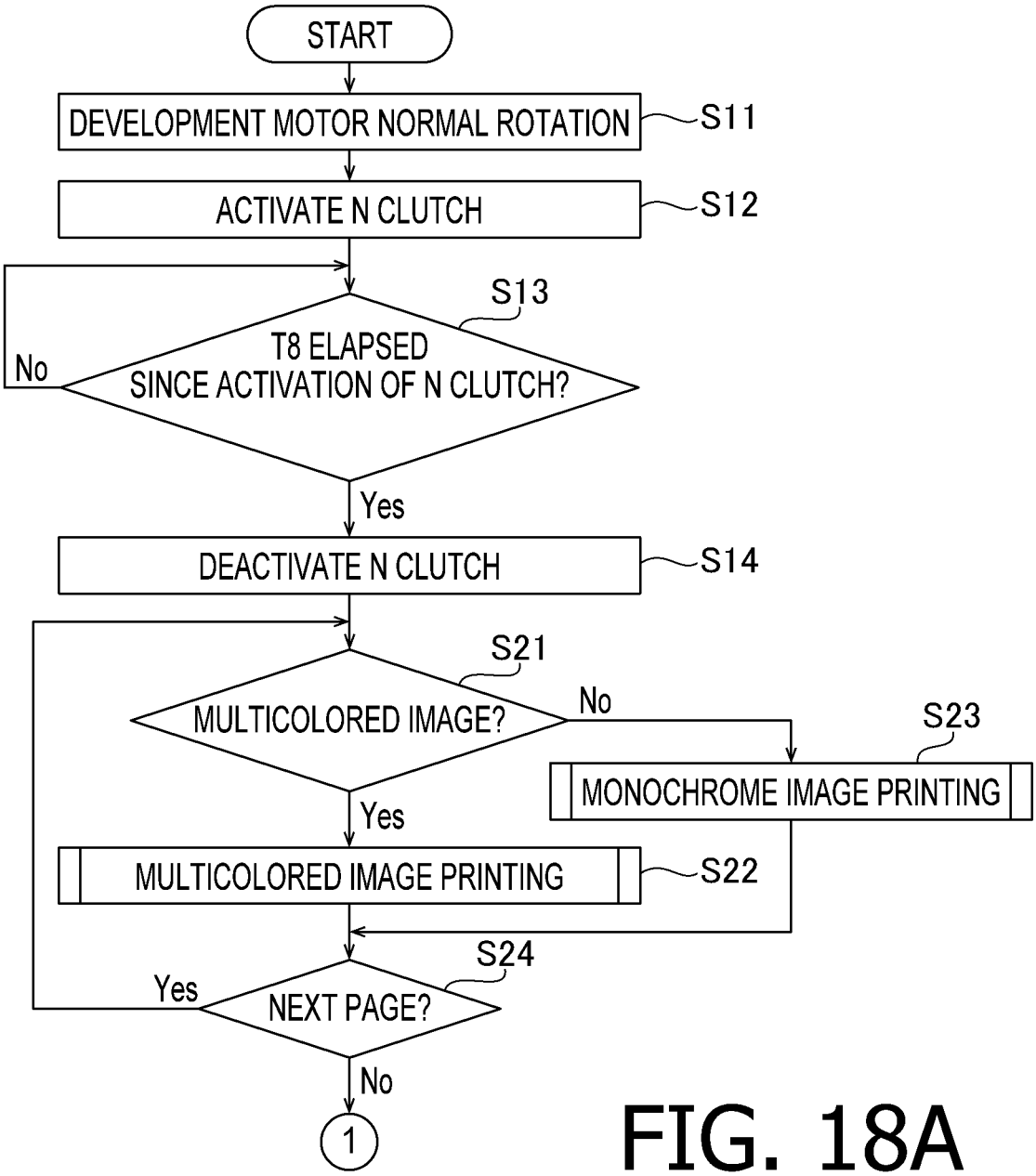
Figure 18B:
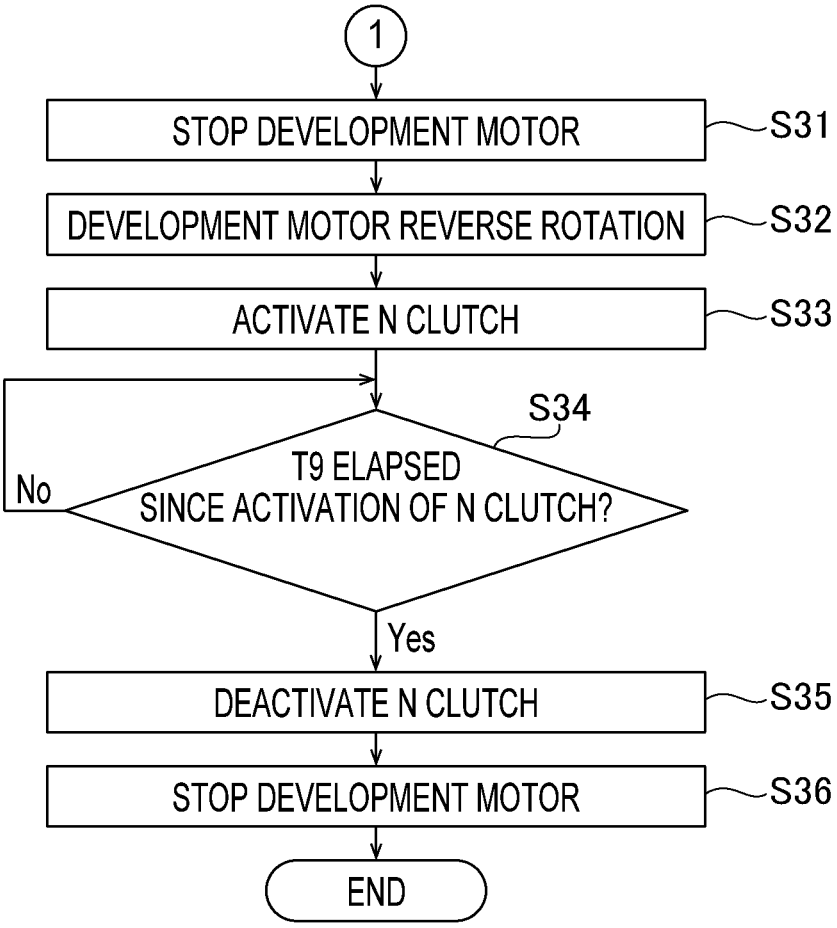

FIGS. 18A-18B are flowcharts to illustrate flows of steps to be conducted when a print job is received in the image forming apparatus according to the embodiment of the present disclosure.

Figure 19A:
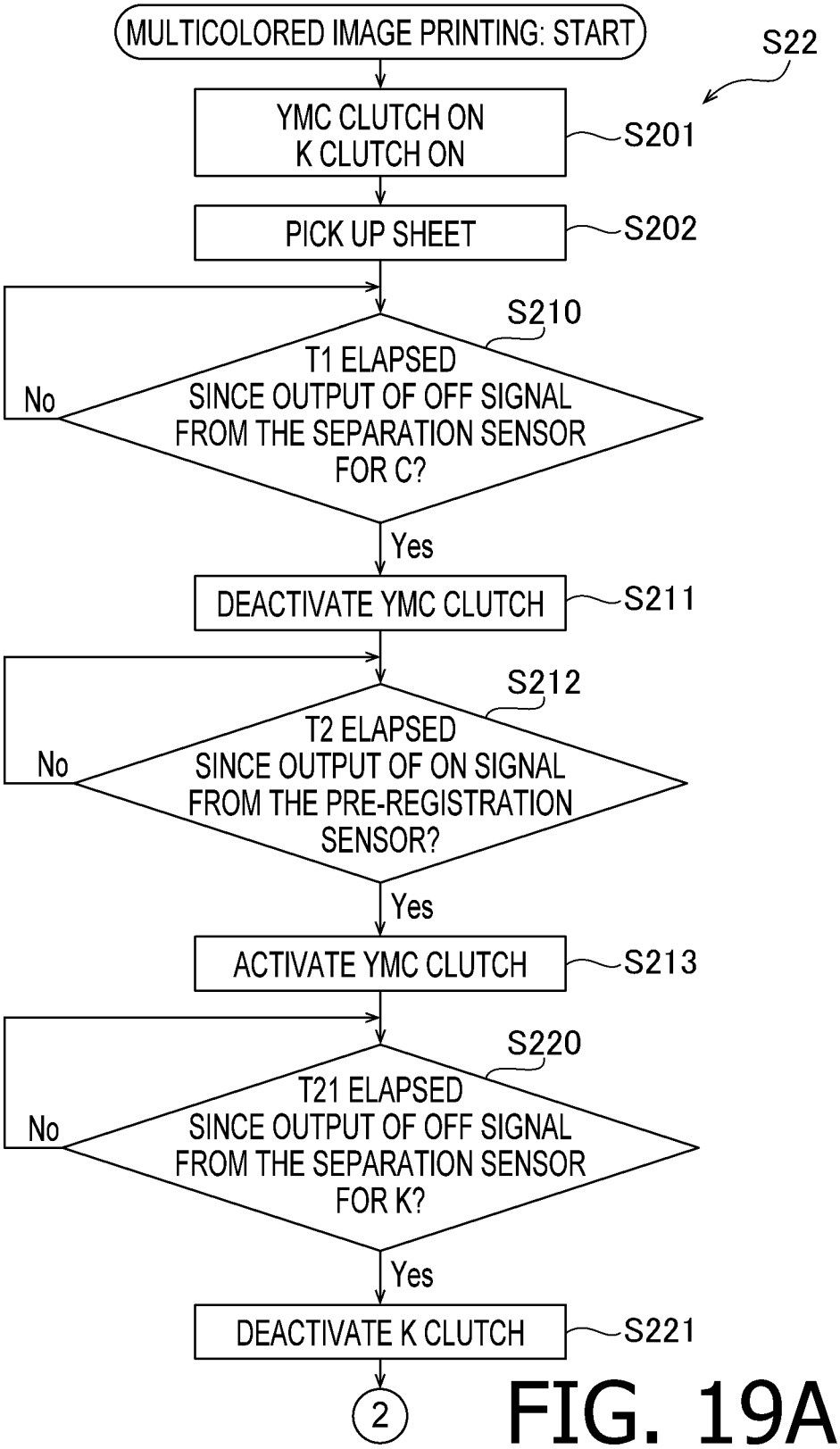
Figure 19B:
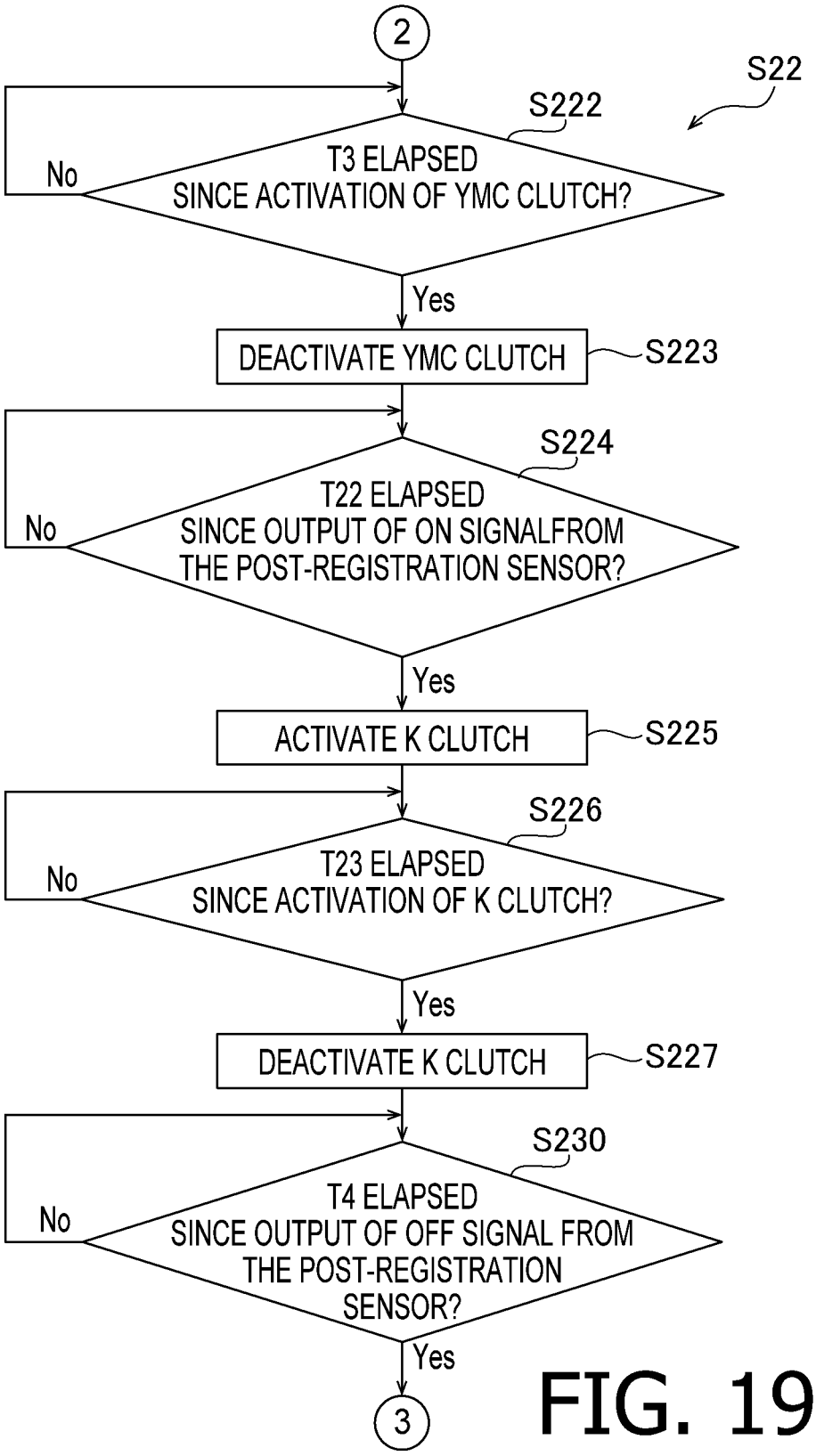
Figure 19C:
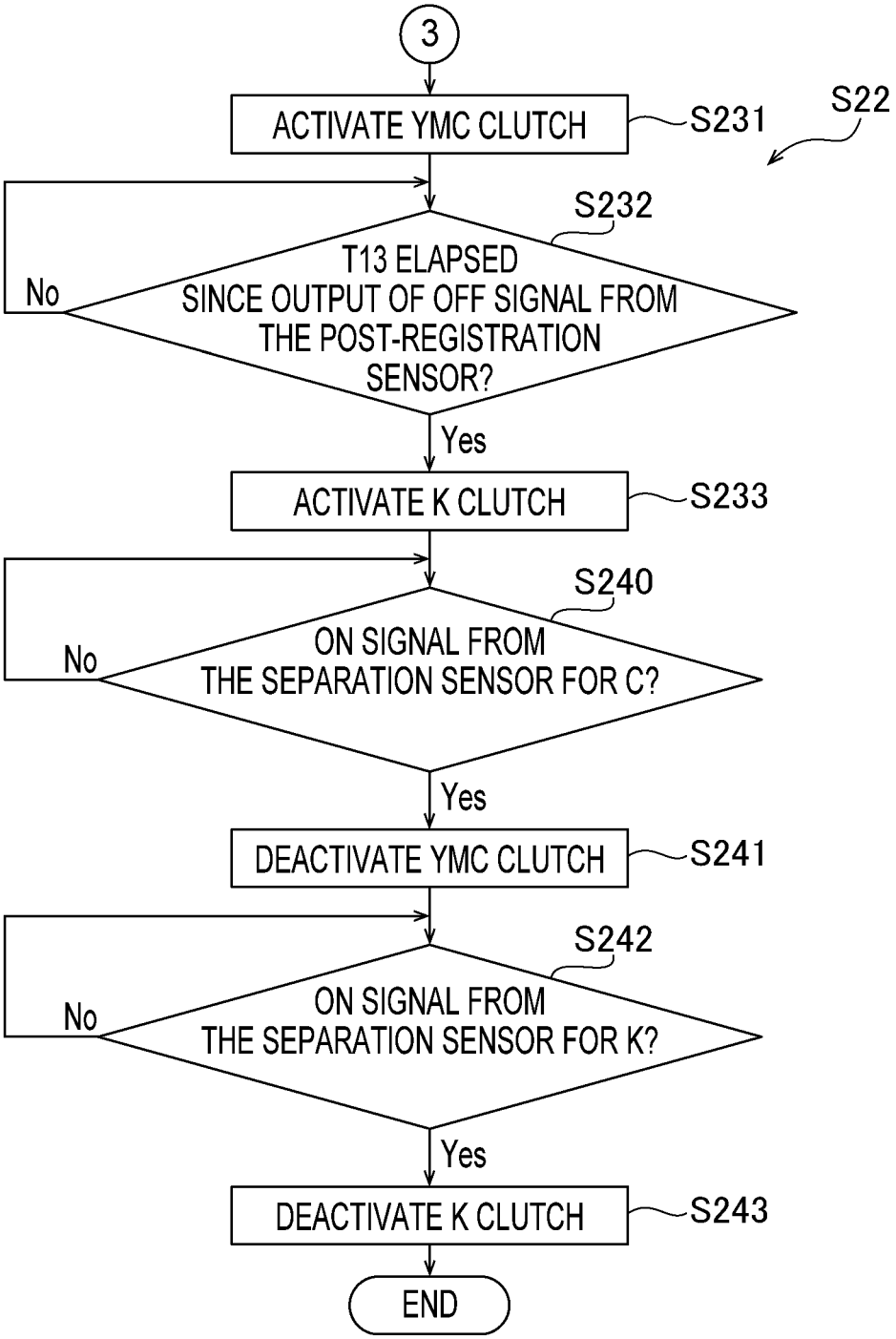

FIGS. 19A-19C are flowcharts to illustrate flows of steps to be conducted when a multicolored image is printed in the image forming apparatus according to the embodiment of the present disclosure.

Figure 20:
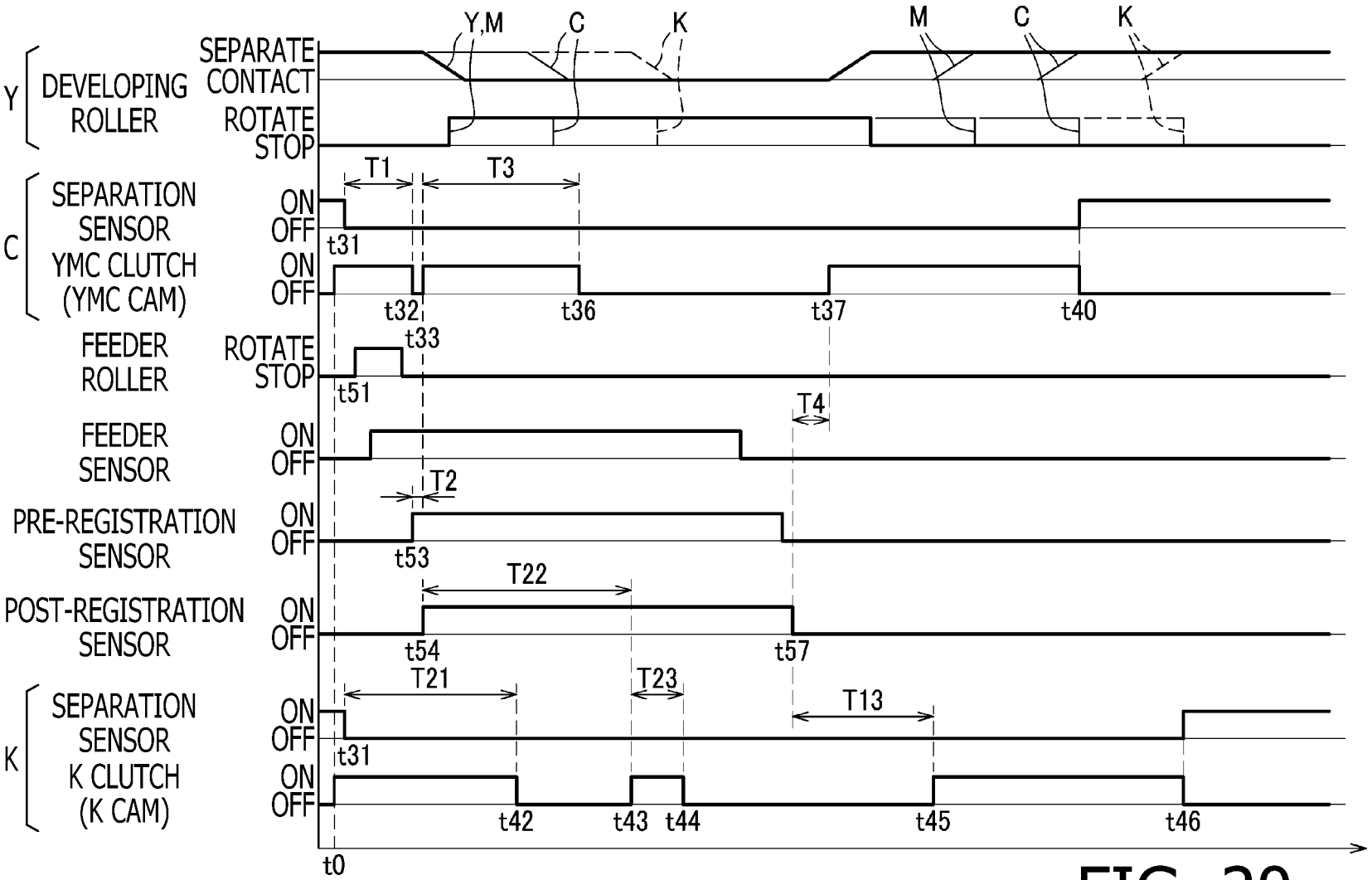

FIG. 20 is a timing chart to illustrate control over a YMC clutch and a K clutch based on signals output from sensors when a multicolored image is printed in the image forming apparatus according to the embodiment of the present disclosure.

Figure 21:
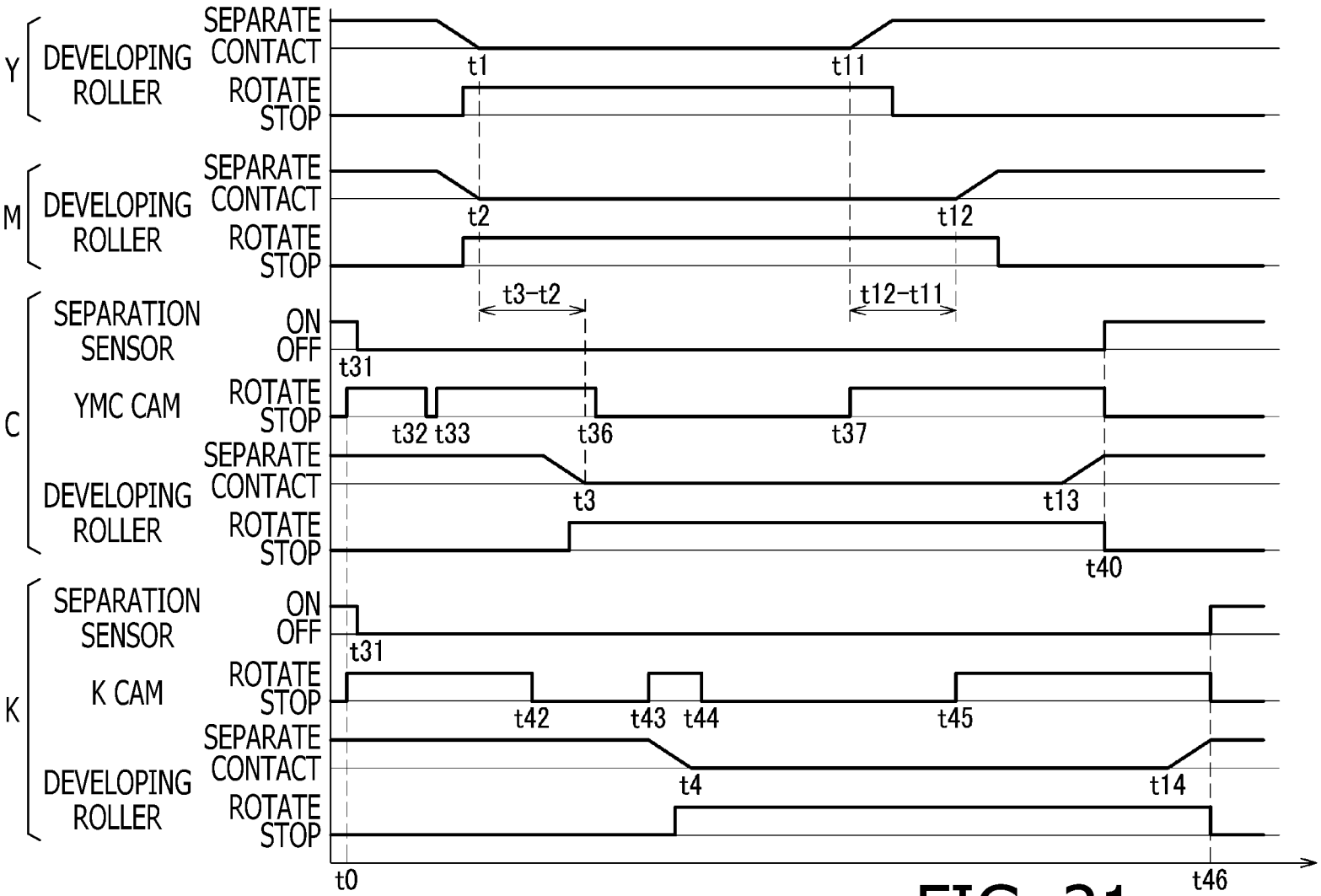

FIG. 21 is a timing chart to illustrate movements of the cams, separation sensors, and the developing rollers when a multicolored image is printed in the image forming apparatus according to the embodiment of the present disclosure.

Figure 22A:
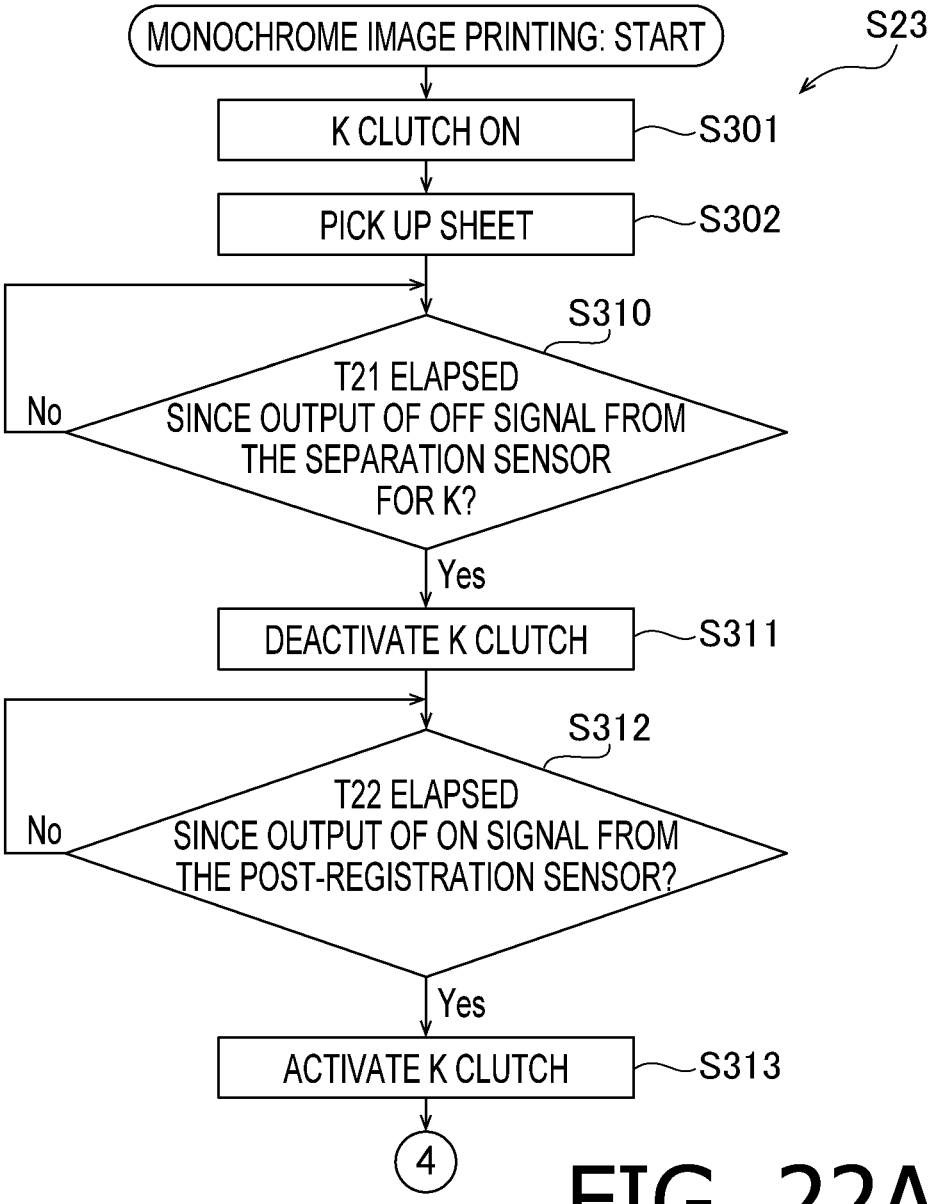
Figure 22B:
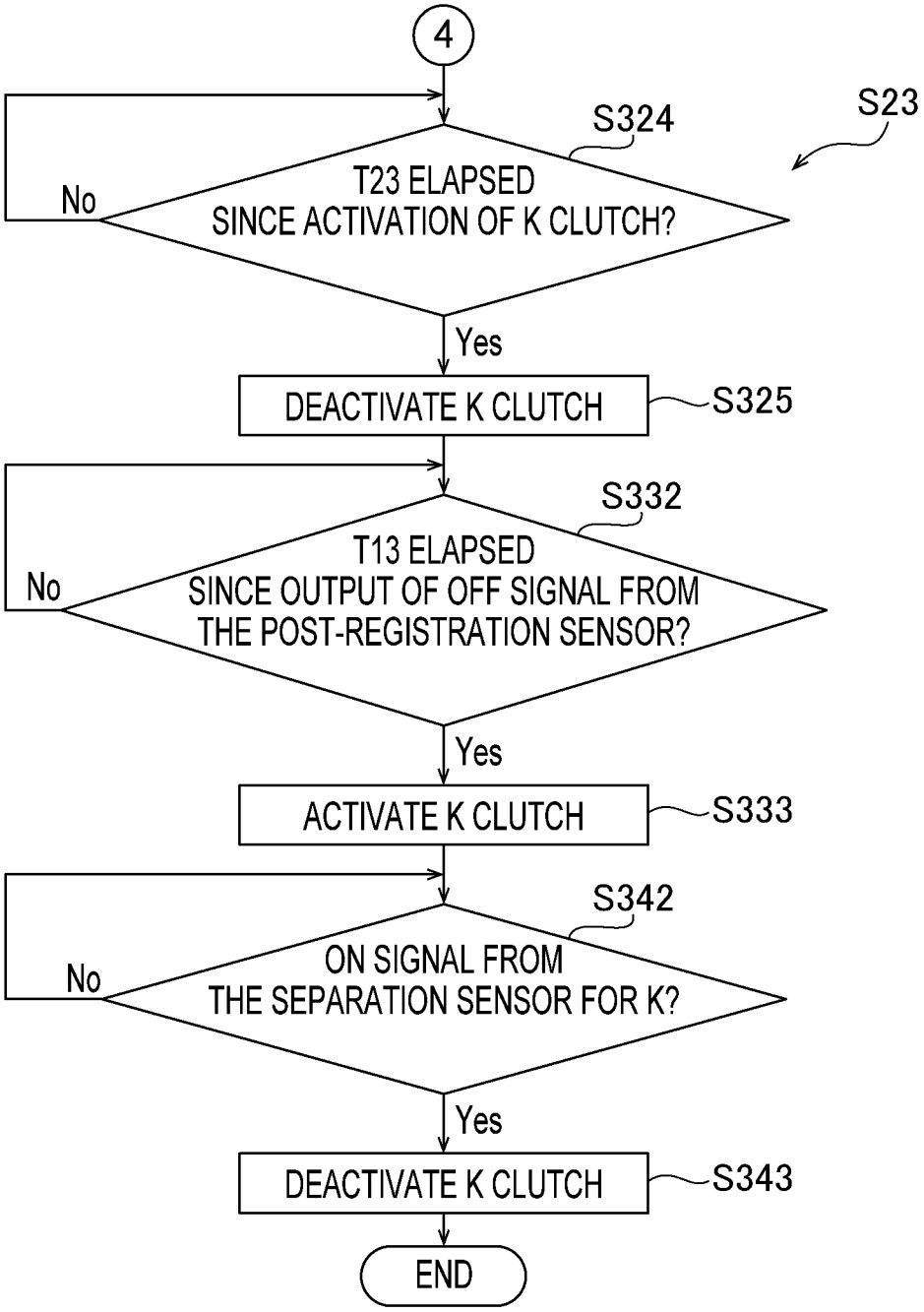

FIGS. 22A-22B are flowcharts to illustrate flows of steps to be conducted when a monochrome image is printed in the image forming apparatus according to the embodiment of the present disclosure.

Figure 23:
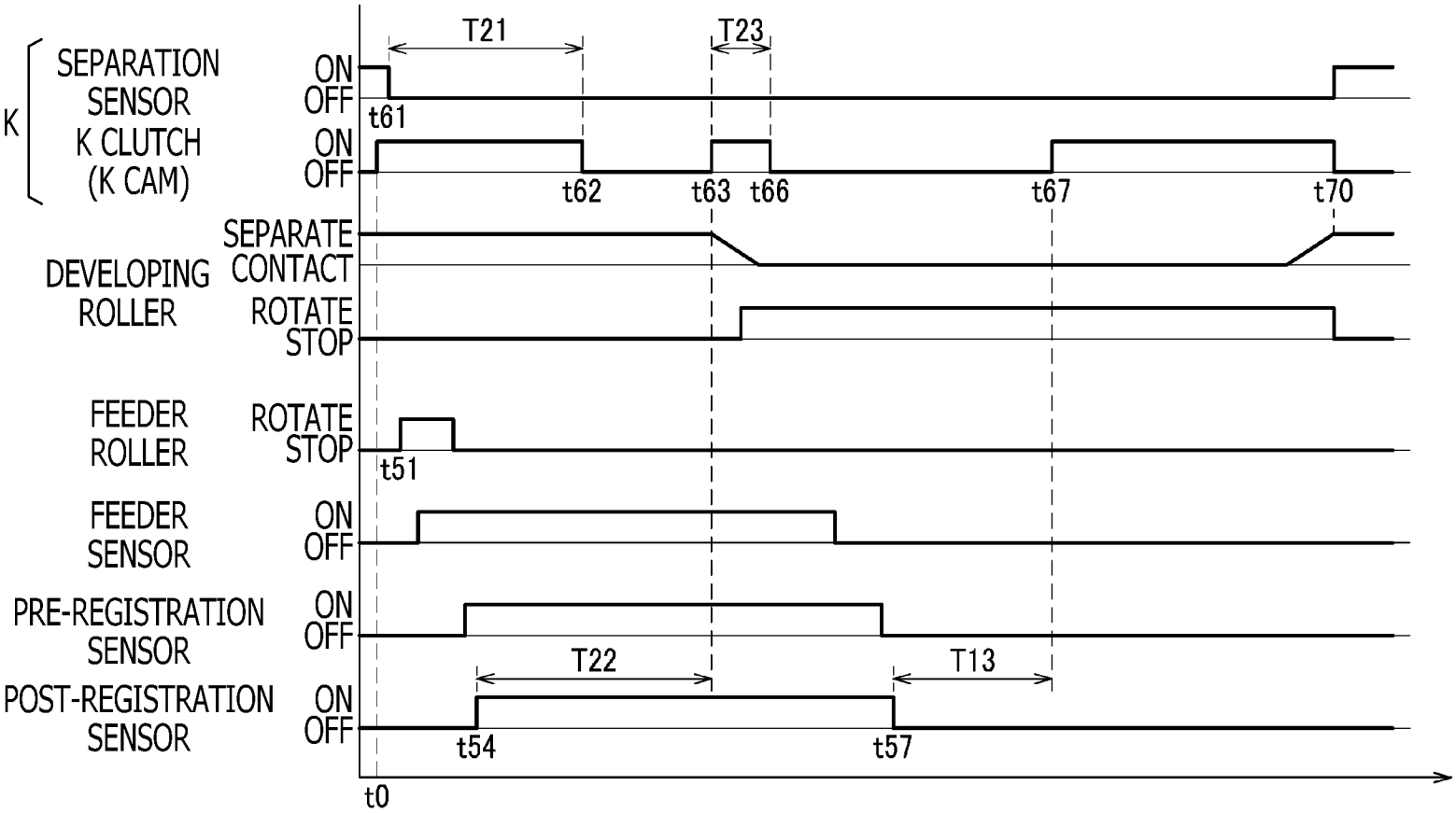

FIG. 23 is a timing chart to illustrate control over the K clutch based on signals output from the sensors and movements of the developing roller for black when a monochrome image is printed in the image forming apparatus according to the embodiment of the present disclosure.

FIGS. 24A-24D illustrate separating and contacting movements of the developing rollers when a multicolored image is printed in the image forming apparatus according to the embodiment of the present disclosure.

Figure 24A:
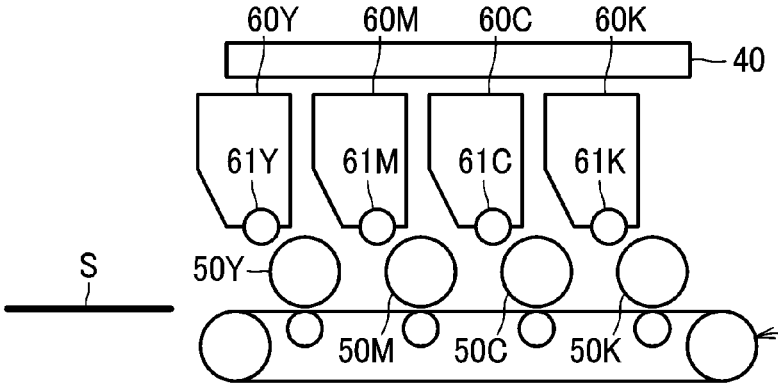
Figure 24B:
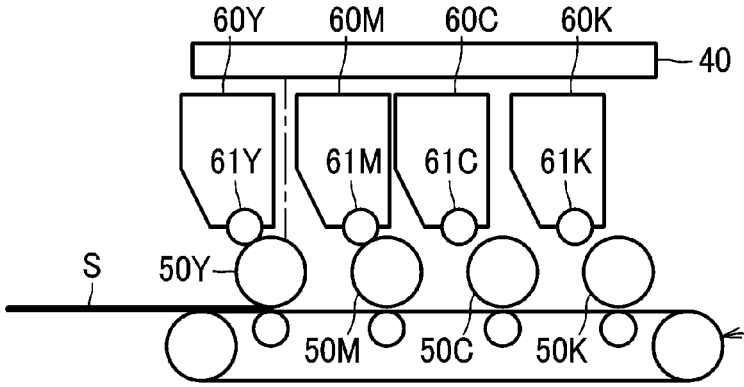
Figure 24C:
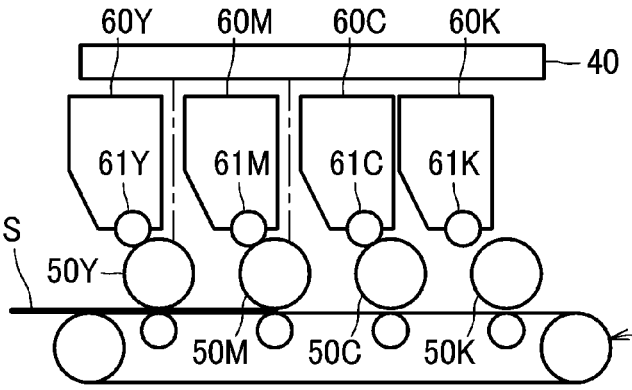
Figure 24D:
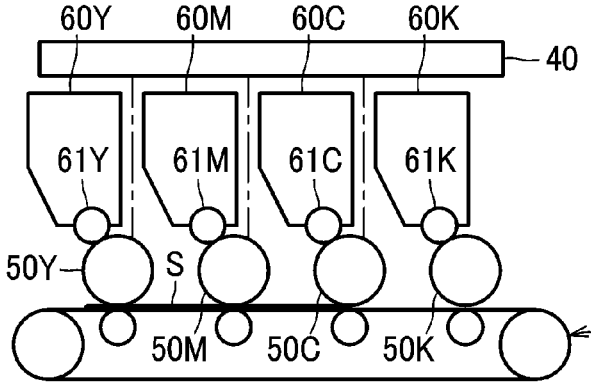

FIGS. 25A-25D illustrate separating and contacting movements of the developing rollers continued from the positions in FIG. 24D when the multicolored image is printed in the image forming apparatus according to the embodiment of the present disclosure.

Figure 26A:
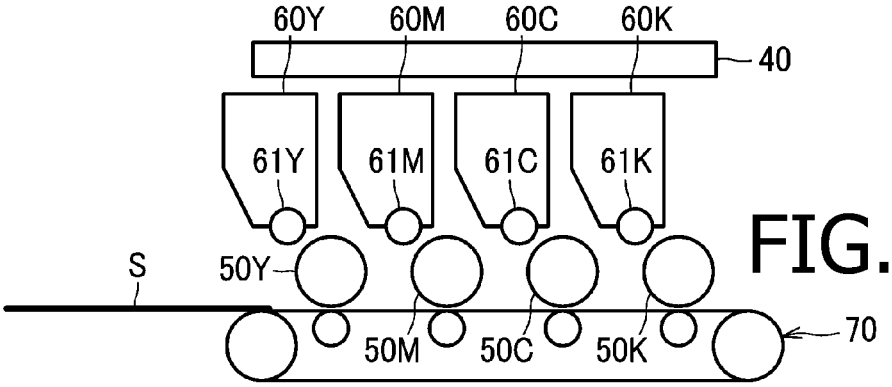
Figure 26B:
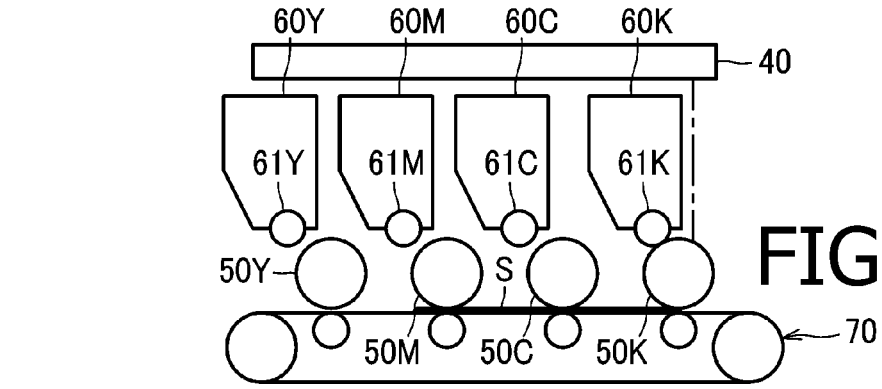
Figure 26C:
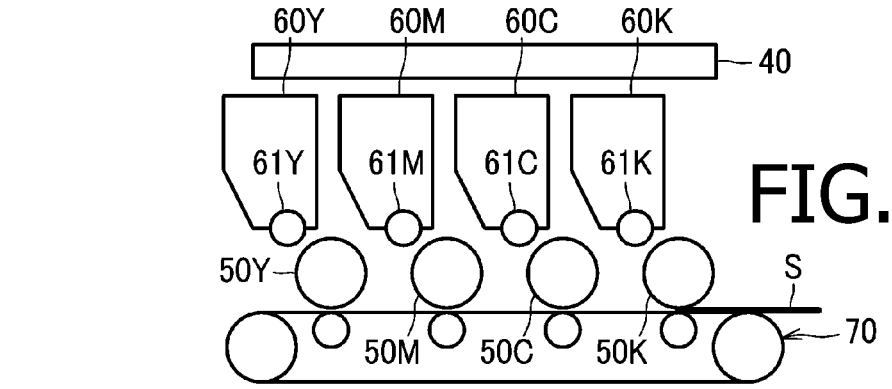

FIGS. 26A-26C illustrate separating and contacting movements of the developing rollers when a monochrome image is printed in the image forming apparatus according to the embodiment of the present disclosure.

DETAILED DESCRIPTION

Hereinafter, described with reference to the accompanying drawings will be an embodiment of the present disclosure.

Figure 1:
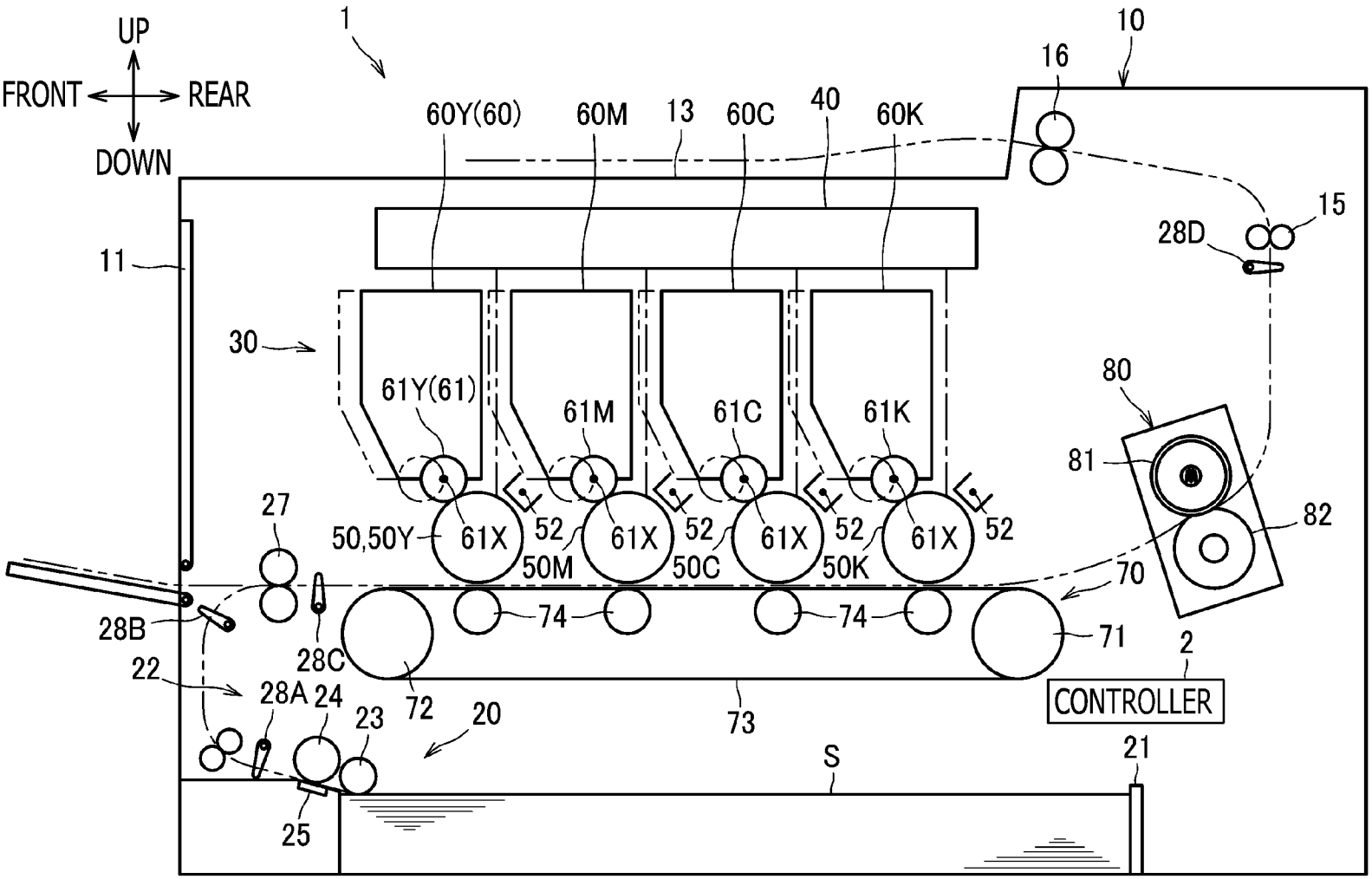
FIG. 1 is an overall cross-sectional view of an image forming apparatus according to an embodiment of the present disclosure.

As shown in FIG. 1, an image forming apparatus 1 according to the embodiment is a multicolor printer and has a main casing 10, which accommodates a sheet feeder 20, an image forming device 30, and a controller 2.

The sheet feeder 20 is arranged at a lower position in the main casing 10 and includes a sheet tray 21 to store sheets S and a feeder device 22 to feed the sheets S from the sheet tray 21 to the image forming device 30. The sheet tray 21 is movable to be pulled frontward, e.g., leftward in FIG. 1, to be detached from the main casing 10. The feeder device 22 is arranged at a frontward position in the main casing 10 and includes a feeder roller 23, a separator roller 24, a separator pad 25, and a registration roller 27. In the following description, directions related the image forming apparatus 1 and each part or item included in the image forming apparatus 1 will be referred to on basis of indications by arrows in FIG. 1. For example, in FIG. 1, a viewer's a left-hand side, a right-hand side, an upper side, and a lower side will be referred to as a front side, a rear side, an upper side, and a lower side, respectively. Moreover, the viewer's farther side and nearer side within FIG. 1 will be referred to as a leftward side and a rightward side in the image forming apparatus 1, respectively. A front-to-rear or a rear-to-front direction may be referred to as a front-rear direction, a left-to-right or right-to-left direction may be referred to as a widthwise direction, and an up-to-down or down-to-up direction may be referred to as a vertical direction. The sheet(s) S in the present embodiment is a printing medium, on which the image forming apparatus 1 may form an image, and includes, but not necessarily be limited to, regular paper, envelope, postcard, tracing paper, cardboard, resin sheet, and sticker sheet.

In the sheet feeder 20, one of the sheets S in the sheet tray 21 may be picked up by the feeder roller 23 and separated from the other sheets S by the separator roller 24 and the separator pad 25. As the separated sheet S is conveyed further, a position of a leading edge of the sheet S may be regulated by the registration roller 27, which may be pausing. Thereafter, as the registration roller 27 starts rotating the sheet S may be fed to the image forming device 30. At a position downstream from the separator roller 24 in a conveying direction to convey the sheet S, arranged is a feeder sensor 28A, which may detect the sheet S passing thereby. At a position upstream from the registration roller 27 in the conveying direction, arranged is a pre-registration sensor 28B, which may detect the sheet S passing thereby. At a position downstream from the registration roller 27 in the conveying direction, arranged is a post-registration sensor 28C.

The image forming device 30 includes an exposure device 40, a plurality of photosensitive drums 50, a plurality of developing cartridges 60, a belt unit 70, and a fuser 80.

The exposure device 40 includes laser diodes, deflectors, lenses, and mirrors, which are not shown. The exposure device 40 may emit laser beams at the photosensitive drums 50 to expose the photosensitive drums 50 to the light and to scan surfaces of the photosensitive drums 50.

The photosensitive drums 50 include a first photosensitive drum 50Y, a second photosensitive drum 50M, a third photosensitive drum 50C, and a fourth photosensitive drum 50K, which are provided correspondingly to a first color, a second color, a third color, and a fourth color, respectively. The first, second, third, and fourth colors may be, for example, yellow, magenta, cyan, and black. In the following paragraphs and the accompanying drawings, a color to which an item corresponds may be identified by a suffix Y, M, C, or K, representing yellow, magenta, cyan, or black, respectively, appended to a reference sign of the item. On the other hand, when items are described generally without necessity of referring to the corresponding colors thereto, the items may be described representatively in a singular form with a single reference sign without the suffix Y, M, C, or K; and the ordinal terms (e.g., first, second, etc.) may be omitted.

The developing cartridge 60 is provided correspondingly to the photosensitive drum 50. In particular, the developing cartridge 60 includes a first developing cartridge 60Y, a second developing cartridge 60M, a third developing cartridge 60C, and a fourth developing cartridge 60K. The first developing cartridge 60Y includes a first developing roller 61Y, which may supply yellow toner to the first photosensitive drum 50Y. The second developing cartridge 60M includes a second developing roller 61M, which may supply magenta toner to the second photosensitive drum 50M. The third developing cartridge 60C includes a third developing roller 61C, which may supply cyan toner to the third photosensitive drum 50C. The fourth developing cartridge 60K includes a fourth developing roller 61K, which may supply black toner to the fourth photosensitive drum 50K.

The first developing roller 61Y, the second developing roller 61M, the third developing roller 61C, and the fourth developing roller 61K are arranged in line in this recited order from upstream to downstream along a sheet-moving direction. In other words, the first developing roller 61Y is at a most upstream position, and the fourth developing roller 61K is at a most downstream position, in the sheet-moving direction for the sheet S. The sheet-moving direction is a direction, in which the sheet S is conveyed in the belt unit 70 (e.g., rearward in FIG. 1 and rightward to a viewer).

The developing cartridge 60 is movable between a position, in which the developing roller 61 being at a contacting position contacts the corresponding photosensitive drum 50, as indicated by solid lines in FIG. 1, and a position, in which the developing roller 61 being at a separated position is separated from the corresponding photosensitive drum 50, as indicated by dash-and-dots lines in FIG. 1. When the second developing roller 61M, the third developing roller 61C, and the fourth developing roller 61K are at the respective separated positions, the second developing cartridge 60M, the third developing cartridge 60C, and the fourth developing cartridge 60K coincide with light paths for the laser beams emitted from the exposure device 40 for scanning the first photosensitive drum 50Y, the second photosensitive drum 50M, and the third photosensitive drum 50C, which correspond to the first developing cartridge 60Y, the second developing cartridge 60M, and the third developing cartridge 60C adjoining upstream in the sheet-moving direction from the second developing cartridge 60M, the third developing cartridge 60C, and the fourth developing cartridge 60K, respectively. In other words, when the second developing roller 61M is at the separated position, the second developing cartridge 60M is in a position to interrupt the light path of the laser beam emitted at the first photosensitive drum 50Y; when the third developing roller 61C is at the separated position, the third developing cartridge 60C is in a position to interrupt the light path of the laser beam emitted at the second photosensitive drum 50M; and when the fourth developing roller 61K is at the separated position, the fourth developing cartridge 60K is in a position to interrupt the light path of the laser beam emitted at the third photosensitive drum 50C.

Figure 2:
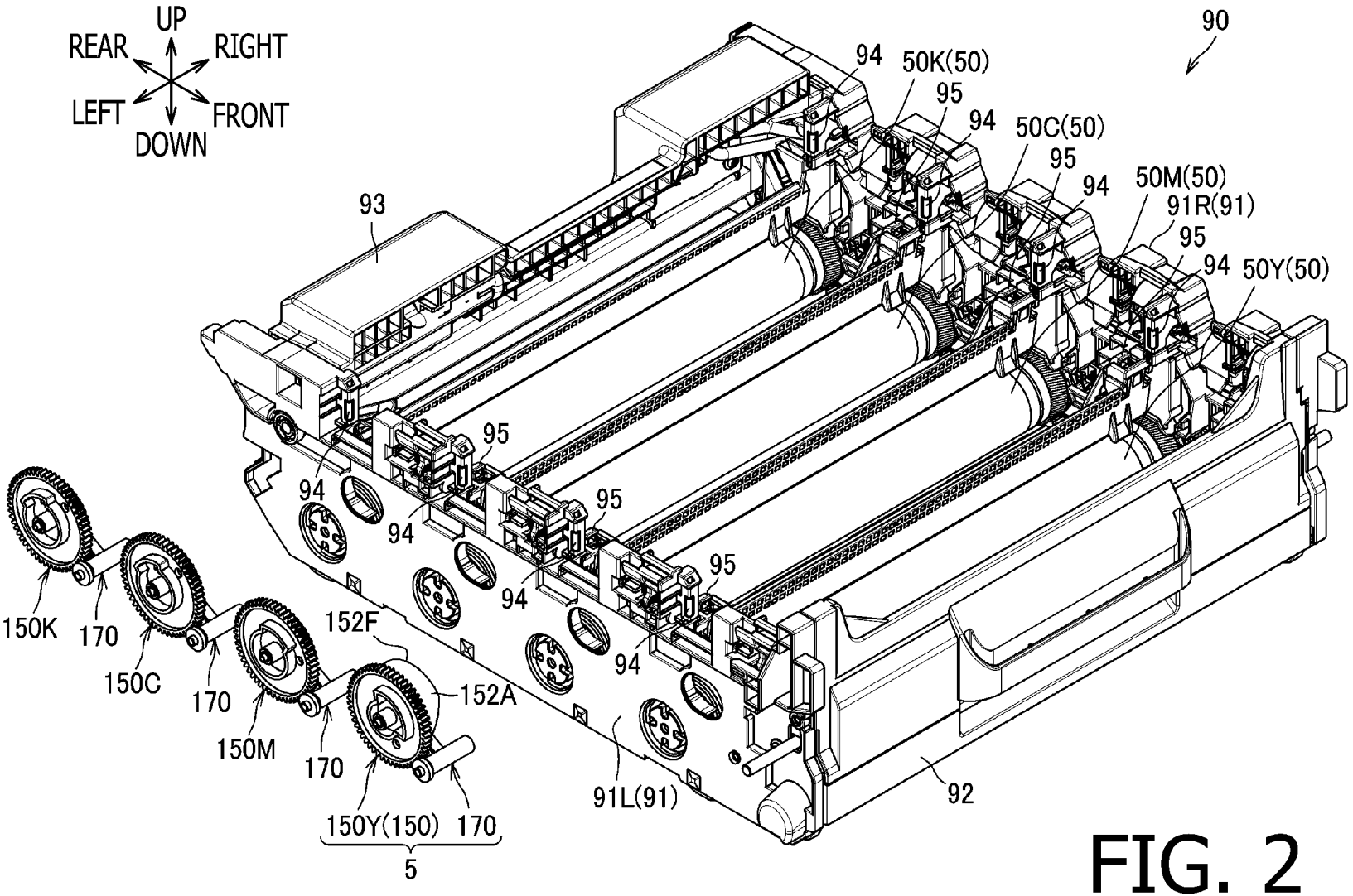
FIG. 2 is a perspective view of a supporting member, cams, and cam followers in the image forming apparatus according to the embodiment of the present disclosure.

As shown in FIG. 2, the photosensitive drum 50 is rotatably supported by a supporting member 90. The supporting member 90 supports the developing cartridge 60 removably. The supporting member 90 is detachably attachable to the main casing 10 through an opening (not shown), which may be exposed when a front cover 11 (see FIG. 1) of the main casing 10 is open. The supporting member includes a side frame 91 and connecting frames 92, 93. The side frame 91 includes a pair of a side frame 91R on the right and a side frame 91L on the left, which are spaced apart from each other in an axial direction of the photosensitive drum 50. The connecting frame 92 connects the side frame 91R and the side frame 91L with each other at a frontward position, and the connecting frame 93 connects the side frame 91R and the side frame 91L with each other at a rearward position. On the supporting member 90, arranged is a charger 52 (see FIG. 1), which may electrically charge the photosensitive drum 50.

The image forming apparatus 1 includes a moving mechanism 5, which may move the developing roller 61 between the contacting position, in which the developing roller 61 contacts the corresponding photosensitive drum 51, and the separated position, in which the developing roller 61 is separated from the corresponding photosensitive drum 51. The moving mechanism 5 may move the developing roller 61 between the contacting position and the separated position by a driving force from a development motor 3D (see FIG. 8), which is rotatable bidirectionally in a normal direction and a reverse direction. In particular, the moving mechanism 5 may move the developing roller 61 when the development motor 3D rotates in the normal direction.

The moving mechanism 5 includes a first cam 150 and a cam follower 170. The first cam 150 is rotatable about an axis, which is parallel to a rotation axis 61X (see FIG. 1) of the developing roller 61 and includes a first cam 150Y for yellow, a first cam 150M for magenta, a first cam 150C for cyan, and a first cam 150K for black. The first cam 150 may control a position of the developing roller 61 and may be rotated in a predetermined rotating direction by the driving force from the development motor 3D. The first cam 150 includes a first cam portion 152A protruding in a rotation-axis direction, which is a direction of the rotation axis 61X of the developing roller 61.

Figures 4A, 4B:
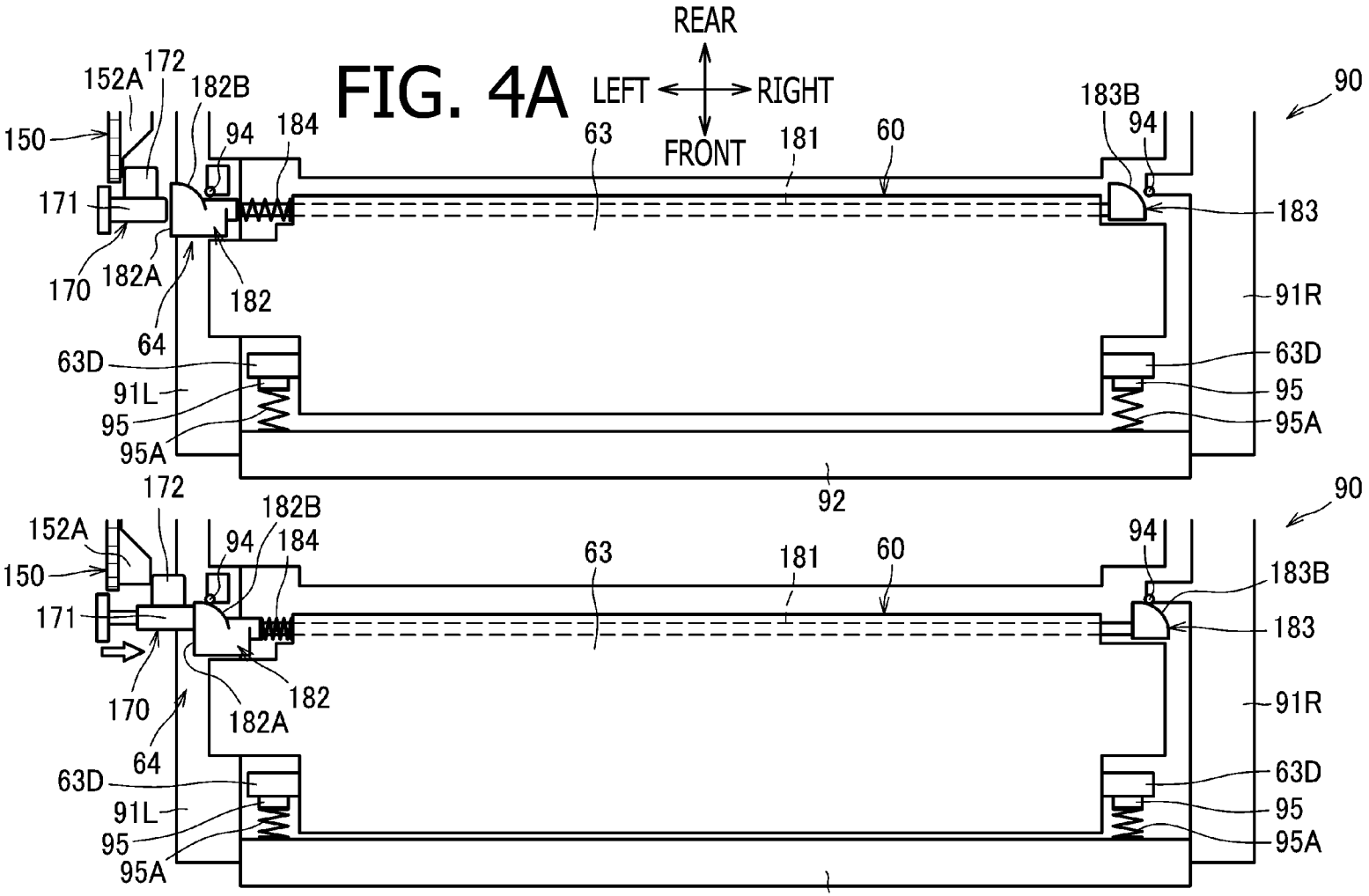
FIG. 4A is an illustrative view of the developing cartridge and periphery thereof when the cam follower is at a standby position.
FIG. 4B is an illustrative view of the developing cartridge and the periphery thereof when the cam follower is at an operable position.

The cam follower 170 is movable between an operable position, in which the cam follower 170 contacts a cam face 152F being an end face of the first cam portion 152A to place the developing roller 61 at the separated position as shown in FIG. 4B, and a standby position, in which the cam follower 170 causes the developing roller 61 to be placed at the contacting position as shown in FIG. 4A. The cam follower 170 may contact the first cam portion 152A of the first cam 150 and slidably move to the operable position to urge the developing cartridge 60. The cam follower 170 is, when at the standby position, separated from the developing cartridge 60.

Referring back to FIG. 2, the first cam 150 and the cam follower 170 are arranged to correspond to each of the first, second, third, fourth developing cartridges 60Y, 60M, 60C, 60K. The first cam 150 and the cam follower 170 are arranged at a widthwise outer position with respect to the side frame 91L. In other words, the first cam 150 and the cam follower 170 are arranged at a leftward position with respect to the side frame 91L. The first cam 150 and the cam follower 170 will be described further below.

At upper positions with respect to the side frames 91R, 91L in the supporting member 90, arranged are contact portions 94. Each contact portion 94 may contact a slider member 64, which will be described further below. The contact portion 94 includes a roller, and while the axial direction of the photosensitive drum 50 extends in a first direction, and the first, second, third, and fourth photosensitive drums 50Y, 50M, 50C, 50K align along a second direction, the roller in the contact portion 94 may rotate about an axis extending along a third direction, e.g., vertical direction, which extends orthogonally to the first direction and to the second direction.

The supporting member 90 includes pressing members 95 for the first, second, third, and fourth developing cartridges 60Y, 60M, 60C, 60K. In particular, two (2) pressing members 95 may be provided for each of the first, second, third, and fourth developing cartridges 60Y, 60M, 60C, 60K. The pressing members 95 are arranged at one and the other ends of the corresponding developing cartridge 60 in the axial direction of the photosensitive drum 50. The pressing members 95 are urged rearward by springs 95A (see FIGS. 4A-4B). When the developing cartridge 60 is attached to the supporting member 90, the pressing members 95 may press protrusions 63D in the developing cartridge 60 to urge the developing roller 61 against the photosensitive drum 50.

Figure 3A:
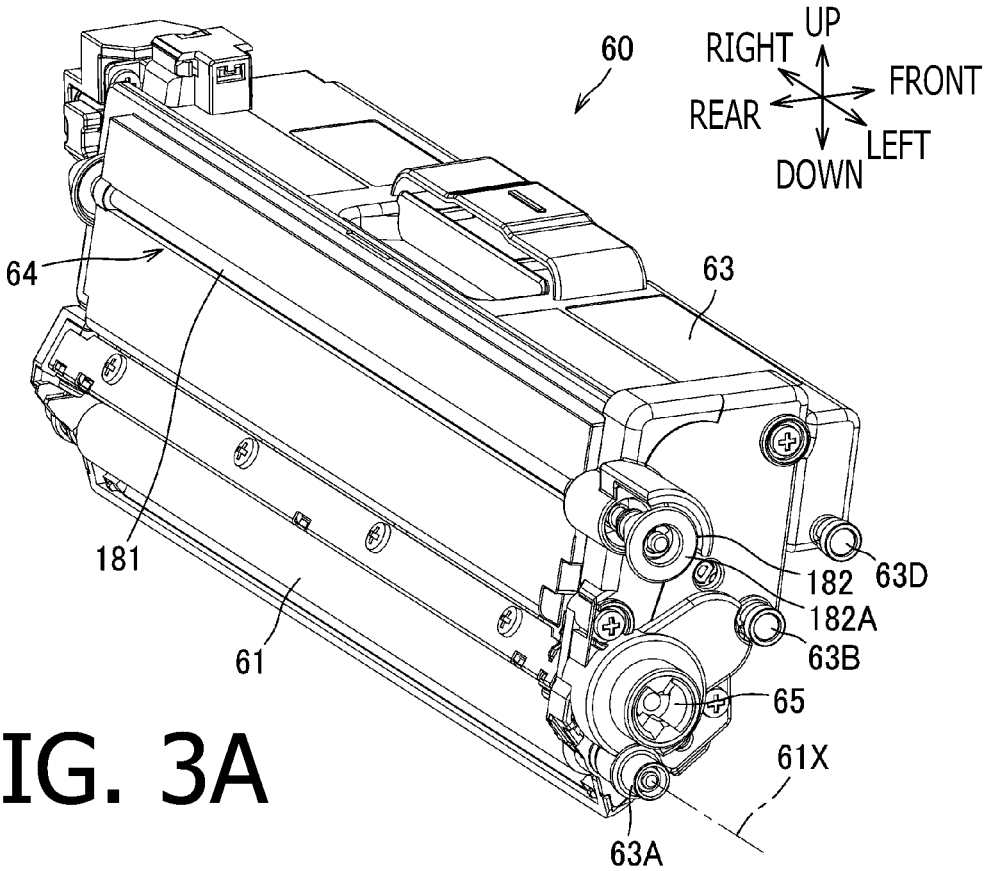
FIG. 3A is a perspective view of a developing cartridge for the image forming apparatus according to the embodiment of the present disclosure.
Figure 3B:
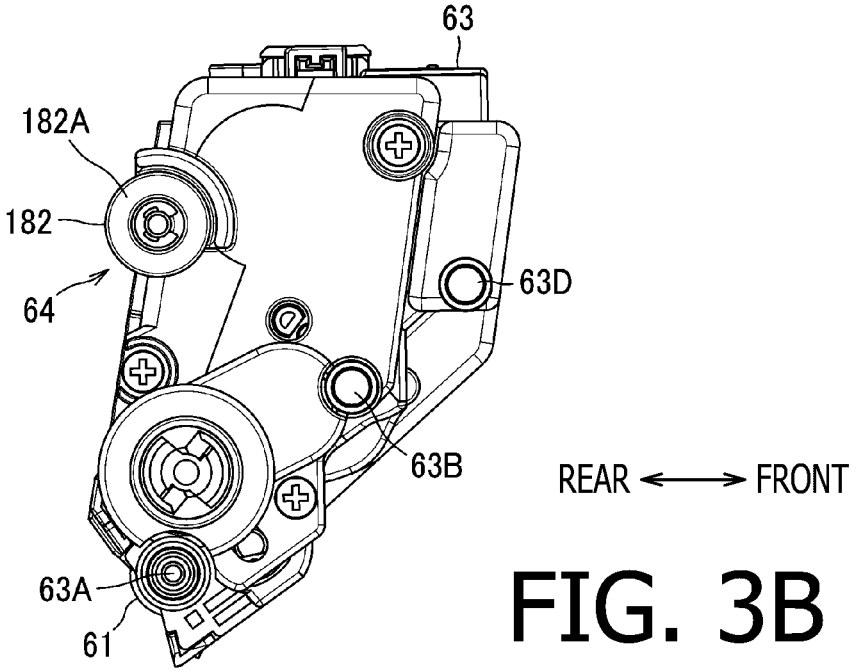
FIG. 3B is a side view of the developing cartridge for the image forming apparatus according to the embodiment of the present disclosure.

The developing cartridge 60 as shown in FIGS. 3A-3B, which is any one of the first, second, third, and fourth developing cartridges 60Y, 60M, 60C, 60K, includes a case 63 to contain toner, a slider member 64, and a coupling 65.

The case 63 has a first protrusive portion 63A and a second protrusive portion 63B, which protrude in the rotation-axis direction, on one sideward face, e.g., a leftward face, thereof. The first protrusive portion 63A is arranged coaxially with the rotation axis 61X of the developing roller 61 and protrudes in the rotation-axis direction. The second protrusive portion 63B is arranged at a position apart from the first protrusive portion 63A for a predetermined distance. The second protrusive portion 63B is arranged at an upper position with respect to the first protrusive portion 63A. The first protrusive portion 63A and the second protrusive portion 63B are rollers, which are rotatable about axes extending in parallel with the rotation-axis direction. Although not shown in the drawings, on the other sideward face, e.g., a rightward face, of the case 63 in the widthwise direction, arranged are a first protrusive portion and a second protrusive portion, which are in the same forms as the first protrusive portion 63A and the second protrusive portion 63B, respectively, at widthwise symmetrical positions.

The case 63 includes a protrusion 63D to be pressed by the pressing member 95 at a frontward position on each sideward face thereof. Thus, the protrusions 63D are arranged at end faces of the case 63 in the rotation-axis direction.

The coupling 65 may engage with a coupling shaft 119, which will be described further below, so that a rotation-driving force may be input from the coupling shaft 119 to the coupling 65.

The slider member 64 is slidable to move in the rotation-axis direction with respect to the case 63. The slider member 64 may be pressed by the cam follower 170 to slidably move in the rotation-axis direction.

As shown in FIGS. 4A-4B, the slider member 64 includes a shaft 181, a first contact member 182, and a second contact member 183. The first contact member 182 is fixed to one end, e.g., a leftward end, of the shaft 181, and the second contact member 183 is fixed to the other end, e.g., a rightward end, of the shaft 181.

The shaft 181 is arranged to extend through the case 63 via holes, which are formed in the rotation-axis direction in the case 63, to be slidably supported by the case 63.

The first contact member 182 includes a pressing face 182A, which is an end face of the first contact member 182 in the rotation-axis direction, and an oblique face 182B, which inclines with respect to the rotation-axis direction. The pressing face 182A is a face to be pressed by the cam follower 170. The oblique face 182B may, when the slider member 64 is pressed by the cam follower 170 in the rotation-axis direction, contact the contact portion 94 on the left in the supporting member 90 and urge the developing cartridge 60 in a direction orthogonal to the rotation-axis direction, e.g., a direction parallel to the sheet-moving direction, to move the developing cartridge 60 (see FIG. 4B). The oblique face 182B inclines, as the oblique face 182B extends from the one end toward the other end, e.g., from left to right, to be closer a side of the developing roller 61 with respect to the corresponding photosensitive drum 50 along the second direction. In other words, a leftward part of the oblique face 182B is closer to the rear, and a rightward part of the oblique face 182B is closer to the front.

The second contact member 183 includes an oblique face 183B, which inclines similarly to the oblique face 182B of the first contact member 182. The oblique face 183B may, when the slider member 64 is pressed by the cam follower 170 in the rotation-axis direction, contact the contact portion 94 on the right in the supporting member 90 and urge the developing cartridge 60 in the direction parallel to the sheet-moving direction to move the developing cartridge 60 (see FIG. 4B), in the same manner as the oblique face 182B.

At a position between the first contact member 182 and the case 63, arranged is a spring 184, which urges the slider member 64 toward one side, e.g., leftward, in the rotation-axis direction. The spring 184 may be a compressed coil spring arranged to coil around an outer periphery of the shaft 181.

Figure 5:
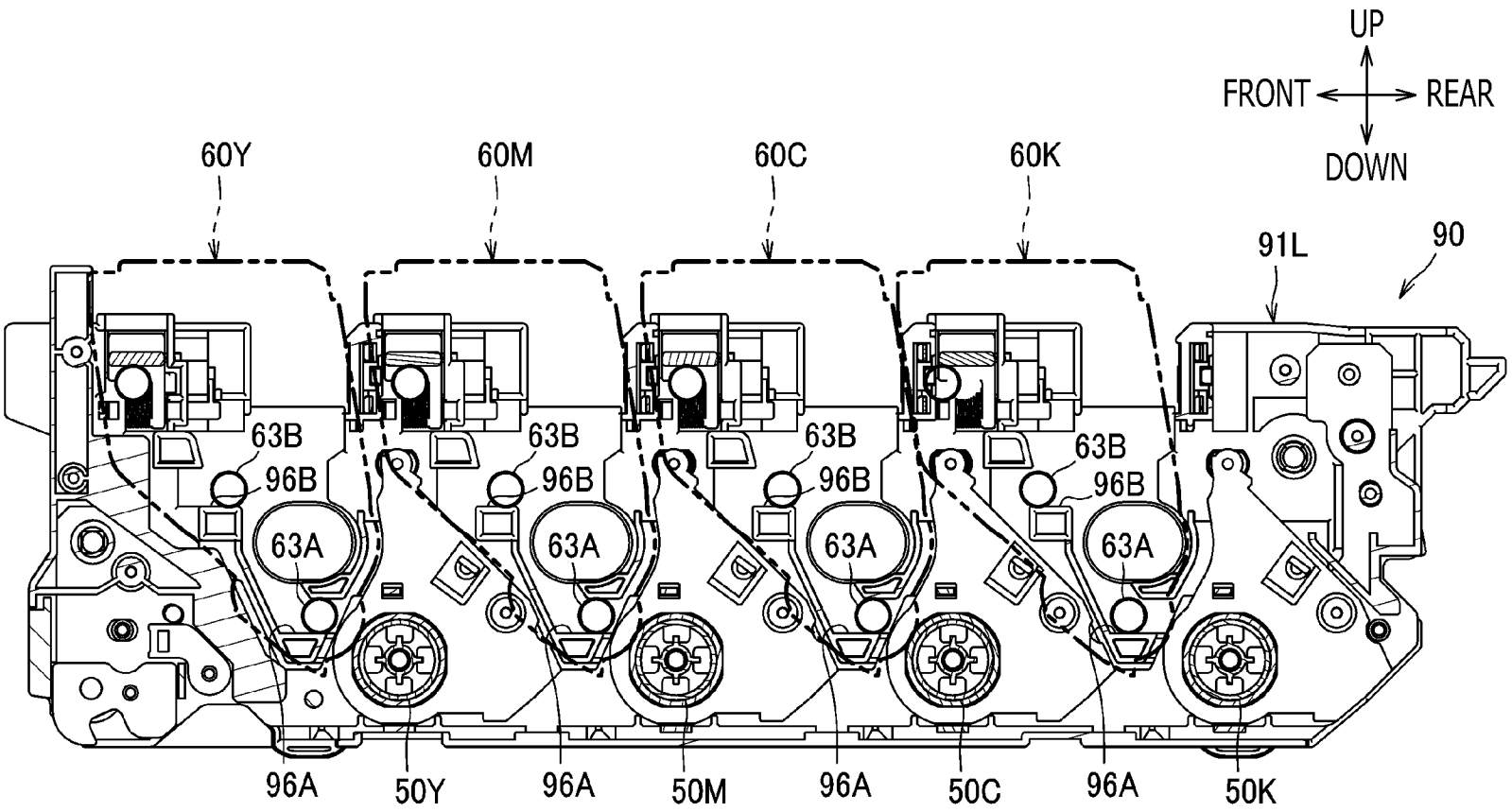
FIG. 5 is an inner-side view of a side frame in the supporting member in the image forming apparatus according to the embodiment of the present disclosure.

As shown in FIG. 5, the supporting member 90 has a first supporting face 96A and a second supporting face 96B on an inner side of the side frame 91L on the left. The first supporting face 96A and the second supporting face 96B may support the first protrusive portion 63A and the second protrusive portion 63B of the case 63, respectively, from below when the developing roller 61 moves from the contacting position to the separated position. The first supporting face 96A and the second supporting face 96B extend in the sheet-moving direction. The first supporting face 96A is arranged to support the first protrusive portion 63A. The first supporting face 96A may guide the developing roller 61 and locate the developing roller 61 at a predetermined position when the developing cartridge 60 is being attached to the supporting member 90. The second supporting face 96B is arranged to support the second protrusive portion 63B at an upper position with respect to the first supporting face 96A. Although not shown in the drawings, the supporting member 90 has a first supporting face and a second supporting face, which are in symmetrical forms as the first supporting face 96A and the second supporting face 96B, respectively, at positions on an inner side of the side of the side frame 91R on the right.

When the developing roller 61 is located at the contacting position, in which the developing roller 61 contacts the corresponding photosensitive drum 50, as seen in the first developing cartridge 60Y, the second developing cartridge 60M, and the third developing cartridge 60C shown in FIG. 5, the first protrusive portion 63A is located at a rearward position on the first supporting face 96A. On the other hand, when the developing roller 61 is located at the separated position, in which the developing roller 61 is separated from the corresponding photosensitive drum 50, as seen in the fourth developing cartridge 60K, the first protrusive portion 63A is located at a frontward position on the first supporting face 96A. Thus, when the developing roller 61 is moved from the contacting position to the separated position, the moving mechanism 5 may move the developing roller 61 in a direction from a position on a downstream side to a position on an upstream side along the sheet-moving direction.

As shown in FIGS. 12A-12B, the first cam 150 includes a disk portion 151, a gear portion 150G, an edge cam 152, and a clutch-controlling cam 153. The first cam 150 may move the corresponding developing roller 61 between the contacting position and the separated position by rotating.

Figure 9:
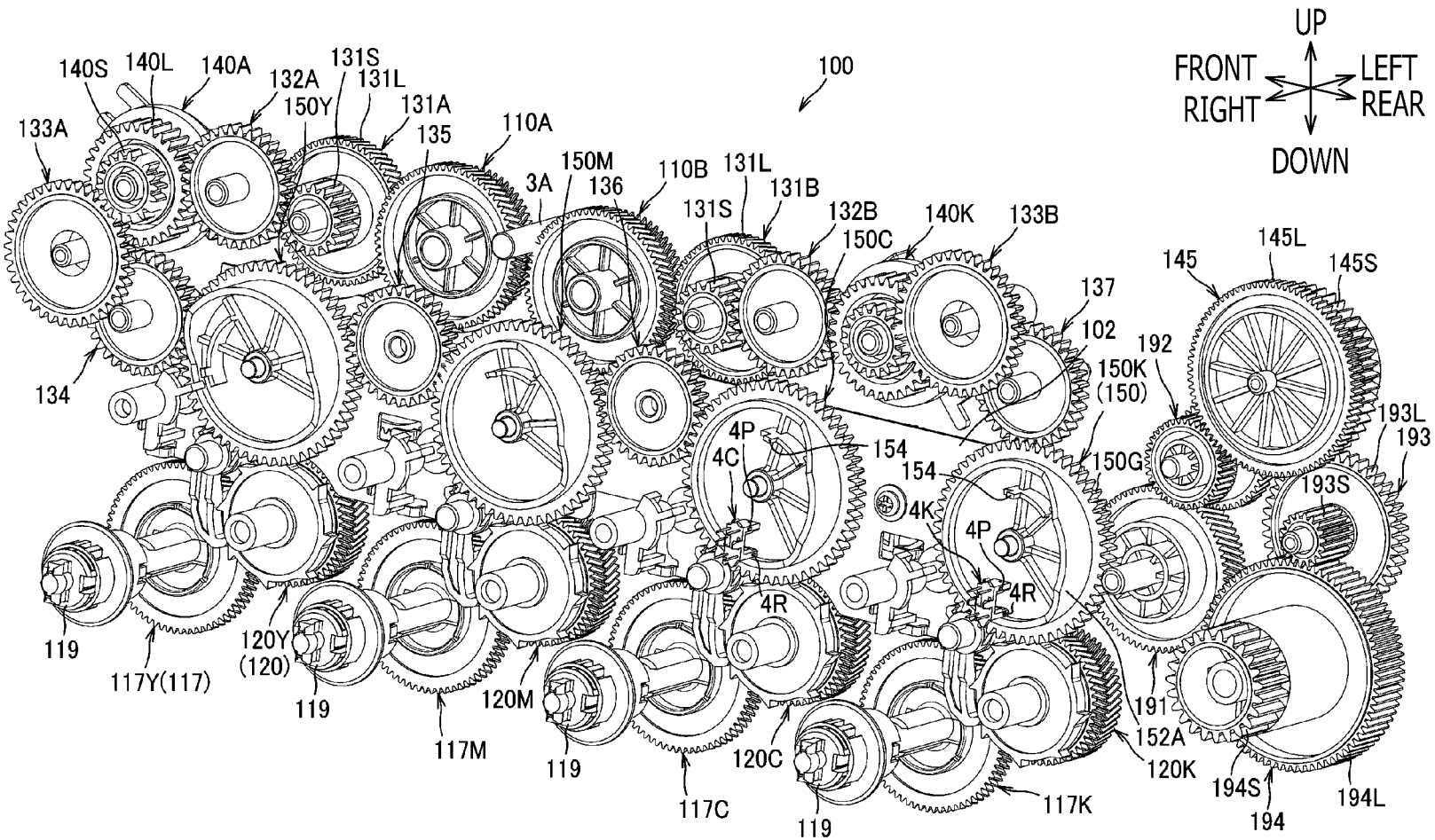
FIG. 9 is a perspective view of the driving-force transmitter in the image forming apparatus according to the embodiment of the present disclosure from an upper-right viewpoint.

The disk portion 151 has an approximate shape of a disk and is rotatably supported by a supporting plate 102 (see FIG. 9). The gear portion 150G is formed on an outer periphery of the disk portion 151. The edge cam 152 includes the first cam portion 152A, which forms a part of the moving mechanism 5 for the developing roller 61 and protrudes from the disk portion 151. The edge cam 152 includes a cam face 152F at an end in the rotation-axis direction thereof. The cam face 152F includes a first retainer face F1, a second retainer face F2, a first guide face F3, and a second guide face F4. The first retainer face F1 may retain the cam follower 170 at the standby position. The second retainer face F2 may retain the cam follower 170 at the operable position. The first guide face F3 connects the first retainer face F1 with the second retainer face F2 and inclines with respect to the first retainer face F1. The first guide face F3 may guide the cam follower 170 from the first retainer face F1 to the second retainer face F2 as the first cam 150 rotates. The second guide face F4 connects the second retainer face F2 with the first retainer face F1 and inclines with respect to the first retainer face F1. The second guide face F4 may guide the cam follower 170 from the second retainer face F2 to the first retainer face F1 as the first cam 150 rotates.

The clutch-controlling cam 153 works in cooperation with a lever 160 to switch transmission to or disconnection from the clutch 150. The clutch-controlling cam 153 includes a basal round portion 153A, which forms a partial cylindrical form, and a second cam portion 153B, which protrudes from the basal round portion 153A in a diametrical direction of the first cam 150. The clutch-controlling cam 153 is formed integrally with the disk portion 151. Therefore, the second cam portion 153B rotates synchronously with the first cam 150.

The cam follower 170 includes a slidable shaft 171 and a contact portion 172. The slidable shaft 171 is slidably supported by a shaft, which is fixed to the main casing 10 but is not shown, to slide in the rotation-axis direction. The slidable shaft 171 is urged by a spring 173 in a direction such that the contact portion 172 tends to contact the cam face 152F of the first cam 150. Therefore, the cam follower 170 is urged toward the standby position. The spring 173 is a tension coil spring, one end of which is hooked to the slidable shaft 171, and the other end of which is hooked to a spring hook being arranged in the main casing 10 but not shown. The contact portion 172 extends from the slidable shaft 171. An end face of the contact portion 172 at one end in the rotation-axis direction faces the cam face 152 and contacts the cam face 152F.

As shown in FIG. 9, the first cams 150Y, 150M, 150C, 150K are in substantially a same configuration except that a circumferential length of the first cam portion 152A along a rotating direction is greater in the first cam 150Y alone than a circumferential length of the other first cam portion 152A in the first cams 150M, 150C, 150K. The first cams 150C, 150K each has a detectable portion 154, which protrudes from the disk portion 151 in the rotation-axis direction. Meanwhile, in the main casing 10, arranged are separation sensors 4C, 4K for cyan and black. The separation sensors 4C, 4K are phase sensors to detect phases of the first cams 150C, 150 K, respectively. The separation sensors 4C. 4K may output separation signals when the first cams 150C, 150K are in predetermined phase range, in which the third and fourth developing rollers 61C, 61K are at the separated positions. The separation sensors 4C, 4K output no separation signal when the first cams 150C, 150K are not in the predetermined phase range. In the present embodiment, for a reason of convenience, the separation sensor(s) 4C, 4K outputting the separation signal may be expressed as "the separation sensor(s) 4C, 4K is/are ON." Moreover, the separation signal may be called as an ON signal. Meanwhile, the separation sensors 4C, 4K outputting no separation signal may be expressed as "the separation sensors 4C, 4K output OFF signals." A voltage required in the phase sensors 4C, 4K to output the separation signal may either be greater or smaller than a voltage in the phase sensors 4C, 4K not outputting the separation signal.

The separation sensors 4C, 4K each includes an emitter 4P to emit light and a receiver 4R receivable of the light emitted from the emitter 4P. When the detectable portion 154 is at a position between the emitter 4P and the receiver 4R to interrupt the light from the emitter 4P, the receiver 4R may not receive the light from the emitter 4P, and the separation sensor 4C, 4K may output ON signals to the controller 2. On the other hand, when the detectable portion 154 is displaced from the position between the emitter 4P and the receiver 4R, the receiver 4R may receive the light from the emitter 4P, the separation sensor 4C, 4K may output OFF signals to the controller 2. It may be noted that the first cams 150Y, 150M as well has the same formation as the detectable portion 154; however, neither the first cam 150Y nor the second cam 150M is provided with a separation sensor. Therefore, the formation similar to the detectable portion 154 in the first cam 150Y or the second cam 150M may not serve as a detectable portion.

Referring back to FIG. 1, the belt unit 70 is arranged between the sheet tray 21 and the photosensitive drum 50. The belt unit 70 includes a driving roller 71, a driven roller 72, a conveyer belt 73 being an endless belt, and four (4) transfer rollers 74. The conveyer belt 73 is strained around the driving roller 71 and the driven roller 72, with an upper outer surface thereof facing the photosensitive drum 50. The transfer rollers 74 are arranged inside the conveyer belt 73 to nip the conveyer belt 73 in cooperation with the first, second, third, and fourth photosensitive drums 50Y, 50M, 50C, 50K. The belt unit 70 may convey the sheet S placed on the upper outer surface thereof by moving the conveyer belt 73 so that the toner images formed on the first, second, third, and fourth photosensitive drums 50Y, 50M, 50C, 50K may be transferred onto the sheet S.

The fuser 80 is arranged at a rearward position with respect to the photosensitive drum 50 and the belt unit 70. The fuser 80 includes a heating roller 81 and a pressing roller 82 arranged to face the heating roller 81 to nip the sheet S at a position between the heating roller 81 and the pressing roller 82. At a position downstream from the fuser 80 in the sheet-conveying direction, arranged is an ejection sensor 28D to detect the sheet S passing thereby. At an upper position with respect to the fuser 80, arranged is a conveyer roller 15, and at an upper position with respect to the conveyer roller 15, arranged is an ejection roller 16.

In the image forming device 30 configured as above, the surface of the photosensitive drum 50 may be charged evenly by the charger and selectively exposed to the light emitted from the exposure device 40. Thereby, electrostatic latent images based on image data may be formed on the surface of the photosensitive drum 50.

Meanwhile, the toner in the case 63 may be supplied to the surface of the developing roller 61, and when the developing roller 61 contacts the corresponding photosensitive drum 50, the toner may be supplied to the electrostatic latent image formed on the surface of the photosensitive drum 50. Thus, the toner image may be formed on the photosensitive drum 50.

When the sheet S on the conveyer belt 73 passes through the position between the photosensitive drum 50 and the transfer roller 74, the toner image formed on the photosensitive drum 50 may be transferred onto the sheet S. Further, as the sheet S is conveyed to pass through the position between the heating roller 81 and the pressing roller 82, the toner images transferred to the sheet S may be fused to the sheet S.

The sheet S ejected from the fuser 80 may be conveyed by the conveyer roller 15 and the ejection roller 16 to rest on an ejection tray 13 formed on an upper face of the main casing 10.

Figure 6:
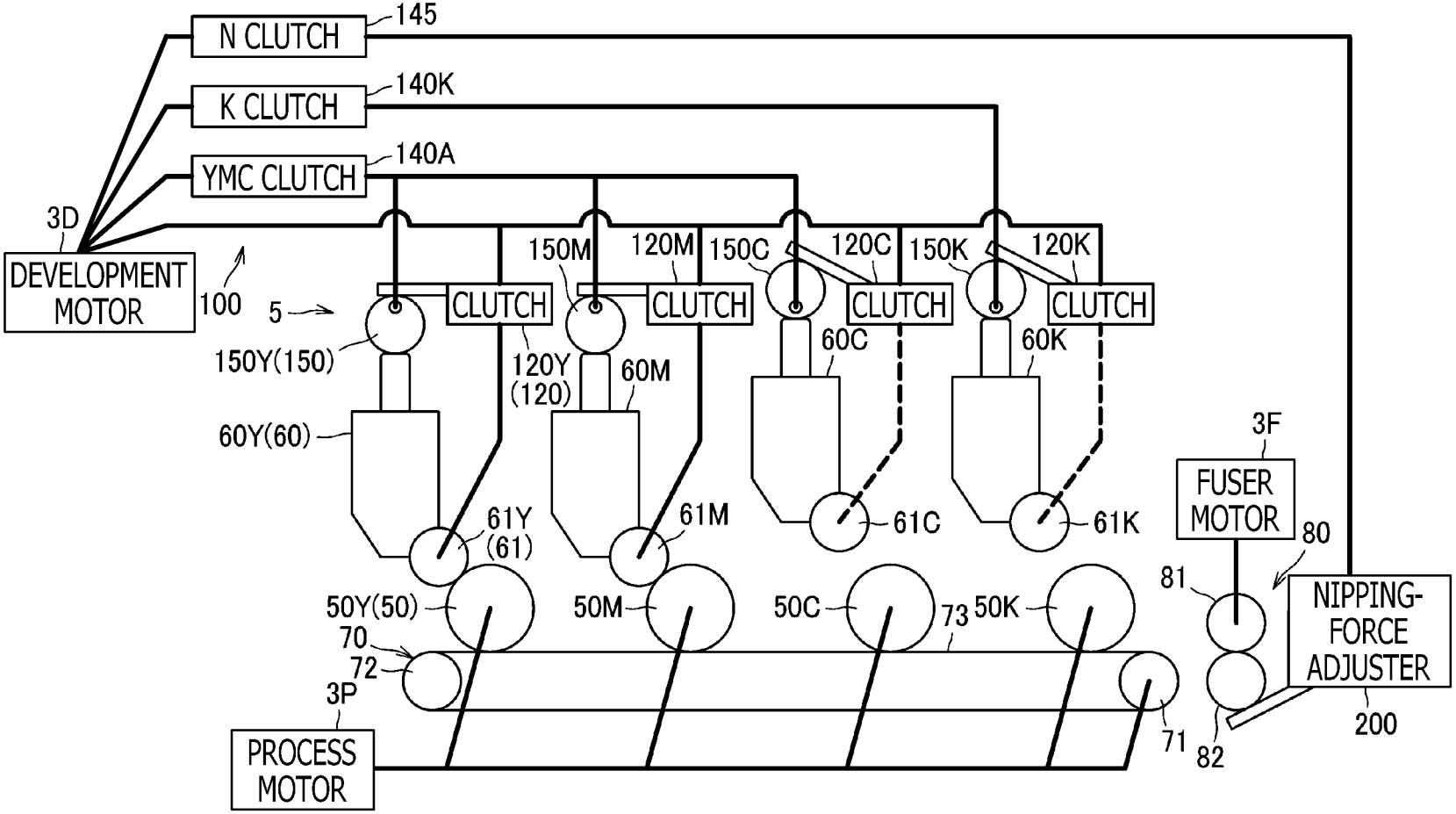
FIG. 6 is a block diagram to illustrate driving systems in the image forming apparatus according to the embodiment of the present disclosure.

The image forming apparatus 1 includes, as shown in FIG. 6, the development motor 3D, a process motor 3P, a fuser motor 3F, a driving-force transmitter 100, and a nipping-force adjuster 200. The driving-force transmitter 100 may transmit the driving force from the development motor 3D to the developing roller 61. The nipping-force adjuster 200 may switch an intensity of nipping force between the heating roller 81 and the pressing roller 82. The development motor 3D is rotatable bidirectionally in the normal direction and the reverse direction and may drive the developing roller 61, the moving mechanism 5, and the nipping-force adjuster 200. The process motor 3P may drive the photosensitive drum 50 and the driving roller 71 in the belt unit 70. The fuser motor 3F may drive the heating roller 81.

Next, described in the following paragraphs will be a configuration to drive or stop rotation of the developing roller 61 and a configuration to move the developing roller 61 to contact or separate from the photosensitive drum 50.

Figure 7:
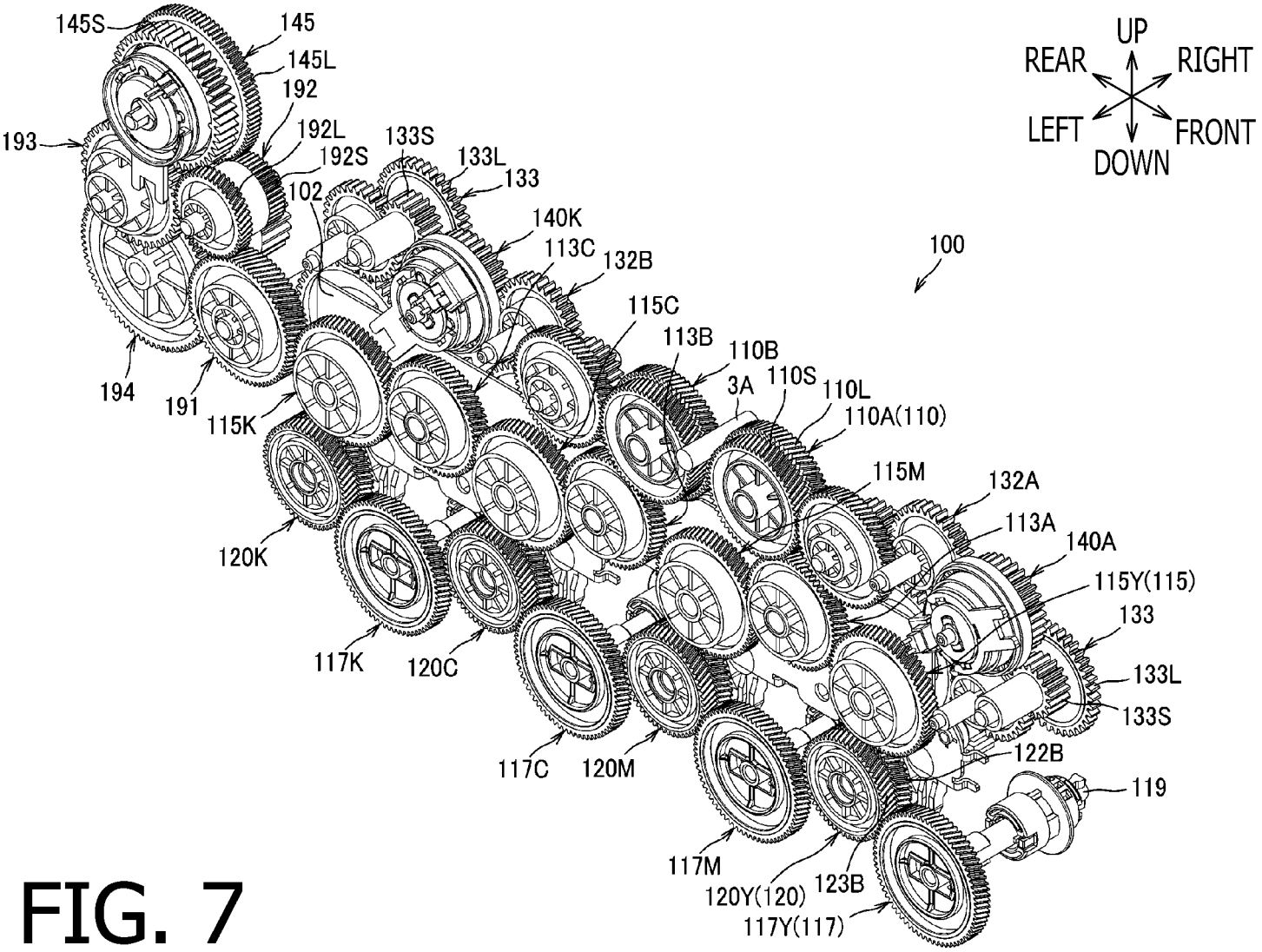
FIG. 7 is a perspective view of a driving-force transmitter in the image forming apparatus according to the embodiment of the present disclosure from an upper-left viewpoint.
Figure 8:
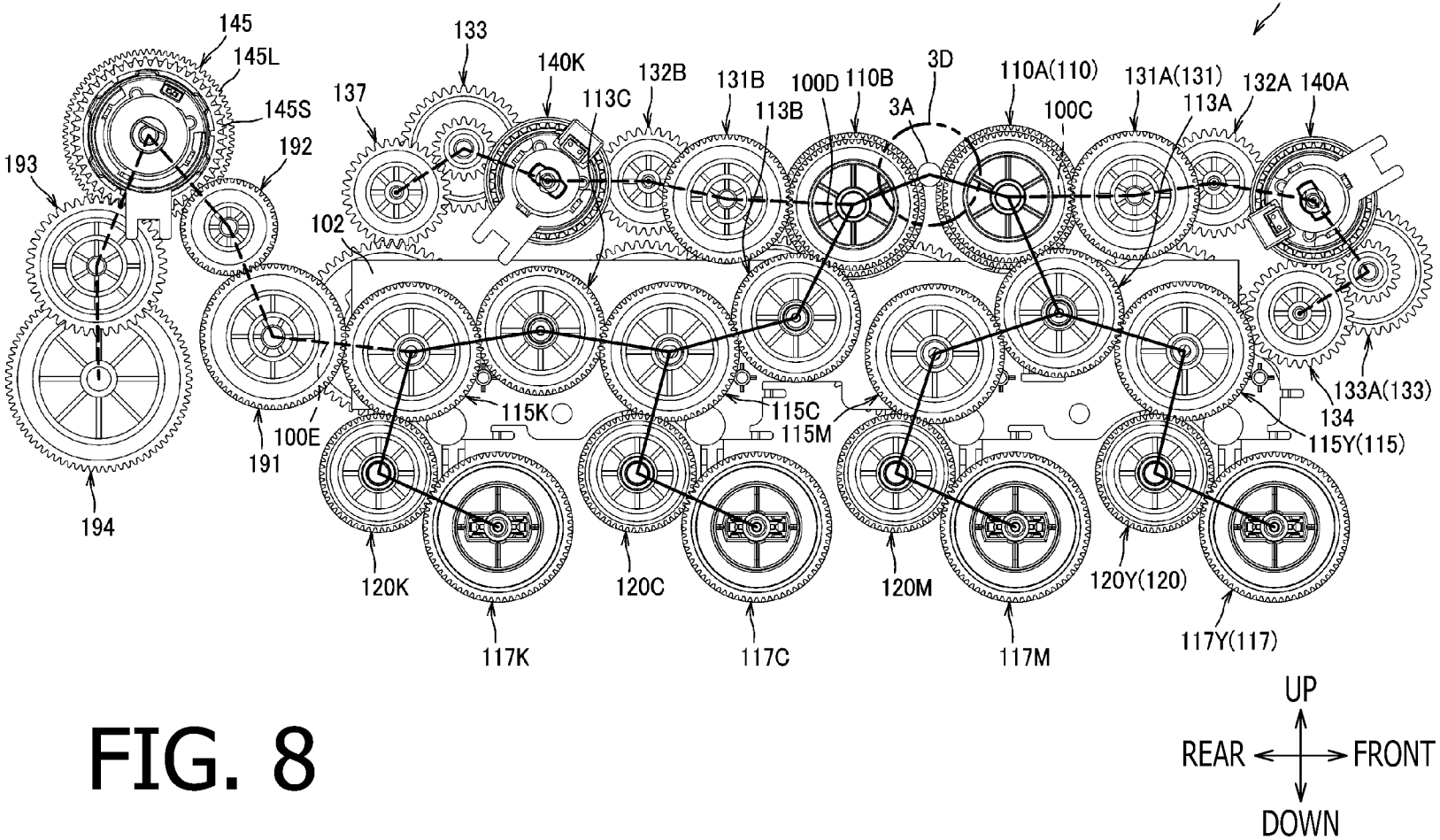
FIG. 8 is a side view of the driving-force transmitter in the image forming apparatus according to the embodiment of the present disclosure viewed from left toward right along an axial direction.

As shown in FIGS. 7-8, the driving-force transmitter 100 is mechanically connected with the first cam 150 being a part of the moving mechanism 5. The driving-force transmitter 100 is arranged to transmit the driving force from the development motor 3D to the developing roller 61 when the developing roller 61 is at the contacting position and the development motor 3D rotates in the normal direction. The driving-force transmitter 100 is arranged, on the other hand, not to transmit the driving force from the development motor 3D to the developing roller 61 when the developing roller 61 is at the separated position. Therefore, when the developing roller 61 is at the contacting position and the development motor 3D rotates in the normal direction, the developing roller 61 may be rotated by the driving force from the development motor 3D. Moreover, the driving-force transmitter 100 may transmit the driving force from the development motor 3D, not only to the developing roller 61, but also to the moving mechanism 5 and to the nipping-force adjuster 200. In other words, the driving force from the development motor 3D may be distributed to the developing roller 61, the moving mechanism 5, and the nipping-force adjuster 200 through the driving force transmitter 100.

Figure 10:
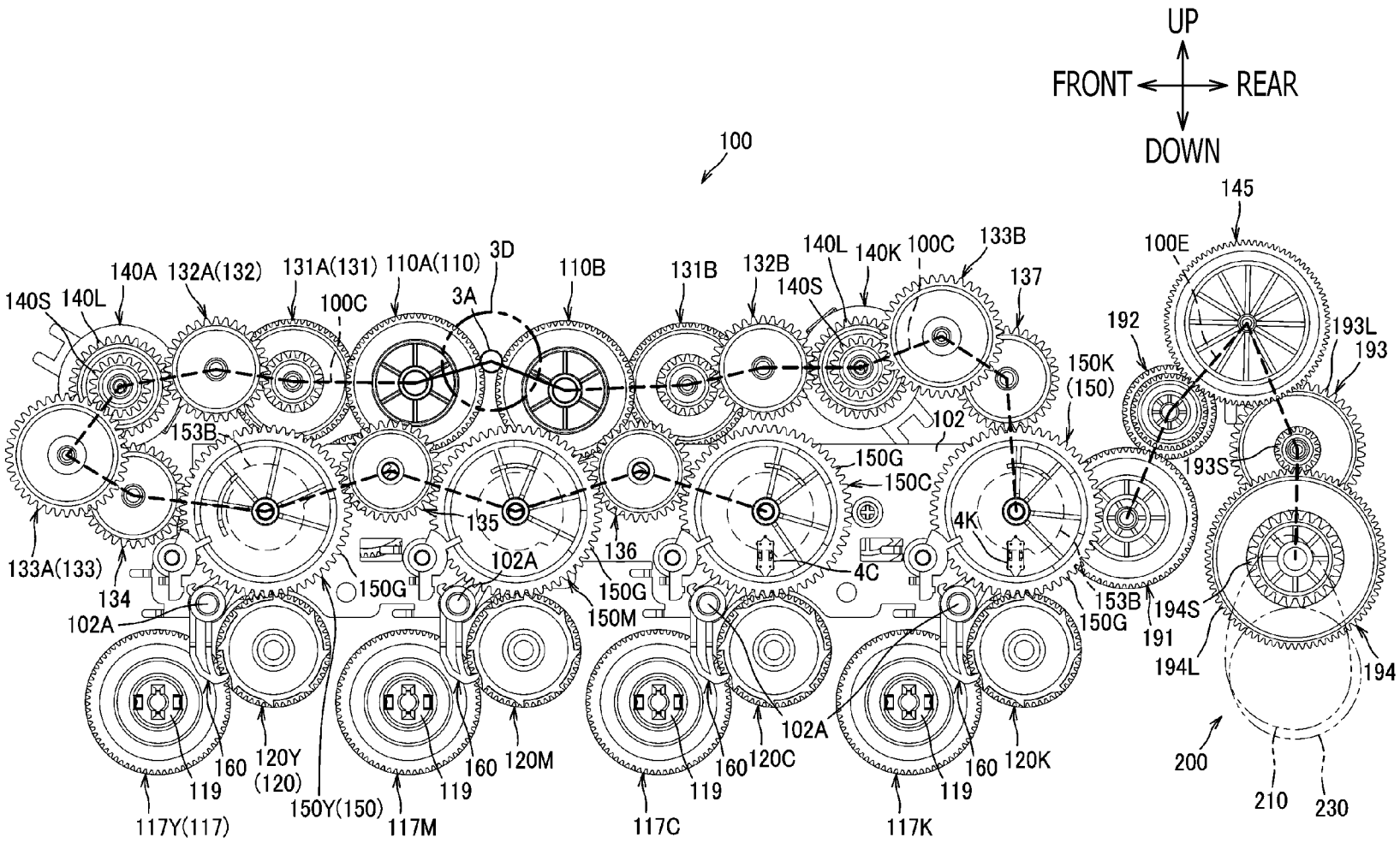
FIG. 10 is a side view of the driving-force transmitter in the image forming apparatus according to the embodiment of the present disclosure viewed from right toward left along the axial direction.

The driving-force transmitter 100 includes, as shown in FIG. 8, a driving-force transmitter gear train 100D, which may transmit the driving force from the development motor 3D to the developing roller 61, and is mechanically connected with a driving-force controlling gear train 100C, which may control transmission of the driving force from the driving-force transmitter gear train 100D. The driving-force transmitter gear train 100D is mechanically connected with a nipping-force controlling gear train 100E, which may control transmission of the driving force from the development motor 3D to the nipping-force adjuster 200 (see FIG. 10). In FIGS. 8 and 10, intermeshing transmitting flows through gears in the driving-force transmitter gear train 100D are indicated in thicker solid lines, and intermeshing transmitting flows through gears in the driving-force controlling gear train 100C and the nipping-force controlling gear train 100E are indicated in thicker broken lines.

The driving-force transmitter gear train 100D includes first idle gears 110, second idle gears 113, third idle gears 115, clutches 120, and coupling gears 117. The first idle gears 100 include two (2) first idle gears 110A, 110B; the second idle gears 113 include three (3) second idle gears 113A, 113B, 113C; the third idle gears 115 include four (4) third idle gears 115Y, 115M, 115C, 115K; the clutches 120 includes four (4) clutches 120Y, 120M, 120C, 120K; and the coupling gears 117 include four (4) coupling gears 117Y, 117M, 117C, 117K. The gears forming the driving-force transmitter gear train 110D are supported by either the supporting plate 102 or a frame, which is not shown, and may rotate about rotation axes parallel to the rotation axis of the photosensitive drum 50.

The development motor 3D includes an output shaft 3A, which may rotate when the development motor 3D is active. To the output shaft 3A, attached is a gear, which is not shown.

As shown in FIG. 7, each first idle gear 110 is a two-wheeler gear having a larger-diameter gear 110L and a smaller-diameter gear 110S. A quantity of teeth in the smaller-diameter gear 110S is smaller than a quantity of teeth in the larger-diameter gear 110L. The larger-diameter gear 110L and the smaller-diameter gear 110S rotate integrally. The first idle gear 110A is arranged at a frontward position with respect to the output shaft 3A, and the first idle gear 110B is arranged at a rearward position with respect to the output shaft 3A. The smaller-diameter gears 110S in the first idle gears 110A, 110B mesh with the output shaft 3A.

As shown in FIG. 8, on the frontward side with respect to the output shaft 3A, the smaller-diameter gear 110S in the first idle gear 110A meshes with the second idle gear 113A. On the rearward side of the output shaft 3A, the smaller-diameter gear 110S in the first idle gear 110B meshes with the second idle gear 113B.

The third idle gears 115Y, 115M, 115C, 115K are provided to correspond to the colors of yellow, magenta, cyan, and black, respectively, and arranged in this recited order from front to rear. In other words, the third idle gear 115Y for yellow is at a most frontward position among the third idle gears 115Y, 115M, 115C, 115K, and the third idle gear 115K for black is at a most rearward position among the third idle gears 115Y, 115M, 115C, 115K. The third idle gears 115Y, 115M mesh with the second idle gear 113A. The third idle gear 115C meshes with the second idle gear 113B. The third idle gears 115C, 115K mesh with the second idle gear 113C. Therefore, the third idle gear 115K may receive the driving force from the third idle gear 115C through the second idle gear 113C.

The clutches 120Y, 120M, 120C, 120K are in a same configuration. The clutches 120Y, 120M, 120C, 120K mesh with the third idle gears 115Y, 115M, 115C, 115K, respectively, to receive the driving force from the third idle gears 115Y, 115M, 115C, 115K. The clutch 120 will be described further below.

The coupling gears 117 each meshes with one of the clutches 120Y, 120M, 120C, 120K. Each coupling gear 117 includes a coupling shaft 119 (see FIG. 7), which is rotatable integrally with the coupling gear 117. The coupling shaft 119 is movable in a direction of an axis thereof in cooperation with opening/closing motions of the front cover 11. The coupling shaft 119 may engage with a coupling 65 (see FIG. 3A) in the developing cartridge 60 when the front cover 11 is closed.

With the driving-force transmitter gear train 110D, the coupling gear 117Y for yellow may receive the driving force from the development motor 3D through the first idle gear 110A, the second idle gear 113A, the third idle gear 115Y, and the clutch 120Y. The coupling gear 117M for magenta may receive the driving force from the development motor 3D through the first idle gear 110A, the second idle gear 113A, the third idle gear 115M, and the clutch 120M. The coupling gear 117C for cyan may receive the driving force from the development motor 3D through the first idle gear 110B, the second idle gear 113B, the third idle gear 115C, and the clutch 120C. The coupling gear 117K for black may receive the driving force from the development motor 3D through the first idle gear 110B, the second idle gear 113B, the third idle gear 115C, the second idle gear 113C, the third idle gear 115K, and the clutch 120K.

As shown in FIGS. 9 and 10, the driving-force controller gear train 110C includes fourth idle gears 131, fifth idle gears 132, a YMC clutch 140A, a K clutch 140K, sixth idle gears 133, a seventh idle gear 134, an eighth idle gear 135, a ninth idle gear 136, a tenth idle gear 137, and the first cam 150 including the first cams 150Y, 150M, 150C, 150K described earlier. The fourth idle gears 131 include two (2) fourth idle gears 131A, 131B; the fifth idle gears 132 include two (2) fifth idle gears 132A, 132B; the sixth idle gears 133 include two (2) idle gears 133A, 133B. The gears forming the driving-force controller gear train 110C are supported by either the supporting plate 102 or a frame, which is not shown, and may rotate about rotation axes parallel to the rotation axis of the photosensitive drum 50.

Each fourth idle gear 131 is a two-wheeler gear having a larger-diameter gear 131L and a smaller-diameter gear 131S (see FIG. 9). A quantity of teeth in the smaller-diameter gear 131S is smaller than a quantity of teeth in the larger-diameter gear 131L. The larger-diameter gear 131L and the smaller-diameter gear 131S rotate integrally. The fourth idle gear 131A is arranged at a frontward position with respect to the first idle gear 110A, and the fourth idle gear 131B is arranged at a rearward position with respect to the first idle gear 110B. The larger-diameter gears 131L in the fourth idle gears 131A, 131B mesh with the smaller-diameter gears 110S in the first idle gears 110A, 110B, respectively.

The fifth idle gear 132A is arranged at a frontward position with respect to the fourth idle gear 131A, and the fifth idle gear 132B is arranged at a rearward position with respect to the fourth idle gear 131B. The fifth idle gears 132A, 132B mesh with the smaller-diameter gears 131S in the fourth idle gears 131A, 131B, respectively.

The YMC clutch 140A may switch transmission and disconnection of the driving-force controller gear train 110C, which forms the transmission flow to transmit the driving force from the development motor 3D to the first cams 150Y, 150M, 150C. In other words, the YMC clutch 140A may switch state of the first cams 150Y, 150M, 150C between rotating and stationary. In particular, the YMC clutch 140A is switchable between a transmittable condition, in which the YMC clutch 140A may transmit the driving force from the development motor 3D to the first cams 150Y, 150M, 150C, and a discontinuing condition, in which the YMC clutch 140A may disconnect the driving force from the development motor 3D not to be transmitted to the first cams 150Y, 150M, 150C, so that the state of the first cams 150Y, 150M, 150C may be switched between rotating and stationary.

The YMC clutch 140A includes a larger-diameter gear 140L and a smaller-diameter gear 140S. A quantity of teeth in the smaller-diameter gear 140S is smaller than a quantity of teeth in the larger-diameter gear 140L. The YMC clutch 140A is arranged at a frontward position with respect to the fifth idle gear 132A, with the larger-diameter gear 140L meshing with the fifth idle gear 132A. The YMC clutch 140A may be, for example, an electromagnetic clutch, in which the larger-diameter gear 140L and the smaller-diameter gear 140S may rotate integrally when the YMC clutch 140A is powered on, or activated; and when the YMC clutch 140A is powered off, or deactivated, the larger-diameter gear 140L may idle so that the smaller-diameter gear 140S may stay stationary.

The K clutch 140K is in the configuration similar to the YMC clutch 140A. Therefore, the K clutch 140K may switch transmission and disconnection of the driving-force controller gear train 110C, which forms the transmission flow to transmit the driving force from the development motor 3D to the first cam 150K. In particular, the K clutch 140K is switchable between a transmittable condition, in which the K clutch 140K may transmit the driving force from the development motor 3D to the first cam 150K, and a discontinuing condition, in which the K clutch 140K may disconnect the driving force from the development motor 3D not to be transmitted to the first cam 150K, so that the state of the first cam 150K may be switched between rotating and stationary. The K clutch 140K includes a larger-diameter gear 140L and a smaller-diameter gear 140S. A quantity of teeth in the smaller-diameter gear 140S is smaller than a quantity of teeth in the larger-diameter gear 140L. The K clutch 140A is arranged at a rearward position with respect to the fifth idle gear 132B, with the larger-diameter gear 140L meshing with the fifth idle gear 132B.

Each sixth idle gear 133 is a two-wheeler gear having a larger-diameter gear 133L and a smaller-diameter gear 133S (see FIG. 7). A quantity of teeth in the smaller-diameter gear 133S is smaller than a quantity of teeth in the larger-diameter gear 133L. The larger-diameter gear 133L and the smaller-diameter gear 133S rotate integrally. The fourth idle gear 133A is arranged at a frontward position with respect to the YMC clutch 140A, and the fourth idle gear 133B is arranged at a rearward position with respect to the K clutch 140K. The larger-diameter gears 133L in the sixth idle gears 133A, 133B mesh with the smaller-diameter gears 140S in the YMC clutch 140A and the K clutch 140K, respectively.

The seventh idle gear 134 is arranged between the sixth idle gear 133A and the first cam 150Y. The seventh idle gear 134 meshes with the smaller-diameter gear 133S (see FIG. 7) in the sixth idle gear 133A and the gear portion 150G in the first cam 150Y.

The eighth idle gear 135 is arranged between the first cam 150Y and the first cam 150M. The eighth idle gear 135 meshes with the gear portion 150G in the first cam 150Y and the gear portion 150G in the first cam 150M.

The ninth idle gear 136 is arranged between the first cam 150M and the first cam 150C. The ninth idle gear 136 meshes with the gear portion 150G in the first cam 150M and the gear portion 150G in the first cam 150C.

The tenth idle gear 137 is arranged between the sixth idle gear 133B and the first cam 150K. The tenth idle gear 137 meshes with the smaller-diameter gear 133S in the sixth idle gear 133B (see FIG. 7) and the gear portion 150G in the first cam 150K.

With the driving-force controlling gear train 110C, the first cam 150Y for yellow may receive the driving force from the development motor 3D through the first idle gear 110A, the fourth idle gear 131A, the fifth idle gear 132A, the YMC clutch 140A, the sixth idle gear 133A, and the seventh idle gear 134. The first cam 150M for magenta may receive the driving force from the first cam 150Y for yellow through the eighth idle gear 135. The first cam 150C for cyan may receive the driving force from the first cam 150M for magenta through the ninth idle gear 136. The first cams 150Y, 150M, 150C may synchronously rotate when the YMC clutch 140A is activated and stop rotating by when the YMC clutch 140A is deactivated.

The first cam 150K for black, on the other hand, may receive the driving force from the development motor 3D through the first idle gear 110B, the fourth idle gear 131B, the fifth idle gear 132B, the K clutch 140K, the sixth idle gear 133B, and the tenth idle gear 137. The first cam 150K may rotate when the K clutch 150K is activated and stop rotating when the K clutch 140K is deactivated.

Figure 11A:
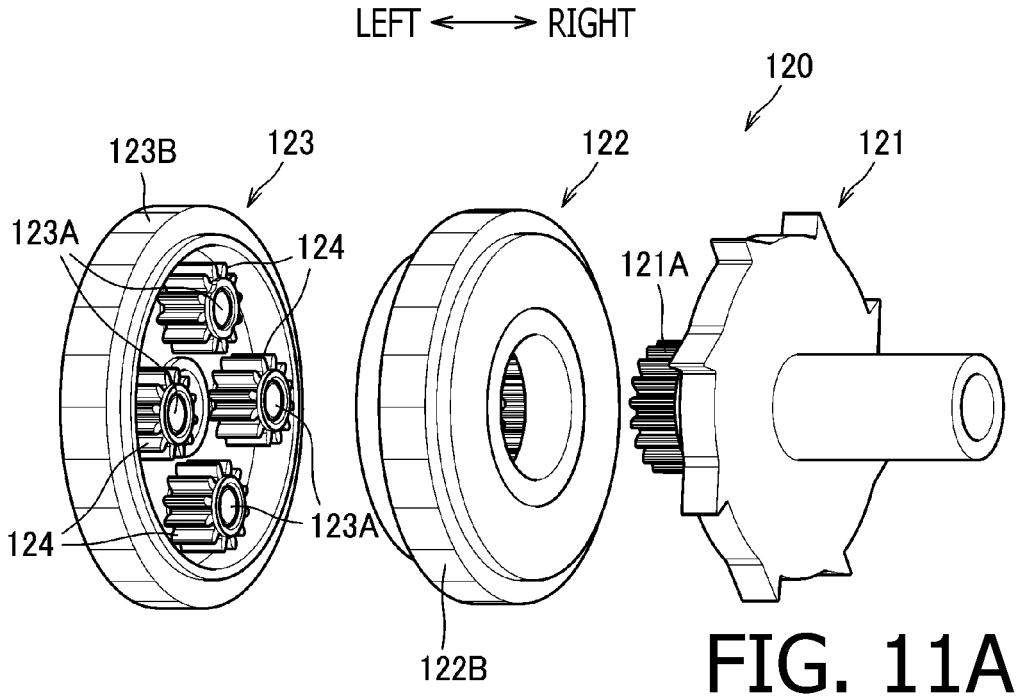
FIGS. 11A and 11 are exploded views of a clutch in the image forming apparatus according to the embodiment of the present disclosure, viewed from a side of a sun gear and a side of a carrier, respectively.
Figure 11B:
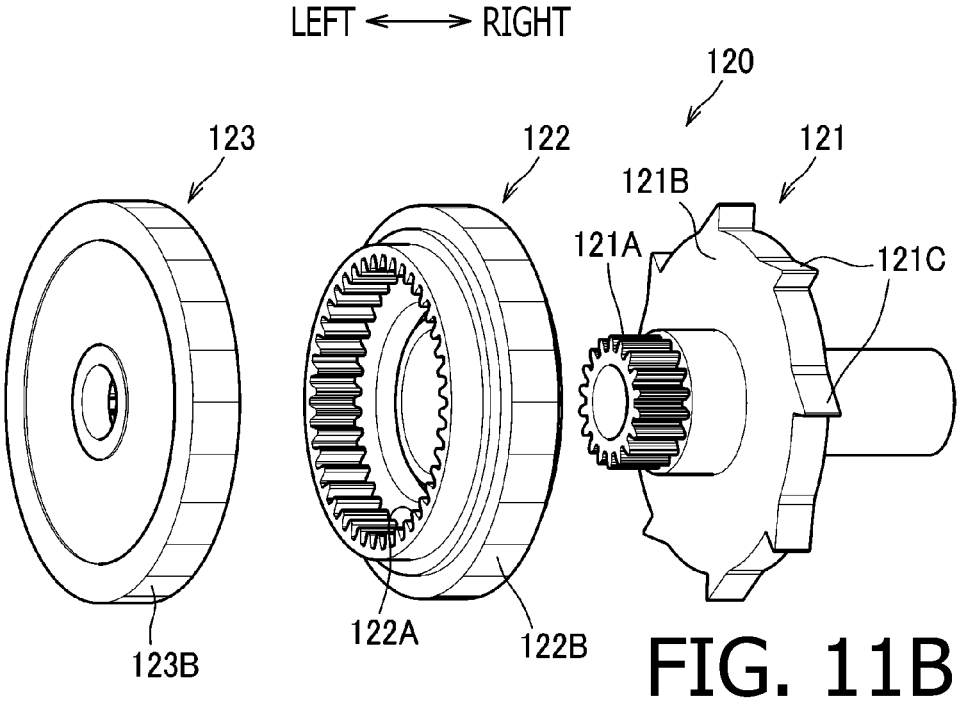

In the following paragraphs, described will be the detailed configuration and movements of the clutch 120. As shown in FIGS. 11A-11B, each clutch 120 includes a planetary gear assembly. The clutch 120 is switchable between a transmittable condition, in which the clutch 120 may transmit the driving force from the development motor 3D to the developing roller 61, and a discontinuing condition, in which the clutch 120 may disconnect the driving force from the development motor 3D not to be transmitted to the developing roller 61. The clutch 120 includes a sun gear 121, which is rotatable about an axis, a ring gear 122, a carrier 123, and planetary gears 124 supported by the carrier 123.

The sun gear 121 includes a disk portion 121B, which is rotatable integrally with the gear portion 121A, and claw portions 121C, which are arranged on an outer circumference of the disk portion 121. The claw portions 121C each has a pointed end, which leans to one side in a rotating direction of the sun gear 121. The ring gear 122 includes an inner gear 122A arranged on an inner circumferential surface and an input gear 122B arranged on an outer circumferential surface.

The carrier 123 includes four (4) shaft portions 123A, which support the planetary gears 124 rotatably. The carrier 123 includes an output gear 123B arranged on an outer circumferential surface thereof.

The planetary gears 124 include four (4) planetary gears 124, each of which is supported by one of the shaft portions 123A in the carrier 123. The planetary gears 124 mesh with gear portion 121A of the sun gear 121 and with the inner gear 122A in the ring gear 122.

In the clutch 120, the input gear 122B meshes with the third idle gear 115, and the output gear 123B meshes with the coupling gear 117 (see FIG. 7). In this arrangement, when the sun gear 121 is restrained from rotating, the clutch 120 is in the transmittable condition, in which the driving force input to the input gear 122B is transmittable to the output gear 123B. On the other hand, when the sun gear 121 is allowed to rotate, the clutch 120 is in the discontinuing condition, in which the driving force input to the input gear 122B is not transmittable to the output gear 123B. When the clutch 120 is in the discontinuing condition, and the output gear 123B is under load, and when the driving force is input to the input gear 122B, the output gear 123B does not rotate so that the sun gear 121 idles.

As shown in FIG. 10, the driving-force transmitter 100 includes a second cam portion 153B, which is formed in the first cam 150, and the lever 160. The lever 160 is swingably supported by a supporting shaft 102A, which is fixed to the supporting plate 102. The lever 160 may, in cooperation with the first cam 150, engage with the sun gear 121, which is one of the elements in the planetary gear assembly, to restrict the sun gear 121 from rotating so that the clutch 120 may be placed in the transmittable condition, and may release the sun gear 121 so that the clutch 120 may be placed in the discontinuing condition.

In particular, as shown in FIG. 12A, the lever 160 includes a rotation-supporting portion 161, a first arm 162 extending from the rotation-supporting portion 161, and a second arm 163 extending from the rotation-supporting portion 161 in a direction different from the first arm 162.

The rotation-supporting portion 161 has a cylindrical shape with a hollow, in which the supporting shaft 102A of the supporting plate 102 is inserted to support the lever 160.

An end of the second arm 163 extends toward the outer circumferential surface of the disk portion 121B of the clutch 120. The lever 160 is urged by a torsion spring, which is not shown, such that the end of the second arm 163 is urged against the outer circumferential surface of the sun gear 121, or the disk portion 121B. The end of the second arm 163 forms a hook 163A. The hook 163A may engage with one of the claw portions 121C formed on the outer circumferential surface of the sun gear 121, which is rotatable by the rotation of the development motor 3D in the normal direction, to restrict the sun gear 121 from rotating.

The lever 160 may contact the second cam portion 153B at an end portion 162A of the first arm 162. The lever 160 is movable between an engaging position, in which the end portion 162A of the first arm 162 faces the basal round portion 153A while the hook 163A engages with one of the claw portions 121C in the sun gear 121 being one of the elements in the planetary gear assembly, and a separating position, in which the end portion 162A of the first arm 162 is pushed by the second cam portion 153B to cause the hook 163A to separate from the claw portions 121C in the sun gear 121 being one of the elements in the planetary gear assembly. The lever 160 may place the clutch 120 in the transmittable condition when the lever 160 is separated from the second cam portion 153B and located at the engaging position and may place the clutch 120 in the discontinuing condition when the lever 160 contacts the second cam portion 153B and is located at the separated position.

With reference to FIGS. 12A-12B through 16A-16B, described below will be the movements of the lever 160. It may be noted that, while the items for yellow are illustrated in FIGS. 12A-12B through 16A-16B, among the four colors of yellow, magenta, cyan, and black, the corresponding items for the other colors, i.e., magenta, cyan, and black, may act in the same manners as the items for yellow, except that the phases in the first cams 150Y, 150M, 150C, 150K are different.

As shown in FIGS. 12A-12B, as the clutch-controlling cam 153 rotates, the end portion 162A of the first cam 162 tracing the second cam portion 153B may separate from the second cam portion 153B and face the basal round portion 153A. Meanwhile, the hook 163A in the second arm 163 may engage with one of the claw portions 121C in the sun gear 121 in the clutch 120 to place the lever 160 at the engaging position. As the lever 160 restricts the sun gear 121 from rotating, the clutch 120 may be placed in the transmittable condition, in which the output gear 123B is rotatable when the input gear 122B rotates. Thereby, the driving force from the development motor 3D rotating in the normal direction may be transmittable to the developing roller 61 through the driving-force transmitter gear train 100D, and when the development motor 3D rotates in the normal direction, the developing roller 61 may rotate. Meanwhile, the cam follower 170 is located at a position, in which the end face of the contact portion 172 is on the first retainer face F1 of the cam face 152F. Therefore, the slidable shaft 171 is separated from the slider member 64 in the developing cartridge 60 (see FIG. 4A), and the developing roller 61 is located at the contacting position.

As the first cam 150 rotates from the position shown in FIGS. 12A-12B to a position shown in FIGS. 13A-13B, the contact portion 172 of the cam follower 170 slides on the first retainer face F1 to be closer to the first guide face F3. In order to stop the first cam 150Y among the four (4) first cams 150 at a position, in which the first developing roller 61Y is at the contacting position, the first cam 150Y may be stopped at the position as shown in FIGS. 13A-13B, in which the contact portion 172 is on the first guide face F3.

In order to separate the developing roller 61 from the photosensitive drum 50, the first cam 150Y may further rotate so that the contact portion 172 may slide on the first guide face F3 and pushed by the first guide face F3 to contact the second retainer face F2, as shown in FIGS. 14A-14B. Meanwhile, the slidable shaft 171 may push the slider member 64 in the developing cartridge 60 in the rotation-axis direction. Thereby, the developing cartridge 60 may be moved frontward by a reaction force from the supporting member 90 (see FIG. 4B). The developing roller 61 may, when the contact portion 172 is at a position on the first guide face F3 closer to the second retainer face F2 rather than the first retainer face F1, start separating from the photosensitive drum 50. When the contact portion 172 is on the second retainer face F2, the developing roller 61 is maintained at the separated position.

When the developing roller 61 is at the separated position, the first cam 150 may rotate further to a position, in which the end portion 162A of the arm 162 in the lever 160 may contact the second cam portion 153B, as shown in FIGS. 15A-15B. As the first arm 162 is pushed by the second cam portion 153B, the lever 160 may swing, and the hook 163A unhooked from the claw portion 121C in the sun gear 121 may move to the separating position. Therefore, the sun gear 121 in the clutch 120 may be released from the lever 160 for rotation and placed in the discontinuing condition, in which the output gear 123B is not transmittable of the driving force even when the input gear 122B rotates. Thereby, the driving force from the development motor 3D may not be transmitted to the developing roller 61. In other words, even when the development motor 3D rotates, merely the sun gear 121 idles, and the developing roller 61 does not rotate.

In order to place and maintain the developing roller 61 at the separated position, the first cam 150 may be stopped at a position, as shown in FIGS. 15A-15B, in which the lever 160 is at the separating position. However, in order to maintain the first developing roller 61Y specifically at the separated position, the first cam 150Y for yellow among the first cams 150Y, 150M, 150C, 150K may be rotated further from the position shown in FIGS. 15A-15B and stopped at a position, as shown in FIGS. 16A-16B, in which the contact portion 172 is at an end of the second retainer face F2 closer to the second guide face F4 rather than the first guide face F3, e.g., a position on the second retainer face F2 most or immediately adjacent to a boundary between the second retainer face F2 and the second guide face F4.

In order to move the developing roller 61 from the separated position to the contacting position, the first cam 150 may be rotated from the position shown in either FIGS. 15A-15B or FIGS. 16A-16B so that the contact portion 172 may slide on the second guide face F4 to a position, as shown in FIGS. 12A-12B, in which the contact portion 172 faces the first retainer face F1. Thereby, the slidable shaft 171 may be moved in the rotation-axis direction by the urging force of the spring 173 to separate from the slider member 64. The slider member 64 may return to the position shown in FIG. 4A, and the developing cartridge 60 may return to the position indicated by the solid lines in FIG. 1. Therefore, the developing roller 61 may contact the photosensitive drum 50. In other words, the developing roller 61 may contact the photosensitive drum 50 when the contact portion 172 passes through the position on the second guide face F4 adjacent to the second retainer face F2 (see FIG. 16B).

Accordingly, with the lever 160 located at the engaging position, in which the lever 160 faces the basal round portion 153A and engages with the sun gear 121, the clutch 120 may be placed in the transmittable condition.

In the image forming apparatus 1 of the present embodiment, in order to transfer the toner images to the sheet S, the first developing roller 61Y, the second developing roller 61M, the third developing roller 61C, and the fourth developing roller 61K are moved in sequence to the respective contacting positions as the sheet S is conveyed, and after transferring the toner images onto the sheet S, the first developing roller 61Y, the second developing roller 61M, the third developing roller 61C, and the fourth developing roller 61K are moved to the separated positions in sequence. In this regard, the first cams 150Y, 150M, 150C are assembled in an arrangement such that the phases of the first cam portions 152A are differed from one another for predetermined angles (see FIG. 9). In particular, the first cams 150M, 150C are in the identical form while the first cam 150Y has the first cam portion 152A, of which circumferential length along the rotating direction is greater than a circumferential length of the first cam portions 152A along the rotating direction in the first cams 150M, 150C. Moreover, downstream ends of the first cam portions 152A of the first cams 150Y, 150M, 150C in the rotating direction are arranged at different rotational positions from one another for a predetermined angle; and upstream ends of the first cam portions 152A of the first cams 150Y, 150M, 150C in the rotating direction are arranged to coincide with one another. Meanwhile, the first cam 150K is in the form identical to the first cams 150M, 150C but is controlled by the controller 2 to move at a delayed phase compared to the first cams 150M, 150C for a predetermined angle.

When the development motor 3D rotates in the reverse direction, the sun gear 121 being one of the elements in the planetary gear assembly may rotate in a direction indicated by an arrow, which is outlined in dash-and-dots lines in FIG. 12A, i.e., a direction opposite to the rotating direction when the development motor 3D rotates in the normal direction, the hook 163A may not engage with the claw portions 121C. Therefore, when the sun gear 121 rotates in the opposite direction alongside the reverse rotation of the development motor 3D, the lever 160 may not restrict the rotation of the sun gear 121. While the sun gear 121 is free to rotate, the clutch 120 is in the discontinuing condition, in which the driving force input in the input gear 122B is not transmitted to the output gear 123B. In this regard, when the development motor 3D rotates in the reverse direction, the lever 160 may place the clutch 120 in the discontinuing condition. In other words, when the development motor 3D rotates in the reverse direction, the driving force from the development motor 3D may not be transmitted to the developing roller 61.

As shown in FIGS. 7-8, the nipping-force controlling gear train 100E includes an eleventh idle gear 191, a twelfth idle gear 192, an N clutch 145, a thirteenth idle gear 193, and a fourteenth idle gear 194. The gears forming the nipping-force controlling gear train 100E are supported by a frame, which is not shown, and may rotate about rotation axes parallel to the rotation axis of the photosensitive drum 50.

The eleventh idle gear 191 meshes with the third idle gear 115K, which is at a frontward position with respect to the eleventh idle gear 191. Through the third gear 115K, the nipping-force controlling gear train 110E may receive the driving force.

The twelfth idle gear 192 is located at an upper position with respect to the eleventh idle gear 191. The twelfth idle gear 192 is a two-wheeler gear having a larger-diameter gear 192L and a smaller-diameter gear 192S. A quantity of teeth in the smaller-diameter gear 192S is smaller than a quantity of teeth in the larger-diameter gear 192L. The larger-diameter gear 192L and the smaller-diameter gear 192S rotate integrally. The larger-diameter gear 192L in the twelfth idle gear 192 meshes with the eleventh idle gear 191.

The N clutch 145 may switch transmission and disconnection of the nipping-force controlling gear train 100E, which forms the transmission flow to transmit the driving force from the development motor 3D to a second cam 210 (see FIG. 17) in the nipping-force adjuster 200. In particular, the N clutch 145 is switchable between a transmittable condition, in which the N clutch 145 may transmit the driving force from the development motor 3D to the second cam 210, and a discontinuing condition, in which the N clutch 145 may disconnect the driving force from the development motor 3D not to be transmitted to the second cam 210, so that the state of second cam 210 may be switched between rotating and stationary.

The N clutch 145 includes a larger-diameter gear 145L and a smaller-diameter gear 145S. A quantity of teeth in the smaller-diameter gear 145S is smaller than a quantity of teeth in the larger-diameter gear 145L. The N clutch 145 is arranged at an upper position with respect to the twelfth idle gear 192, with the larger-diameter gear 145L meshing with the smaller-diameter gear 192S in the twelfth idle gear 192. The N clutch 145 may be, for example, an electromagnetic clutch, in which the larger-diameter gear 145L and the smaller-diameter gear 145S may rotate integrally when the N clutch 145 is powered on, or activated; and when the N clutch 145 is powered off, or deactivated, the larger-diameter gear 145L may idle so that the smaller-diameter gear 145S may stay stationary.

As shown in FIGS. 9-10, the thirteenth idle gear 193 is located at a position rearward with respect to the twelfth idle gear 192 and lower with respect to the N clutch 145. The thirteenth idle gear 193 is a two-wheeler gear having a larger-diameter gear 193L and a smaller-diameter gear 193S. A quantity of teeth in the smaller-diameter gear 193S is smaller than a quantity of teeth in the larger-diameter gear 193L. The larger-diameter gear 193L and the smaller-diameter gear 193S rotate integrally. The larger-diameter gear 193L in the thirteenth idle gear 193 meshes with the smaller-diameter gear 145S in the N clutch 145.

The fourteenth idle gear 194 is located at a position rearward with respect to the eleventh idle gear 191 and lower with respect to the thirteenth idle gear 193. The fourteenth idle gear 194 is a two-wheeler gear having a larger-diameter gear 194L and a smaller-diameter gear 194S. A quantity of teeth in the smaller-diameter gear 194S is smaller than a quantity of teeth in the larger-diameter gear 194L. The larger-diameter gear 194L and the smaller-diameter gear 194S rotate integrally. The larger-diameter gear 194L in the fourteenth idle gear 194 meshes with the smaller-diameter gear 193S in the thirteenth idle gear 193, and the smaller-diameter gear 194S in the fourteenth idle gear 194 meshes with a gear portion 230 in the second cam 210.

The nipping-force adjuster 200 may switch the nipping force between the heating roller 81 and the pressing roller 82 in the fuser 80 between a first nipping force, as shown in FIG. 17C, and a second nipping force, as shown in FIGS. 17A-17B. The nipping-force adjuster 200 may switch the nipping force in the fuser 80 to the second nipping force when the development motor 3D rotates in the normal direction and to the first nipping force when the development motor 3D rotates in the reverse direction.

As shown in FIG. 17C, when the nipping force in the fuser 80 is at the first nipping force, the heating roller 81 and the pressing roller 82 are separated from each other. In other words, the first nipping force produces no (zero) pressure. The second nipping force is greater than the first nipping force. The second nipping force according to the present embodiment includes a third nipping force (see FIG. 17B), which is greater than the first nipping force, and a fourth nipping force (see FIG. 17A), which is greater than the third nipping force. The nipping-force adjuster 200 may switch the nipping forces between the first nipping force and the third nipping force and between the first nipping force and the fourth nipping force. In the following paragraphs, the first nipping force, the third nipping force, and the fourth nipping force may be called as zero nipping force, smaller nipping force, and greater nipping force, respectively. A nipping range N1 between the heating roller 81 and the pressing roller 82 under the greater nipping force is larger than a nipping range N2 between the heating roller 81 and the pressing roller 82 under the smaller nipping force.

In the following paragraphs, described in detail will be a configuration of the fuser 80. As shown in FIG. 17A, the fuser 80 includes a frame 84 to support the heating roller 81 rotatably, a lever 85 to support the pressing roller 82 rotatably, and a spring 86 which may pressurize the pressing roller 82 against the heating roller 81. The lever 85, the spring, and the parts of the frame 84, with which the lever 85 and the spring 86 are engaged, are arranged on each side of the fuser 80 in the rotation-axis direction, although solely one of each is shown in FIGS. 17A-17C.

The frame 84 includes a shaft portion 84A and a first spring-engageable portion 84B. The lever 85 includes a shaft-engageable portion 85A, a second spring-engageable portion 85B, and a cam-contacting face 85C. The lever 85 is engaged with the shaft portion 84A of the frame 84 at the shaft-engageable portion 85A to be supported swingably by the frame 84 to swing about the shaft portion 84A. Thereby, the pressing roller 82 supported by the lever 85 is movable to contact and separate from the heating roller 81 supported by the frame 84. The spring 86 may be a tension coil spring. One end of the spring 86 is engaged with the first spring-engageable portion 84B in the frame 84, and the other end of the spring 86 is engaged with the second spring-engageable portion 85B in the lever 85.

The nipping-force adjuster 200 includes a pair of second cams 210 (solely one of the pair is shown), each of which is provided correspondingly to the cam-contacting face 85C of each lever 85, a shaft portion 220, which extends in the rotation-axis direction to connect the paired second cams 210 with each other, and a gear portion 230 (see FIG. 10) arranged on one end of the shaft portion 220 in the rotation-axis direction. The paired second cams 210, the shaft portion 220, and the gear portion 230 are formed to rotate integrally. As shown in FIG. 10, the gear portion 230 meshes with the smaller-diameter gear 194S in the fourteenth idle gear 194 that forms the nipping-force controlling gear train 100E.

As shown in FIG. 17B, the second cam 210 may control the nipping force between the heating roller 81 and the pressing roller 82. The second cam 210 may rotate in either a first rotating direction R1 or a second rotating direction R2, which is opposite from the first rotating direction R1, by receiving the driving force from the development motor 3D. In particular, the second cam 210 may rotate in the first rotating direction R1 by receiving the driving force from the development motor 3D when the development motor 3D rotates in the normal direction and may rotate in the second rotating direction R2 by receiving the driving force from the development motor 3D when the development motor 3D rotates in the reverse direction. The second cam 210 may move one of the heating roller 81 and the pressing roller 82 to move closer to or separate from the other of the heating roller 81 and the pressing roller 82 to switch the nipping forces. For example, the second cam 210 may move the pressing roller 82 to move closer to or separate from the heating roller 81.

The second cam 210 may move the heating roller 82 by rotating to switch the nipping forces between the heating roller 81 and the pressing roller 82 in the fuser 80, between the zero nipping force and the smaller nipping force, or between the zero nipping force and the greater nipping force. The second cam 210, together with the shaft portion 220, is rotatably supported by a frame, which is not shown, to rotate about an axis parallel to rotation axes of the heating roller 81 and the pressing roller 82. The second cam 210 has a cam face 213 on an outer periphery thereof. The cam face 213 includes a first cam face 213A, which may contact the cam-contacting face 85C of the lever 85 to cause the zero nipping force, and a second cam face 213B, which may contact the cam-contacting face 85C of the lever 85 to cause the smaller nipping force. The second cam 210 is formed such that a distance between the first cam face 213A and a rotation axis of the second cam 210 is greater than a distance between the second cam face 213B and the rotation axis of the second cam 210. The outer peripheral surface of the second cam 210 is separated from the cam-contacting face 85C of the lever 85, as shown in FIG. 17A, to cause the greater nipping force.

The controller 2 may control overall movements in the image forming apparatus 1. The controller 2 includes a CPU, a ROM, a RAM, and input/output device, which are not shown. The controller 2 may execute predetermined programs to process operations.

For example, based on signals from the feeder sensor 28A, the pre-registration sensor 28B, the post-registration sensor 28C, and the separation sensors 4K, 4C, the controller 2 may control the YMC clutch 140A and the clutch 140K to control the contacting and separating movements of the developing roller 61 with respect to the photosensitive drum 50 and may control the N clutch 145 to control the nipping force between the pressing roller 82 and the heating roller 81 in the fuser 80.

When the second developing roller 61M, the third developing roller 61C, and the fourth developing roller 61K are at the respective separating positions, the second developing roller 61M, the third developing roller 61C, and the fourth developing roller 61K may interrupt the light paths for the laser beams emitted at the first photosensitive drum 50Y, the second photosensitive drum 50M, and the third photosensitive drum 50C, respectively, which are located upstream adjacent positions in the sheet-moving direction from the second photosensitive drum 50M, the third photosensitive drum 50C, and the fourth photosensitive drum 50K corresponding to the second developing roller 61M, the third developing roller 61C, and the fourth developing roller 61K, respectively. Therefore, the image forming apparatus 1 is arranged such that the second developing roller 61M, the third developing roller 61C, and the fourth developing roller 61K are moved to or located at the respective contacting positions before the upstream adjoining photosensitive drums 50. i.e., the first photosensitive drum 50Y, the second photosensitive drum 50M, the third photosensitive drum 50C, are exposed to the laser beams.

In this regard, the second developing roller 61M and the third developing rollers 61C are enabled to be located to the respective contacting positions before the first and second photosensitive drums 50Y, 50M in the upstream adjoining positions are exposed to the laser beams from the exposure device 40 due to the difference in the circumferential lengths of the first cam portions 152A in the first cams 150Y, 150M, 150C in the rotating direction and the mechanical setting for the phases of the first cams 150Y, 150M, 150C being differed from one another. In particular, in order to locate the second developing roller 61M at the contacting position before the first photosensitive drum 50Y is exposed to the laser beam, the first cams 150Y, 150M are in an arrangement such that the second developing roller 61M is moved to contact the second photosensitive drum 50M on or before the first developing roller 61Y contacts the first photosensitive drum 50Y. In other words, t1, which expresses the time when the first developing roller 61Y contacts the first photosensitive drum 50Y, and t2, which expresses the time when the second developing roller 61M contacts the second photosensitive drum 50M, are set in a relation: t2≤t1. In the present embodiment, more specifically, t1 and t2 are set to be equal (t2=t1), or simultaneous.

Meanwhile, the fourth developing roller 61K may be controlled differently depending on whether an image to be formed is a multicolored image or a monochrome image. When printing a multicolored image, in consideration of the movement of the third developing roller 61C, the controller 2 may control the first cam 150K to move at a delayed phase for a predetermined angle with respect to the first cam 150C. In other words, when the multicolored image is printed with use of the first developing roller 61Y, the second developing roller 61M, the third developing roller 61C, and the fourth developing roller 61K, the controller 2 may, before the third photosensitive drum 50C is exposed to the laser beam, move the third developing roller 61C to the contacting position and move the fourth developing roller 61K to the contacting position. After the toner image is completely developed by the third developing roller 61C on the third photosensitive drum 50C, and before the toner image is completely developed by the fourth developing roller 61K on the fourth photosensitive drum 50K, the controller 2 may move the third developing roller 61C to the separated position. Thereafter, when the toner image is completely developed on the fourth photosensitive drum 50K, the controller 2 may move the fourth developing roller 61K to the separated position.

On the other hand, when printing a monochrome image on the sheet S with use of the fourth developing roller 61K alone, the controller 2 may maintain the first developing roller 61Y, the second developing roller 61M, and the third developing roller 61C at the respective separated positions, and before the fourth photosensitive drum 50K is exposed to the laser beam, move the fourth developing roller 61K to the contacting position. After the toner image is completely developed by the fourth developing roller 61K on the fourth photosensitive drum 50K, the controller 2 may move the fourth developing roller 61K to the separated position.

The controller 2 further controls timing, in which the first developing roller 61Y for yellow at the most upstream position in the sheet-conveying direction among the first, second, third, and fourth developing milers 61Y, 61M, 61C, 61K contacts the first photosensitive drum 50Y, to be synchronized with the conveyance of the sheet S. In other words, after starting conveying the sheet S and before the sheet S reaches the first photosensitive drum 50Y, the controller 2 controls the first cams 150Y, 150M, 150C through the YMC clutch 140A to rotate. Thereafter, the controller 2 controls the YMC clutch 140A to stop the rotation of the first cams 150Y, 150M, 150C at a pausing timing, which is a moment when a first period T1 elapses since ON signals from the separation sensor 4C were discontinued, in other words, since the controller 2 starts receiving OFF signals, while the first developing roller 61Y is separated from the first photosensitive drum 50Y. Thereafter, at a resuming timing, which is a moment when a second period T2 elapses since the pre-registration sensor 28B being a sheet sensor detects the leading edge of the sheet S passing thereby, the controller 2 controls the YMC clutch 140A to move the first cams 150Y, 150M, 150C to rotate, and after the first developing roller 61Y contacts the first photosensitive drum 50Y, the image may be printed on the sheet S.

Meanwhile, in order to switch the nipping force in the fuser 80 from the zero nipping force as shown in FIG. 17C to the smaller nipping force as shown in FIG. 17B or to the greater nipping force as shown in FIG. 17A, the controller 2 may maintain the YMC clutch 140A and the K clutch 140K deactivated, control the development motor 3D to rotate in the normal direction, and activate the N clutch 145. Thereby, the second cam 210 may rotate in the first rotating direction R1 from the posture shown in FIG. 17C.

In order to switch the nipping force to the smaller nipping force, the controller 2 may rotate the second cam 210 from the position, in which the first cam face 213A contacts the cam-contacting face 85C of the lever 85, to the position, in which the second cam face 213B contacts the cam-contacting face 85C, for a predetermined period T8 and deactivate the N clutch 145. In order to switch the nipping force to the greater nipping force, on the other hand, the controller 2 may rotate the second cam 210 from the position, in which the first cam face 213A contacts the cam-contacting face 85C of the lever 85, to the position, in which the outer peripheral surface is separated from the cam-contacting face 85C, for a predetermined period T8 and deactivate the N clutch 145. Thereby, the lever 85 may be pulled upward by the spring 86, and the pressing roller 82 supported by the lever 85 may contact the heating roller 81 at a predetermined nipping force. The controller 2 may, after deactivating the N clutch 145, stop the normal rotation of the development motor 3D. It may be noted that the predetermined period T8 for switching the nipping force from the zero nipping force to the smaller nipping force and the predetermined period T8 for switching the nipping force from the zero nipping force to the greater nipping force are different time periods.

Moreover, in order to switch the nipping force in the fuser 80 from the smaller nipping force as shown in FIG. 17B or the greater nipping force as shown in FIG. 17A to the zero nipping force as shown in FIG. 17C, the controller 2 may maintain the YMC clutch 140A and the K clutch 140K deactivated, control the development motor 3D to rotate in the reverse direction, and activate the N clutch 145. Thereby, the second cam 210 may rotate in the second rotating direction R2 from the posture shown in FIG. 17A or the posture shown in FIG. 17B.

In order to switch the nipping force from the smaller nipping force, the controller 2 may rotate the second cam 210 from the position, in which the second cam face 213B contacts the cam-contacting face 85C of the lever 85, to the position, in which the first cam face 213A contacts the cam-contacting face 85C, for a predetermined period T9 and deactivate the N clutch 145. In order to switch the nipping force from the greater nipping force, on the other hand, the controller 2 may rotate the second cam 210 from the position, in which the outer peripheral surface is separated from the cam-contacting face 85C of the lever 85, to the position, in which the first cam face 213A contacts the cam-contacting face 85C, for a predetermined period T9 and deactivate the N clutch 145. Thereby, the lever 85 may be pushed downward by the second cam 210, and the pressing roller 82 may be separated from the heating roller 81. The controller 2 may, after deactivating the N clutch 145, stop the reverse rotation of the development motor 3D. It may be noted that the predetermined period T9 for switching the nipping force from the smaller nipping force to the zero nipping force and the predetermined period T9 for switching the nipping force from the greater nipping force to the zero nipping force are different time periods.

In the following paragraphs, described with reference to FIGS. 18A-18B through 23 will be exemplary processes to be executed by the controller 2. When the image forming apparatus 1 is standing by for a print job, the developing rollers 61 including the first, second, third, and fourth developing rollers 61Y, 61M, 61C, 61K are all located at the respective separated positions, and the fuser 80 is in the condition of the zero nipping force.

As shown in FIG. 18A, when the controller receives a print job, in S11, the controller 2 controls the development motor 3D to rotate in the normal direction. In S12, the controller 2 activates the N clutch 145 to rotate the second cam 210. In S13, the controller 2 determines whether the predetermined period T8 elapsed since the activation of the N clutch 145. If the controller 2 determines that the predetermined period T8 elapsed (S13: YES), in S14, the controller 2 deactivates the N clutch 145 to stop the rotation of the second cam 210.

In S21, the controller 2 determines whether an image to be printed for a first page in the received print job is a multicolored image. If the controller 2 determines that the image to be printed for the first page is a multicolored image (S21: YES), in S22, the controller 2 performs a multicolor image printing. On the other hand, if the controller 2 determines that the image to be printed for the first page is not a multicolored image but is a monochrome image (S21: NO), in S23, the controller 2 performs a monochrome image printing. Following the image printing for the first page in S22 or S23, in S24, the controller 2 determines whether an image for a next page remains in the print job. If an image for a next page remains (S24: YES), the flow returns to S21 and repeats the steps onward.

If no image for a next page remains in the print job (S24: NO), in S31, as shown in FIG. 18B, the controller 2 stops the normal rotation of the development motor 3D, and in S32, starts rotating the development motor 3D in the reverse direction. In S33, the controller 2 activates the N clutch 145 to rotate the second cam 210. In S34, the controller 2 determines whether the predetermined period T9 elapsed since the activation of the N clutch 145. If the predetermined period T9 elapsed (S34: YES), in S35, the controller 2 deactivates the N clutch 145 to stop the rotation of the second cam 210. In S36, the controller stops the reverse rotation of the development motor 3D and ends the flow.

In the following paragraphs, described with reference to flowcharts in FIGS. 19A-19C and a timing chart in FIG. 20 will be flows of processes for the multicolored image printing. FIGS. 19A-19C and 20 show flows of processes to print a multicolored image for a page. Moreover, in FIG. 20, while a top row indicates movement of the developing roller 61Y for yellow in a timeline, movements of the second, third, and fourth developing rollers 61M, 61C, 61K for magenta, cyan, and black are overlaid on the same timeline.

For multicolored image printing in S22 (see also FIG. 18A), prior to an image forming operation, the first, second, third, and fourth developing rollers 61Y, 61M, 61C, 61K are all located at the respective separated positions. Therefore, as shown in FIG. 19A, in S201 (t0), the controller 2 activates the YMC clutch 140A and the K clutch 140K to cause the first cams 150Y, 150M, 150C, 150K to rotate. Shortly after the first cams 150Y, 150M, 150C, 150K start rotating (t31), the separation sensors 4C, 4K output OFF signals. Thereafter, the controller 2 drives the feeder roller 23 (t51) for a predetermined period so that, in S202, the sheet S may be picked up and conveyed.

After starting conveyance of the sheet S, and before the sheet S reaches the first photosensitive drum 50Y, in S210, the controller 2 determines whether the first period T1 elapsed since the separation sensor 4C for cyan started outputting the OFF signals. If the controller 2 determines that the first period T1 elapsed (S210: YES), in S211 (t32), the controller 2 deactivates the YMC clutch 140A so that the first cams 150Y, 150M, 150C stop rotating at the pausing timing. The first period T1 is set to have a length, in which the contact portion 172 of the cam follower 170 for yellow reaches the position on the second retainer face F2 of the first cam 150Y most adjacent to the second guide face F4. Therefore, when the rotation of the first cams 150Y, 150M, 150C resumes, the second guide face F4 of the first cam 150Y shortly reaches the cam follower 170. In other words, the cam follower 170 for yellow may shortly move to the second guide face F4 of the first cam 150Y, and the first developing roller 61Y may start moving for the contacting position.

In S212, the controller 2 determines whether the second period T2 elapsed since t53, when the pre-registration sensor 28B started outputting ON signals, i.e., when the leading edge of the sheet S passes by the pre-registration sensor 28B. If the controller 2 determines that the second period T2 elapsed (S212: YES), in S213 (t33), the controller 2 activates the YMC clutch 140A to resume the rotation of the first cams 150Y, 150M, 150C at the resuming timing. The second period T2 is set to have a length, in which the development of the toner image on the first photosensitive drum 50Y by the first developing roller 61Y may be rendered in time without being late for the transfer of the developed toner image onto the sheet S.

In S220, after starting the conveyance of the sheet S and before the sheet S reaches the fourth photosensitive drum 50K, the controller 2 determines whether a first period T21, since the separation sensor 4K for black started outputting the OFF signals, elapsed. If the controller 2 determines that the first period T21 elapsed (S220: YES), in S221 (t42), the controller 2 deactivates the K clutch 140K to stop the rotation of the first cam 150K at the pausing timing. The first period T21 is set to have a length, in which the contact portion 172 of the cam follower 170 for black may be located at the position on the second retainer face F2 of the first cam 150K most adjacent to the second guide face F4 at the pausing timing. Therefore, when the rotation of the first cam 150K resumes, the cam follower 170 for black may move shortly to the second guide face F4, and the fourth developing roller 61K may start moving for the contacting position. It may be noted that the first period T21 and the first period T1 are different from each other.

In S222, as shown in FIG. 19B, the controller 2 determines whether a third period T3 elapsed, since the YMC clutch 140 was activated at the resuming timing (t33). If the third period T3 elapsed (S222: YES), in S223 (t36), the controller 2 deactivates the YMC clutch 140A to stop the rotation of the first cams 150Y, 150M, 150C. The third period T3 is set to have a length, in which the first developing roller 61Y, the second developing roller 61M, and the third developing roller 61C are moved and located at the respective contacting positions.

In S224, the controller 2 determines whether a second period T22 since t54, when the post-registration sensor 28C started outputting ON signals, i.e., since the leading edge of the sheet S passed by the post-registration sensor 28C, elapsed. If the controller 2 determines that second period T22 elapsed (S224: YES), in S225 (t43), the controller 2 activates the K clutch 140K to rotate the first cam 150K. The second period T22 is set to have a length, in which the development of the toner image in black on the fourth photosensitive drum 50K by the fourth developing roller 61K may be rendered in time to be transferred onto the sheet S. Therefore, the fourth developing roller 61K is located at the contacting position shortly before the third photosensitive drum 50 is exposed to the laser beam.

In S226, the controller 2 determines whether a predetermine period T23 since t43, when the K clutch 140K was activated, elapsed. If the controller 2 determines that the predetermined period T23 elapsed (S226: YES), in S227 (t44), the controller 2 deactivates the K clutch 140K to stop the rotation of the first cam 150K. The predetermined period T23 is set to have a length, in which the fourth developing roller 61K is moved and located at the contacting position.

In S230, the controller 2 determines whether a fourth period T4 since t57, when the post-registration sensor 28C started outputting the OFF signals, i.e., since the trailing end of the sheet S passed by the post-registration sensor 28C, elapsed. If the controller 2 determines that fourth period T4 elapsed (S230: YES), in S231 (t37), as shown in FIG. 19C, the controller 2 activates the YMC clutch 140A to rotate the first cams 150Y, 150M, 150C to cause the first developing roller 61Y, the second developing roller 61M, the third developing roller 61C to be sequentially separated from the first photosensitive drum 50Y, the second photosensitive drum 50M, and the third photosensitive drum 50C, respectively. The fourth period T4 is set to have a length, in which, after the toner image in yellow is completely developed on the first photosensitive drum 50Y by the first developing roller 61Y, and shortly after completion of transferring the toner image from the first photosensitive drum 50Y to the sheet S, the first developing roller 61Y becomes ready to be moved to the separated position.

In S232, the controller 2 determines whether a predetermine period T13 since t57, when the post-registration sensor 28C started outputting the OFF signals, elapsed. If the controller 2 determines that predetermined period T13 elapsed (S232: YES), in S233 (t45), the controller 2 activates the K clutch 140K to rotate the first cam 150K. The predetermined period T13 is set to have a length, in which, after the toner image in black is completely developed on the fourth photosensitive drum 50K by the fourth developing roller 61K, and shortly after completion of transferring the toner image from the fourth photosensitive drum 50K to the sheet S, the fourth developing roller 61K becomes ready to be moved to the separated position.

In S240, the controller 2 determines whether the separation sensor 4C for cyan is outputting ON signals (i.e., separation signals). If the controller 2 determines that the separation sensor 4C is outputting OFF signals (S240: NO), the controller 2 repeats S240. If the controller 2 determines that the separation sensor 4C is outputting ON signals (S240: YES), in S241 (t40), the controller 2 deactivates the YMC clutch 140A to stop the rotation of the first cams 150Y, 150M, 150C.

In S242, the controller 2 determines whether the separation sensor 4K for black is outputting ON signals. If the controller 2 determines that the separation sensor 4K is outputting OFF signals (S240: NO), the controller 2 repeats S242. If the controller 2 determines that the separation sensor 4K is outputting ON signals (S242: YES), in S243 (t46), the controller 2 deactivates the K clutch 140K to stop the rotation of the cam 150K.

According to the flow described above, the first, second, third, and fourth developing rollers 61Y, 60M, 61C, 61K may move sequentially from the respective separated positions to the respective contacting positions for printing a multicolored image on a page and, after printing the multicolored image on the page, from the respective contacting positions to the respective separated positions. In particular, as shown in FIG. 21, the first developing roller 61Y is moved to contact the first photosensitive drum 50Y at t1, the second developing roller 61M is moved to contact the second photosensitive drum 50M at t2, the third developing roller 61C is moved to contact the third photosensitive drum 50C at t3, and the fourth developing roller 61K is moved to contact the fourth photosensitive drum 50K at t4. In the meantime, in the present embodiment, t1 coincides with t2 (t1=t2). Meanwhile, t1 is earlier than t3 (t1<t3), t2 is earlier than t3 (t2<t3), and t3 is earlier than t4 (t3<t4). Therefore, when a length between t1 and t2 is expressed as |t1−t2|, and when a length between t2 and t3 is expressed as |t2−t3|, the length |t1−t2| is shorter than the length |t2−t3| (|t1−t2|<|t2−t3|). In this regard, in the present embodiment, an earlier time may be expressed by a smaller value, and a later time may be expressed by a larger value. Therefore, subtraction of the value expressing the earlier time from the value expressing the later time results a positive value, and subtraction of the value expressing the later time from the value expressing the earlier time results a negative value. Moreover, an absolute value between the value expressing the earlier time and the value expressing the later time expresses a length of the time period between the earlier time and the later time. Optionally, but not necessarily, t2 may be set to be earlier than t1 (t2<t1), which results a negative value. If t2 is set to be earlier than t1, the second developing roller 61M should be moved earlier to the contacting position than the first developing roller 61Y.

Moreover, the first developing roller 61Y is moved to be separated from the first photosensitive drum 50Y at t11, the second developing roller 61M is moved to be separated from the second photosensitive drum 50M at t12, the third developing roller 61C is moved to be separated from the third photosensitive drum 50C at t13, and the fourth developing roller 61K is moved to be separated from the fourth photosensitive drum 50K at t14. In the present embodiment, t11 is earlier than t12, t12 is earlier than t13, and t13 is earlier than t14 (t11<t12<t13<t14). Therefore, when the length between t1 and t2 is expressed as |t1−t2|, and when a length between t11 and t12 is expressed as |t11−t12|, the absolute value between t1 and 12 is set to be smaller than the absolute value between t11 and t12 (|t1−t2|<|t11−t12|).

In the following paragraphs, described with reference to flowcharts in FIGS. 22A-22B and a timing chart in FIG. 23 will be flows of processes for the monochrome image printing. FIGS. 22A-22B and 23 show flows of processes to print a monochrome image for a page.

For the monochrome image printing in S23 (see also FIG. 18A), prior to an image forming operation, the first, second, third, and fourth developing rollers 61Y, 61M, 61C, 61K are all located at the respective separated positions. Moreover during the image forming operation for the monochrome image printing, the controller 2 controls the YMC clutch 140A to stay inactive so that the first, second, and third developing rollers 61Y, 61M, 61C are maintained at the respective separated positions. Meanwhile, in order to move the fourth developing roller 61K to the contacting position, in S301 (t0), as shown in FIG. 22A, the controller 2 activates the K clutch 140K to cause the first cam 150K to rotate. Shortly after the first cam 150K starts rotating (t61), the separation sensor 4K for black outputs OFF signals. Thereafter, the controller 2 drives the feeder roller 23 (t61) for a predetermined period so that, in S302, the sheet S may be picked up and conveyed.

After starting the conveyance of the sheet S. and before the sheet S reaches the fourth photosensitive drum 50K, in S310, the controller 2 determines whether a first period T21, since the separation sensor 4K for black started outputting the OFF signals, elapsed. If the controller 2 determines that the first period T21 elapsed (S310: YES), in S311 (t62), the controller 2 deactivates the K clutch 140K to stop the rotation of the first cam 150K at the pausing timing. The first period T21 is set to have a length, in which the contact portion 172 of the cam follower 170 for black may be located at the position on the second retainer face F2 of the first cam 150K most adjacent to the second guide face F4. Therefore, when the rotation of the first cam 150K resumes, the cam follower 170 for black may move shortly to the second guide face F4, and the fourth developing roller 61K may start moving for the contacting position. It may be noted that the first period T21 for the monochrome image printing and the first period T1 for the multicolored image printing are different from each other.

In S312, the controller 2 determines whether a second period T22 since t154, when the pre-registration sensor 28B started outputting ON signals, i.e., since the leading edge of the sheet S passes by the post-registration sensor 28C, elapsed. If the controller 2 determines that the second period T22 elapsed (S312: YES), in S313 (t63), the controller 2 activates the K clutch 140K to resume the rotation of the first cam 150K at the resuming timing. The second period T22 is set to have a length, in which the development of the toner image in black on the fourth photosensitive drum 50K by the fourth developing roller 61K may be rendered in time to be transferred onto the sheet S. The second period T22 for the monochrome image printing and the second period T2 for the multicolored image printing are different from each other.

In S324, as shown in FIG. 22B, the controller 2 determines whether a predetermine period T23 since t63, when the K clutch 140K was activated, elapsed. If the controller 2 determines that the predetermined period T23 elapsed (S324: YES), in S325 (t66), the controller 2 deactivates the K clutch 140K to stop the rotation of the first cam 150K. The predetermined period T23 is set to have a length, in which the fourth developing roller 61K is moved and located at the contacting position.

In S332, the controller 2 determines whether a predetermine period T13 since t57, when the post-registration sensor 28C started outputting the OFF signals, elapsed. If the controller 2 determines that predetermined period T13 elapsed (S332: YES), in S333 (t67), the controller 2 activates the K clutch 140K to rotate the first cam 150K.

In S342, the controller 2 determines whether the separation sensor 4K for black is outputting ON signals. If the controller 2 determines that the separation sensor 4K is outputting OFF signals (S342: NO), the controller 2 repeats S342. If the controller 2 determines that the separation sensor 4K is outputting ON signals (S342: YES), in S343 (t70), the controller 2 deactivates the K clutch 140K to stop the rotation of the cam 150K.

Meanwhile, the first developing roller 61Y, the second developing roller 61M, and the third developing roller 61C are maintained at the respective separated positions. In other words, the first developing roller 61Y, the second developing roller 61M, and the third developing roller 61C may be prevented from being rotated for not developing any toner images.

In the following paragraphs, described with reference to FIGS. 24A-24D through 26A-26C will be the detailed behaviors of the sheet S and the developing roller 61.

For multicolored image printing in the image forming apparatus 1 with use of the first developing roller 61Y, the second developing roller 61M, the third developing roller 61C, and the fourth developing roller 61K, in order to transfer the toner images to the sheet S, the first developing roller 61Y, the second developing roller 61M, the third developing roller 61C, and the fourth developing roller 61K may be moved to the respective contacting positions synchronously with the conveyance of the sheet S, and after the toner images are developed on the first, second, third, and fourth photosensitive drums 50Y, 50M, 50C, 50K, the first developing roller 61Y, the second developing roller 61M, the third developing roller 61C, and the fourth developing roller 61K may be moved to the respective separated positions.

For example, as shown in FIG. 24A, before the sheet S reaches the first photosensitive drum 50Y, which is at the most upstream position in the conveying direction among the four (4) photosensitive drums 50, the first developing roller 61Y, the second developing roller 61M, the third developing roller 61C, and the fourth developing roller 61K are all located at the respective separated positions. At the separated positions, the second developing cartridge 60M coincides with the light path of the laser beam for scanning the first photosensitive drum 50Y, the third developing cartridge 60C coincides with the light path of the laser beam for scanning the second photosensitive drum 50M, and the fourth developing cartridge 60K coincides with the light path of the laser beam for scanning the third photosensitive drum 50C.

As the sheet S approaches the first photosensitive drum 50Y, as shown in FIG. 24B, the first developing cartridge 60Y and the second developing cartridge 60M may be moved simultaneously, before the first photosensitive drum 50Y is exposed to the laser beam, to locate the first developing roller 61Y and the second developing roller 61M at the respective contacting positions. Therefore, the light path of the laser beam emitted at the first photosensitive drum 50Y is cleared without being interrupted by the second developing cartridge 60M so that the first photosensitive drum 50Y may be exposed to the laser beam clearly. The first developing roller 61Y may develop the toner image on the first photosensitive drum 50Y, and the developed toner image may be transferred from the first photosensitive drum 50Y to the sheet S.

As the sheet S approaches the second photosensitive drum 50M, as shown in FIG. 24C, the third developing cartridge 60C may be moved, before the second photosensitive drum 50M is exposed to the laser beam, to locate the third developing roller 61C at the contacting position. Therefore, the light path of the laser beam emitted at the second photosensitive drum 50M is cleared without being interrupted by the third developing cartridge 60C so that the second photosensitive drum 50M may be exposed to the laser beam clearly. The second developing roller 61M may develop the toner image on the second photosensitive drum 50M, and the developed toner image may be transferred from the second photosensitive drum 50M to the sheet S.

As the sheet S approaches the third photosensitive drum 50C, as shown in FIG. 24D, the fourth developing cartridge 60K may be moved, before the third photosensitive drum 50C is exposed to the laser beam, to locate the fourth developing roller 61K at the contacting position. Therefore, the light path of the laser beam emitted at the third photosensitive drum 50C is cleared without being interrupted by the fourth developing cartridge 60K so that the third photosensitive drum 50C may be exposed to the laser beam clearly. The third developing roller 61C may develop the toner image on the third photosensitive drum 50C, and the developed toner image may be transferred from the third photosensitive drum 50C to the sheet S. Moreover, the fourth developing roller 61K moved to the contacting position may develop the toner image on the fourth photosensitive drum 50K.

Figure 25A:
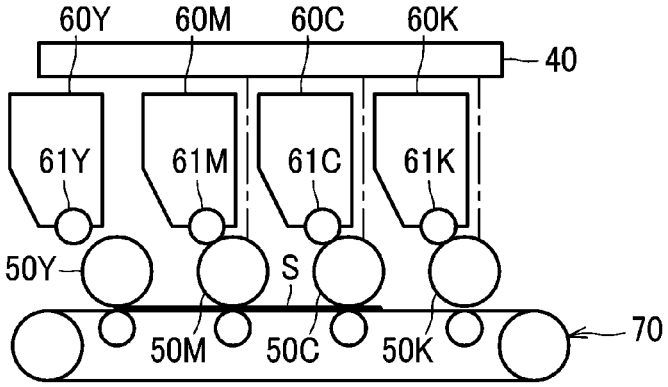

After the toner image is completely developed by the first developing roller 61Y on the first photosensitive drum 50Y, and before the toner image is completely developed by the second developing roller 61M on the second photosensitive drum 50M, as shown in FIG. 25A, the first developing cartridge 60Y is moved to locate the first developing roller 61Y at the separated position.

Figure 25B:
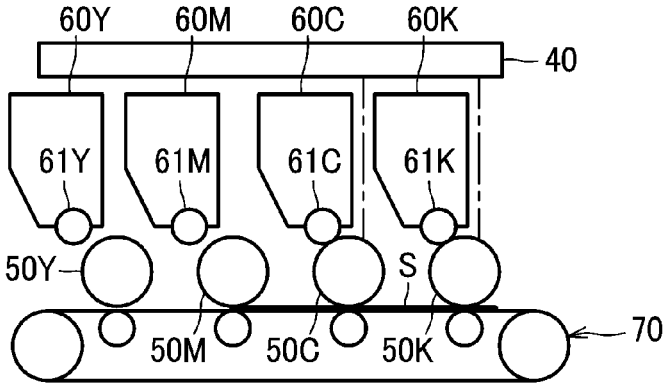

After the toner image is completely developed by the second developing roller 61M on the second photosensitive drum 50M, and before the toner image is completely developed by the third developing roller 61C on the third photosensitive drum 50C, as shown in FIG. 25B, the second developing cartridge 60M is moved to locate the second developing roller 61M at the separated position.

Figure 25C:
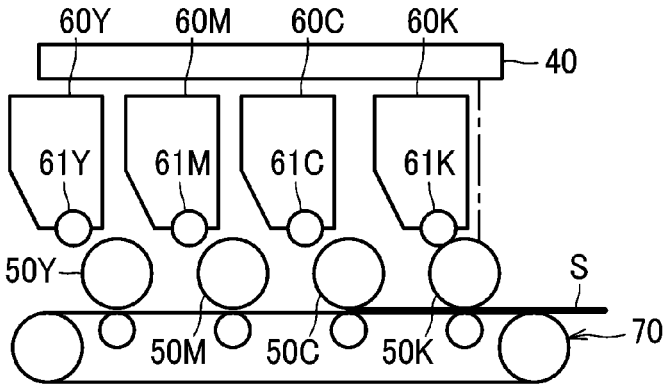

After the toner image is completely developed by the third developing roller 61C on the third photosensitive drum 50C, and before the toner image is completely developed by the fourth developing roller 61K on the fourth photosensitive drum 50K, as shown in FIG. 25C, the third developing cartridge 60C is moved to locate the third developing roller 61C at the separated position.

Figure 25D:
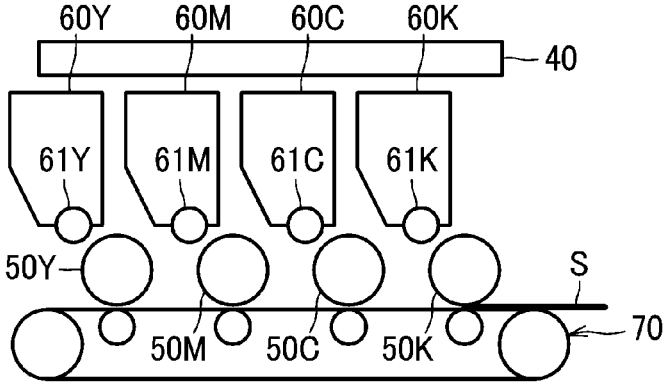

After the toner image is completely developed by the fourth developing roller 61K on the fourth photosensitive drum 50K, as shown in FIG. 25D, the fourth developing cartridge 60K is moved to locate the fourth developing roller 61K at the separated position.

For monochrome image printing in the image forming apparatus 1 with use of the fourth developing roller 61K alone, in order to transfer the toner image to the sheet S, as shown in FIGS. 26A-26C, the first developing roller 61Y, the second developing roller 61M, and the third developing roller 61C for the colors that are not used, i.e., yellow, magenta, and cyan, are maintained at the respective separated positions. Meanwhile, the fourth developing roller 61K for black may be moved to the contacting position for developing the toner image and, after complete development of the toner image on the fourth photosensitive drum 50K, moved to the separated position synchronously with the conveyance of the sheet S.

For example, as shown in FIG. 26B, the fourth developing cartridge 60K may be moved, before the fourth photosensitive drum 50K is exposed to the laser beam, to locate the fourth developing roller 61K at the contacting position. After the toner image is completely developed on the fourth photosensitive drum 50K, as shown in FIG. 26C, the fourth developing roller 61K may be moved to the separated position.

Benefits achievable by the image forming apparatus 1 described above will be described below. In the image forming apparatus 1 according to the embodiment, the driving-force transmitter 100 may transmit the driving force from the development motor 3D not only to the developing roller 61 but also to the moving mechanism 5 and the nipping-force adjuster 200. Therefore, the development motor 3D, which may drive the developing roller 61, may cause the moving mechanism 5 to move the developing roller 61 to contact or separate from the photosensitive drum 50 and cause the nipping-force adjustor 200 to switch the nipping forces in the fuser 80. In other words, actions of driving the developing roller 61, moving the developing roller 61 to contact or separate from the photosensitive drum 50, and switching the nipping forces in the fuser 80 may be driven by the single motor alone, i.e., the development motor 3D, without providing a dedicated motor for each action.

Moreover, the driving-force transmitter 100 is arranged not to transmit the driving force from the development motor 3D to the developing roller 61 when the developing roller 61 is located at the separated position. In other words, when the developing roller 61 is located at the separated position, in which the developing roller 61 does not develop a toner image, the developing roller 61 may be restrained from rotating. Therefore, rotating activity of the developing roller 61 may be reduced, and the toner may be restrained from being exhausted or impaired.

In the image forming apparatus 1 according to the embodiment, with use of the cam face 213 of the second cam 210, the nipping force in the fuser 80 may be switched from the zero nipping force to either the smaller nipping force or the greater nipping force, when the development motor 3D rotates in the normal direction, and from either the smaller nipping force or the greater nipping force to the zero nipping force, when the development motor 3D rotates in the reverse direction. Therefore, the second cam may not necessarily be provided with two different cam faces; a cam face to switch the nipping force from the zero nipping force to either the smaller nipping force or the greater nipping force and another cam face to switch the nipping force from either the smaller nipping force or the greater nipping force to the zero nipping force. In this regard, the second cam 210 may be provided in a smaller size.

Moreover, when the nipping force in the fuser 80 is at the zero nipping force, the heating roller 81 and the pressing roller 82 are separated from each other. Therefore, when the sheet S is jammed at the position between the heating roller 81 and the pressing roller 82, the sheet S may be removed easily by placing the fuser 80 at the zero nipping force, and the sheet jam may be cleared easily.

Moreover, the development motor 3D rotating in the normal direction may move the developing roller 61 between the contacting position and the separated position and switch the nipping force in the fuser 80 from the zero nipping force to either the smaller nipping force or the greater nipping force. Therefore, once the image forming apparatus 1 receives a print job and activates the development motor 3D to rotate in the normal direction to perform image printing, an image for the print job may be printed smoothly without switching the rotating directions of the development motor 3D. For example, if the nipping force is switchable from the zero nipping force to either the smaller nipping force or the greater nipping force by reverse rotation of a development motor, once the image forming apparatus receives a print job, the development motor may be rotated in the reverse direction so that the nipping force may be switched from the zero nipping force to either the smaller nipping force or the greater nipping force; after the nipping forces are switched, the development motor rotating in the reverse direction may be stopped for a pause, and the development motor may be rotated in the normal direction once again to move the development roller 61 to the contacting position and rotate. In this regard, according to the image forming apparatus 1, the normal rotation of the development motor 3D may be maintained through the actions to switch the nipping forces and to print the image. Therefore, a running time from input of the print job to output of the image on the sheet S may be shortened.

Moreover, according to the image forming apparatus 1, when the image forming apparatus 1 is standing by for image printing, the developing roller 61 is located at the separated position. In this regard, the developing roller 61 may be restrained from contacting the photosensitive drum 50 idly. Therefore, the developing roller 61 may be restrained from being exhausted or impaired, and the toner may be restrained from being adhesive between the developing roller 61 and the photosensitive drum 50. Further, when the image forming apparatus 1 is standing by for image printing, the nipping force in the fuser 80 is zero, in other words, the heating roller 81 and the pressing roller 82 are separated. Therefore, the pressing roller 82 may be restrained from urged against the heating roller 81 for not fusing any image, and the pressing roller 82 may be restrained from being exhausted or impaired.

Moreover, the image forming apparatus 1 may switch the nipping forces between zero nipping force and the smaller nipping force and between zero nipping force and the greater nipping force. In this regard, the nipping force in the fuser 80 may be set at either the smaller nipping force or the greater nipping force. Therefore, the nipping force more preferable to a character or texture of the sheet S, such as thickness, material, etc., may be selectable to fuse the toner image on the sheet S.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the second cam 210 in the nipping-force adjuster 200 may not necessarily move the pressing roller 82 to switch the nipping forces but may move the heating roller 81 to switch the nipping forces between the pressing roller 82 and the heating roller 81. Moreover, the nipping-force adjuster 200 may move both the heating roller 81 and the pressing roller 82 to switch the nipping forces between the pressing roller 82 and the heating roller 81.

For another example, the nipping forces between the pressing roller 82 and the heating roller 81 may not necessarily be switchable among the three (3) levels of zero nipping force, the smaller nipping force, and the greater nipping force but may be switchable between two (2) levels or among four (4) or more levels. For another example, the heating roller 81 and the pressing roller 82 at zero nipping force may not necessarily be separated from each other but may contact each other.

For another example, the heating roller 81 may be replaced with, for example, a heater unit having a heated endless belt. Moreover, the pressing roller 82 may be replaced with, for example, a pressing unit having a pressing endless belt.

For another example, the belt unit 70 with the conveyer belt 73 may be replaced with a belt unit with an intermediate transfer belt.

For another example, the image forming apparatus 1 may not necessarily be limited to the image forming apparatus for forming multicolored images in the toners of four colors but may be an image forming apparatus for forming multicolored images in toners of three colors, five colors, or a different number of colors. For another example, the image forming apparatus may be a monochrome printer for forming a monochrome image in single-colored toner having a single set of photosensitive drum, developing roller, and cam, etc.

For another example, the image forming apparatus may be a multifunction peripheral machine or a copier.

What is claimed is:

1. An image forming apparatus, comprising:

a photosensitive drum;

a developing roller configured to be movable between a contacting position, in which the developing roller contacts the photosensitive drum, and a separated position, in which the developing roller is separated from the photosensitive drum;

a moving mechanism configured to move the developing roller between the contacting position and the separated position;

a fuser comprising a heating member and a pressing member, the pressing member being configured to nip a sheet at a position between the heating member and the pressing member;

a nipping-force adjuster configured to switch a nipping force between the heating member and the pressing member in the fuser between a first nipping force and a second nipping force, the second nipping force being greater than the first nipping force;

a motor; and a driving-force transmitter comprising a first idle gear, the first idle gear being configured to transmit a driving force from the motor to the developing roller, to the moving mechanism, and to the nipping-force adjuster.

2. The image forming apparatus according to claim 1, wherein the motor is rotatable bidirectionally in a normal direction and a reverse direction;

wherein the driving-force transmitter is configured to transmit the driving force from the motor to the developing roller when the motor rotates in the normal direction;

wherein the moving mechanism is configured to move the developing roller between the contacting position and the separated position when the motor rotates in the normal direction; and wherein the nipping-force adjuster is configured to switch the nipping force in the fuser from the first nipping force to the second nipping force when the motor rotates in the normal direction and to switch the nipping force from the second nipping force to the first nipping force when the motor rotates in the reverse direction.

3. The image forming apparatus according to claim 2, wherein the moving mechanism comprises a first cam configured to control a position of the developing roller, the first cam being configured to rotate by receiving the driving force from the motor; and wherein the driving-force transmitter comprises a first clutch configured to switch state of the first cam between rotating and stationary by switching between a condition, in which the driving-force transmitter is transmittable of the driving force from the motor to the first cam, and a condition, in which the driving force from the motor is discontinued without being transmitted to the first cam.

4. The image forming apparatus according to claim 3, further comprising a developing cartridge comprising the developing roller, wherein the first cam is configured to rotate about an axis parallel to a rotation-axis direction, the rotation-axis direction being a direction of a rotation axis of the developing roller, the first cam comprising a first cam portion protruding in the rotation-axis direction; and wherein the moving mechanism comprises a cam follower, the cam follower being configured to contact the first cam portion in the first cam and press the developing cartridge by slidably moving in the rotation-axis direction.

5. The image forming apparatus according to claim 4, further comprising a supporting member configured to support the developing cartridge, wherein the developing cartridge comprises a slider member configured to slidably move in the rotation-axis direction by being pressed by the cam follower; and wherein the slider member comprises an oblique face inclining with respect to the rotation-axis direction, the oblique face being configured to contact the supporting member and urge the developing cartridge in a direction orthogonal to the rotation-axis direction.

6. The image forming apparatus according to claim 4, wherein the driving-force transmitter is mechanically connected with the moving mechanism, the driving-force transmitter being configured to discontinue the driving force from the motor not to be transmitted to the developing roller when the developing roller is located at the separated position.

7. The image forming apparatus according to claim 6, wherein the driving-force transmitter comprises:

a second cam portion configured to rotate integrally with the first cam;

a clutch including a planetary gear assembly, the clutch being switchable between a transmittable condition, in which the clutch is transmittable of the driving force from the motor to the developing roller, and a discontinuing condition, in which the driving force from the motor is discontinued; and a lever swingable to contact and separate from the second cam portion, the lever being configured to place the clutch in the transmittable condition when the lever separating from the second cam portion engages with one of elements in the planetary gear assembly rotating alongside rotation of the motor in the normal direction, the lever being configured to place the clutch in the discontinuing condition at least one of when the lever contacting the second cam portion separates from the one of the elements in the planetary gear assembly and when the one of the elements in the planetary gear assembly rotates alongside rotation of the motor in the reverse direction.

8. The image forming apparatus according to claim 3, wherein the nipping-force adjuster comprises a second cam configured to move one of the heating member and the pressing member to switch the nipping forces, the second cam being configured to rotate by receiving the driving force from the motor;

wherein the driving-force transmitter comprises a second clutch configured to switch state of the second cam between rotating and stationary by switching between a condition, in which the driving-force transmitter is transmittable of the driving force from the motor to the second cam, and a condition, in which the driving force from the motor is discontinued without being transmitted to the second cam.

9. The image forming apparatus according to claim 1, wherein the heating member and the pressing member are separated from each other when the nipping force in the fuser is at the first nipping force.

10. The image forming apparatus according to claim 9, wherein the nipping-force adjuster is further configured to switch the nipping force between the first nipping force and a third nipping force being greater than the first nipping force; and wherein the nipping-force adjuster is further configured to switch the nipping force between the first nipping force and a fourth nipping force being greater than the third nipping force.

11. An image forming apparatus, comprising:

a photosensitive drum;

a developing roller configured to be movable between a contacting position, in which the developing roller contacts the photosensitive drum, and a separated position, in which the developing roller is separated from the photosensitive drum;

a moving mechanism configured to move the developing roller between the contacting position and the separated position;

a fuser comprising a heating member and a pressing member;

a nipping-force adjuster configured to switch a nipping force between the heating member and the pressing member in the fuser between a first nipping force and a second nipping force, the second nipping force being greater than the first nipping force;

a development motor; and a first idle gear which couples the development motor with the developing roller, the moving mechanism, and the nipping-force adjuster.

12. The image forming apparatus according to claim 11, further comprising:

a belt unit configured to transfer a toner image formed on the photosensitive drum to a sheet; and a process motor configured to drive the photosensitive drum and the belt unit.

13. The image forming apparatus according to claim 11, further comprising a fuser motor configured to drive the heating member.

14. The image forming apparatus according to claim 11, wherein the development motor is rotatable bidirectionally in a normal direction and a reverse direction;

wherein the developing roller is configured to be driven by a driving force from the development motor when the development motor rotates in the normal direction;

wherein the moving mechanism is configured to move the developing roller between the contacting position and the separated position by the driving force from the development motor when the development motor rotates in the normal direction; and wherein the nipping-force adjuster is configured to switch the nipping force in the fuser from the first nipping force to the second nipping force when the development motor rotates in the normal direction and to switch the nipping force from the second nipping force to the first nipping force when the development motor rotates in the reverse direction.

15. The image forming apparatus according to claim 1, further comprising a second idle gear configured to transmit the driving force from the first idle gear to the developing roller and to the nipping-force adjuster.

16. The image forming apparatus according to claim 11, further comprising a second idle gear which couples the first idle gear to the developing roller and to the nipping-force adjuster.

17. An image forming apparatus, comprising:

a moving mechanism configured to move a developing roller between a contacting position, in which the developing roller contacts a photosensitive drum, and a separated position, in which the developing roller is separated from the photosensitive drum;

a fuser comprising a heating member and a pressing member;

a nipping-force adjuster configured to switch a nipping force between the heating member and the pressing member in the fuser between a first nipping force and a second nipping force, the second nipping force being greater than the first nipping force;

a motor; and a gear which couples the motor with the moving mechanism and with the nipping-force adjuster.

18. An image forming apparatus, comprising:

a first moving mechanism configured to move a first developing roller between a first contacting position, in which the first developing roller contacts a first photosensitive drum, and a first separated position, in which the first developing roller is separated from the first photosensitive drum;

a second moving mechanism configured to move a second developing roller between a second contacting position, in which the second developing roller contacts a second photosensitive drum, and a second separated position, in which the second developing roller is separated from the second photosensitive drum;

a fuser comprising a heating member and a pressing member, the pressing member being configured to nip a sheet at a position between the heating member and the pressing member;

a nipping-force adjuster configured to switch a nipping force between the heating member and the pressing member in the fuser between a first nipping force and a second nipping force, the second nipping force being greater than the first nipping force;

a motor; and a driving-force transmitter comprising:

a first gear train configured to transmit the driving force from the motor to the first developing roller, the first gear train comprising a first idle gear;

a second gear train configured to transmit the driving force from the motor to the second developing roller, the second gear train comprising a second idle gear;

a third gear train configured to transmit the driving force from the first idle gear to the first moving mechanism, the third gear train comprising a third idle gear;

a fourth gear train configured to transmit the driving force from the second idle gear to the second moving mechanism; and a fifth gear train configured to transmit the driving force from the third idle gear to the nipping-force adjuster.

19. The image forming apparatus according to claim 18, wherein the first idle gear is disposed between the motor and the third idle gear.

* * * * *